US006439788B1

(12) United States Patent
Wakahara et al.

(10) Patent No.: US 6,439,788 B1
(45) Date of Patent: Aug. 27, 2002

(54) IMAGE FORMING APPARATUS

(75) Inventors: Shirou Wakahara, Chiba; Kazuya Masuda, Nara; Hajime Yoshinaga, Ikoma-gun, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/255,455

(22) Filed: Feb. 19, 1999

(30) Foreign Application Priority Data

Feb. 20, 1998 (JP) ..... 10/039384

(51) Int. Cl.[7] ..... B41J 2/06
(52) U.S. Cl. ..... 400/719; 347/55; 347/141
(58) Field of Search ..... 347/54, 55, 141, 347/142, 112, 111; 400/719

(56) References Cited

U.S. PATENT DOCUMENTS

| | | | | |
|---|---|---|---|---|
| 5,121,144 A | | 6/1992 | Larson et al. | 346/154 |
| 5,781,218 A | * | 7/1998 | Wakahara et al. | 347/141 |
| 6,015,208 A | * | 1/2000 | Wakahara et al. | 347/55 |
| 6,357,861 B1 | * | 3/2002 | Katsumi | 347/55 |

FOREIGN PATENT DOCUMENTS

| | | |
|---|---|---|
| EP | 0 719 648 A1 | 7/1996 |
| EP | 0 788 887 A1 | 8/1997 |

* cited by examiner

*Primary Examiner*—Andrew H. Hirshfeld
*Assistant Examiner*—Kevin D. Williams
(74) *Attorney, Agent, or Firm*—David G. Conlin; Peter J. Manus; Dike Bronstein Roberts & Cushman

(57) ABSTRACT

An image forming apparatus of the present invention includes ring electrodes for controlling flying of toner from a carrier to a sheet, and a control power source section for applying a potential that is in accordance with an image signal to each ring electrode. The control power source section carries out, in the case where the image signal is applied to each ring electrode so that the potential is applied at the same timing, a control of shifting the timing of applying ON potential so that the sum of transient current flowing through each ring electrode at a predetermined time is smaller than the sum of maximum value of the transient current flowing through each ring electrode. This ensures that the amount of transient current supplied at a predetermined time to each ring electrode by the control power source section is reduced.

20 Claims, 33 Drawing Sheets

IMAGE FORMING APPARATUS

FIELD OF THE INVENTION

The present invention relates to an image forming apparatus for allowing toner to fly in a direction from a toner carrier to a counter electrode so as to directly form an image on a sheet transported between the toner carrier and the counter electrode. The image forming apparatus is applicable to various devices such as a printing section of a digital copying machine and a facsimile device, a digital printer, and a plotter.

BACKGROUND OF THE INVENTION

Conventionally, as an image forming apparatus for forming a visible image in accordance with an image signal on a recording medium such as paper, for example, the apparatus as disclosed in Japanese Unexamined Patent publication No. 211970/1992 (Tokukaihei 4-211970) has been available. The image forming apparatus (electrographic printer) as disclosed in this publication is provided with, as shown in FIG. 31, a development roller 102 and a background electrode 103. The development roller 102 is a carrier for carrying pigment particles 101 such as toner. The background electrode 103 is a counter electrode facing the development roller 102. To the background electrode 103 is applied a potential for drawing the pigment particles 101 in the direction towards the background electrode 103. towards the background electrode 103.

Between the development roller 102 and the background electrode 103 is provided an electrode matrix 104 (control electrode section) having a plurality of passages 105. The electrode matrix 104 is provided with electrodes, corresponding one to one to the passages 105, for controlling the electric field between the electrode matrix 104 and the development roller 102. The passage of the pigment particles 101 through each passage 105 is controlled by these electrodes corresponding to the passages 105.

Namely, in this type of image forming apparatus, flying of pigment particles 101 is controlled (allowed or prevented) by the electrode matrix 104 under a strong electric field generated between the development roller 102 and the background electrode 103. This allows the pigment particles 101 held on the development roller 102 to pass through predetermined passages 105 to reach a sheet 106 transported between the electrode matrix 104 and the background electrode 103, thus directly forming an image made of the pigment particles 101 on the sheet 106.

Therefore, the above image forming apparatus omits a developing medium, such as a photoreceptor for carrying an electrostatic image or toner image in accordance with an image signal, and a dielectric drum for temporarily carrying a toner image before transfer of the toner image formed on a photoreceptor onto a sheet takes place. This reduces the number of components and simplifies the structure of the apparatus, thus realizing a more compact and less expensive apparatus with ease. Also, because the transfer process from the developing medium to the sheet is omitted, the image is prevented from deterioration, and the reliability of the image forming apparatus is improved.

The following describes the problems associated with the above image forming apparatus. To begin with, two arbitrary electrodes of the electrodes formed on the electrode matrix 104, corresponding to the passages 105 are electrodes 104*m* and 104*n*. Here, for example as shown in FIG. 32, when an image signal is simultaneously applied to the electrodes 104*m* and 104*n*, for example, an ON potential of 150 V is applied to each of the electrodes 104*m* and 104*n* for a predetermined period in synchronization with the image signal, and then, for example, an OFF potential of −200 V is applied to the each of the electrodes 104*m* and 104*n*.

Incidentally, at the moment when the ON potential or OFF potential is applied to a single electrode, that is, at the moment when the potential applied to a single electrode is switched to the ON potential or to the OFF potential, typically, a transient current of, for example, about 140 $\mu$A flows through each electrode. Namely, as shown in FIG. 33, for example, in the case where the ON potential is simultaneously applied to the two electrodes 104*m* and 104*n* in accordance with the image signal, a total of about 280 $\mu$A of transient current is supplied as a peak current at one instant from a power source.

While such a transient current is minute through one to several electrodes, it amounts to a huge value when the ON potential is simultaneously applied to several hundreds to several thousands of electrodes, as in the case of carrying out solid-black printing for example. More specifically, for example, supposing 2560 electrodes are provided on the electrode matrix 104, corresponding to the passages 105, when the ON potential is simultaneously applied to these electrodes, a transient current of 358.4 mA (140 $\mu$A×2560=358400 $\mu$A=358.4 mA) is supplied from the power source at one instant.

Here, it is not generally preferable to adopt a power source having a large current capacity capable of supplying a transient current of, for example, 70 mA or more, as a power source for applying a high voltage such as the ON and OFF potentials to the matrix electrode 104. This is because when the current capacity is large, in the event of accident, such as a high voltage leak in which the high voltage applied to the electrode matrix 104 is leaked via sheet 106 as the sheet 106 is brought into contact with the electrode matrix 104 when printing, and malfunctioning of the apparatus, the output potential does not drop due to the fact that the current supplying ability of the power source is large, and as a result the high voltage flows into other circuits, causing troubles such as destruction of the circuits. Also, when other devices, such as a computer, are connected to the image forming apparatus, such devices may be destroyed as well. Further, in the worst case, if the user happens to be touching the image forming apparatus, the user may be electrified by the occurrence of such an event.

To prevent such an accident, a high-level insulation may be provided for the parts of the apparatus to which the high-voltage is applied or even for the entire apparatus. Yet, this is not preferable because of the high cost associated with this action.

Thus, the conventional image forming apparatus has the problem that when the number of electrodes on the electrode matrix 104 is large, a transient current exceeding an acceptable value is supplied from the power source, and as a result reliability of the apparatus is lowered.

Also, because a power source having a large current capacity is required, another problem is presented that the size and cost of the apparatus are increased. This problem especially becomes serious when the image forming apparatus is compliant with printing of large sheet 106 or has high resolution. Further, in a high-speed image forming apparatus, the number of times the apply potential is switched per unit time becomes larger, and this necessitates a power source capable of supplying even larger transient current, causing the foregoing problems as well.

SUMMARY OF THE INVENTION

The present invention offers a solution to the above-mentioned problems, and accordingly it is an object of the present invention to provide an image forming apparatus which does not require a power source having a large current capacity even when the number of control electrodes is large, and thus capable of reducing the size and cost of the apparatus and also improving reliability of the apparatus.

In order to solve the above-mentioned problems, an image forming apparatus in accordance with the present invention includes: a carrier for carrying developer particles; a counter electrode positioned so as to face the carrier; a control electrode section having a plurality of passage pores constituting a passage of developer particles flying from the carrier to the counter electrode, and a plurality of gate electrodes formed one to one around the plurality of passage pores; and potential applying means for applying a potential that is in accordance with an image signal to the plurality of gate electrodes, the image forming apparatus characterized in that the potential applying means applies a predetermined potential to each of the plurality of gate electrodes so that a sum of current flowing through each of the plurality of gate electrodes at a predetermined time by application of the predetermined potential is smaller than a sum of maximum value of the current flowing through each of the plurality of gate electrodes.

With this arrangement, the potential applying means applies a predetermined potential to the gate electrodes of the control electrode section, thus controlling flying of the developer particles held on the carrier towards the counter electrode by the potential of each gate electrode.

Here, when the potential applying means applies the predetermined potential to the gate electrodes, a transient current momentarily flows through each gate electrode when the potential is changed. If the timing of applying the predetermined potential is the same, the transient current is supplied from the potential applying means simultaneously. This means that when the number of gate electrodes is large, potential applying means capable of supplying a large transient current is required.

However, in the described arrangement, the potential applying means applies the predetermined potential to each gate electrode so that the sum of current flowing through each gate electrode at a predetermined time is smaller than the sum of maximum value of the current flowing through each gate electrode.

The potential applying means may realize this control, for example, by shifting the timing of applying the predetermined potential by a predetermined amount with respect to each gate electrode, or by grouping the plurality of gate electrodes, and while simultaneously applying the predetermined potential to the gate electrodes of a same group, applying the predetermined potential to the gate electrodes of different groups at a different timing. Here, it is preferable that the shifting of timing of set in accordance with a duration (transient response period) of the transient current.

This ensures that the amount of current supplied at a predetermined time by the potential applying means is significantly reduced compared with the conventional case where the potential is applied to the gate electrodes at the same timing.

As a result, it is not required to provide potential applying means having a particularly large current capacity even when the number of gate electrodes is increased.

Therefore, with the described arrangement, even when adopting a control electrode section having large numbers of gate electrodes, it is possible to use potential applying means having the current capacity which has been available conventionally, thus preventing an increase in size and cost of the potential applying means, preventing in turn an increase in size and cost of the apparatus.

Also, because the current capacity of the potential applying means is not particularly large, even when a high voltage leak, etc., is generated via the control electrode section, the output potential is reduced to some degree upon occurrence of such an event. Therefore, problems, such as destruction of other circuits and the apparatus, do not occur, thus improving reliability of the apparatus, and it is not required to take a high-level insulation measure.

Note that, as long as the transient current is flown as a result of applying the potential to the gate electrodes, the potential may be a potential for controlling flying of developer particles, such as a flying potential for allowing the developer particles to fly towards the counter electrode and a flying preventing potential for preventing flying of developer particles towards the counter electrode, or alternatively, a cleaning potential for cleaning the control electrode section.

In order to solve the above-mentioned problems, another image forming apparatus of the present invention includes: a plurality of carriers, each carrying developer particles of different color; a counter electrode positioned so as to face the plurality of carriers; a plurality of control electrode sections, each having a plurality of passage pores constituting a passage of developer particles flying from the plurality of carriers to the counter electrode, and a plurality of gate electrodes formed one to one around the plurality of passage pores; and potential applying means for applying a potential that is in accordance with an image signal to the plurality of gate electrodes, the image forming apparatus characterized in that the potential applying means applies a predetermined potential to each of the plurality of gate electrodes so that a sum of current flowing through each of the plurality of gate electrodes at a predetermined time by application of the predetermined potential is smaller than a sum of maximum value of the current flowing through each of the plurality of gate electrodes.

With this arrangement, the potential applying means applies a predetermined potential to the gate electrodes of each control electrode section, and as a result flying of developer particles of predetermined colors held on their respective carriers towards the counter electrode is controlled with respect to each carrier, thus forming a color image.

When the potential applying means applies the predetermined potential to the gate electrodes, a transient current is flown momentarily through each gate electrode when the potential is changed. Here, if the timing of applying the potential is the same, the transient current is simultaneously supplied from the potential applying means, and this means that when the number of gate electrodes is large, potential applying means capable of supplying a large transient current is required.

Also, in the above color image forming apparatus, for example, the number of control electrodes is four times that of the black-and-white image forming apparatus, and accordingly the sum of transient current supplied to each gate electrode by the potential applying means is also increased fourfold, requiring potential applying means having a current capacity four times larger than that of the black-and-white image forming apparatus.

However, with the above arrangement, the potential applying means applies the predetermined potential to the gate electrodes so that the sum of current flowing through each gate electrode at a predetermined time is smaller than the sum of maximum value of the current flowing through each gate electrode. The potential applying means realizes this control, for example, by shifting the timing of potential application by a predetermined amount when applying the predetermined potential to each gate electrode, or alternatively, by grouping the plurality of gate electrodes, and then by applying the potential to the gate electrodes of the same group at the same timing, while applying the potential to the gate electrodes of different groups at a different timing.

As a result, it is ensured that the amount of current supplied momentarily by the potential applying means is reduced compared with the conventional case where the potential is applied to the gate electrodes at the same timing. Thus, it is not required to provide potential applying means having a particularly large current capacity, even when the number of gate electrodes is increased.

Therefore, with the described arrangement, it is possible to use potential applying means having the same current capacity as that of the black-and-white image forming apparatus even when the control electrode sections having large numbers of gate electrodes are used, thus preventing an increase in size and cost of the potential applying means, and in turn size and cost of the apparatus.

Also, because the current capacity of the potential applying means is not particularly large, even when a high voltage leak, etc., is generated via the control electrode section, the output potential is reduced to some degree upon occurrence of such an event. Therefore, problems, such as destruction of other circuits and the apparatus, do not occur, thus improving reliability of the apparatus, and it is not required to take a high-level insulation measure with the described arrangement.

Note that, as long as the transient current is flown as a result of applying the potential to the gate electrodes, the potential may be a potential for controlling flying of developer particles, such as the flying potential for allowing the developer particles to fly towards the counter electrode and the flying preventing potential for preventing flying of developer particles towards the counter electrode, or alternatively, a cleaning potential for cleaning the control electrode section.

For a fuller understanding of the nature and advantages of the invention, reference should be made to the ensuing detailed description taken in conjunction with the accompanying drawings.

BRIEF DESCRIPTION OF THE DRAWINGS

FIG. 18(*b*) is an explanatory drawing showing the degree of positional shift of dots when ON potential is subsequently applied from a group at the center to the groups towards the ends.

FIG. 21(*b*) is a plan view showing a positional relationship of gate and ring electrodes adjacent to another set of gate and ring electrodes under normal condition.

FIG. 22(*b*) is an explanatory drawing showing potential waveforms and waveforms of transient current through the ring electrodes, in the case where the transient currents which flow by application of OFF potential are overlapped with one another in time when ON potential is applied to each ring electrode with a shifted apply timing for preventing timely overlap of transient currents which flow by application of ON potential.

FIG. 23(*b*) is an explanatory drawing showing potential waveforms and waveforms of transient current through the ring electrodes, when the apply time of ON potential of a ring electrode to which ON potential is applied later is adjusted shorter than the apply time of ON potential of a ring electrode to which ON potential is applied first so that the transient currents which flow by application of ON potential and the transient currents which flow by application of OFF potential are both not overlapped with one another in time.

FIG. 25(*b*) is an explanatory drawing showing a circuit structure adopting a switching element which supplies a ground potential to the ring electrodes when applying ON potential to the ring electrodes, and supplies an apply potential from a control power source section to the ring electrodes when applying OFF potential to the ring electrodes.

DESCRIPTION OF THE EMBODIMENTS

[First Embodiment]

The following will describe one embodiment of the present invention referring to FIG. 1 through FIG. 27. Note that, the following explanations are given through the case of an image forming apparatus having an arrangement adopting a negatively charged toner. In the case of using a positively charged toner, the polarity of applied voltages are appropriately set accordingly.

Figure 2:
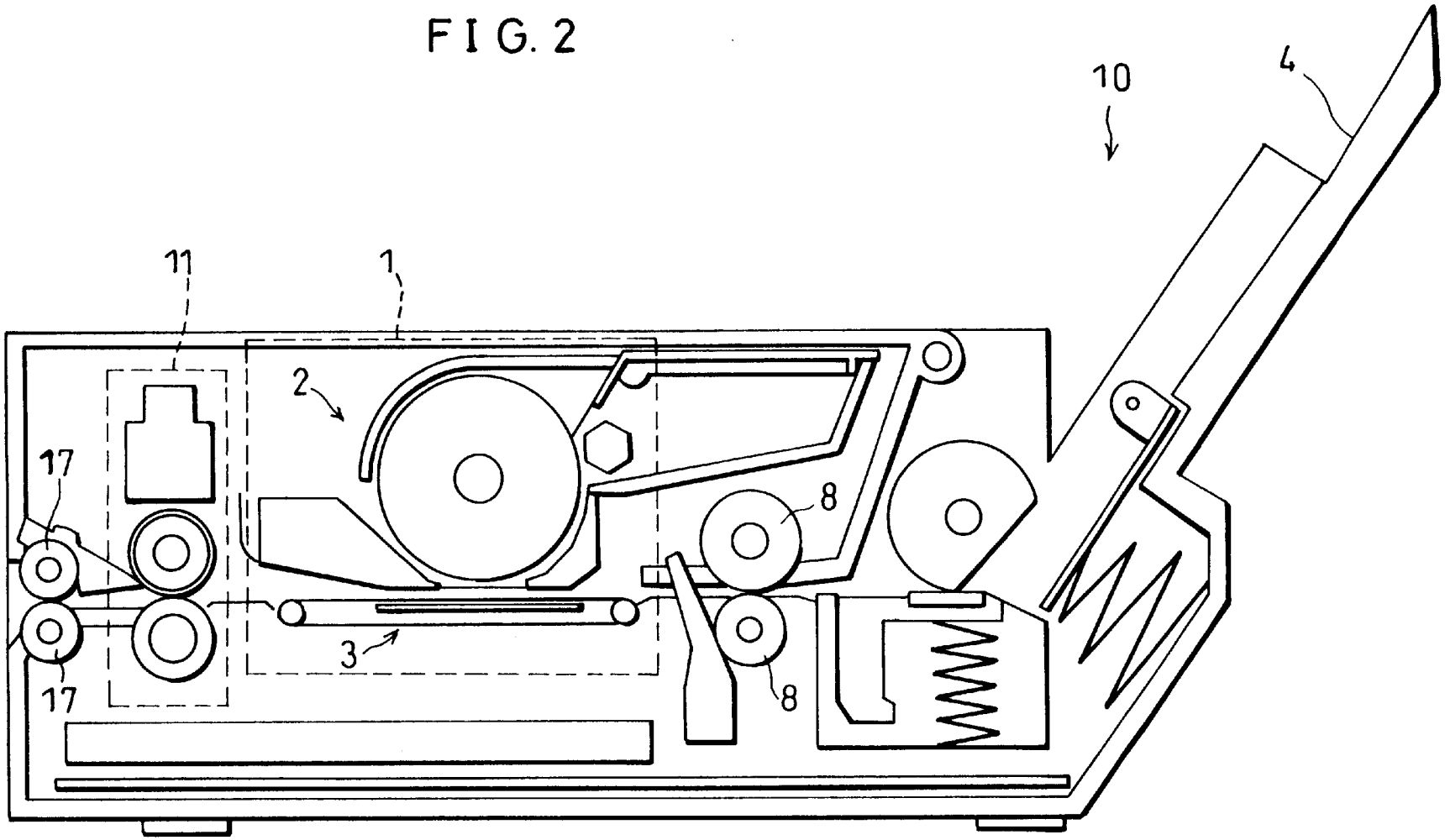
FIG. 2 is a cross sectional view of the image forming apparatus.
Figure 3:
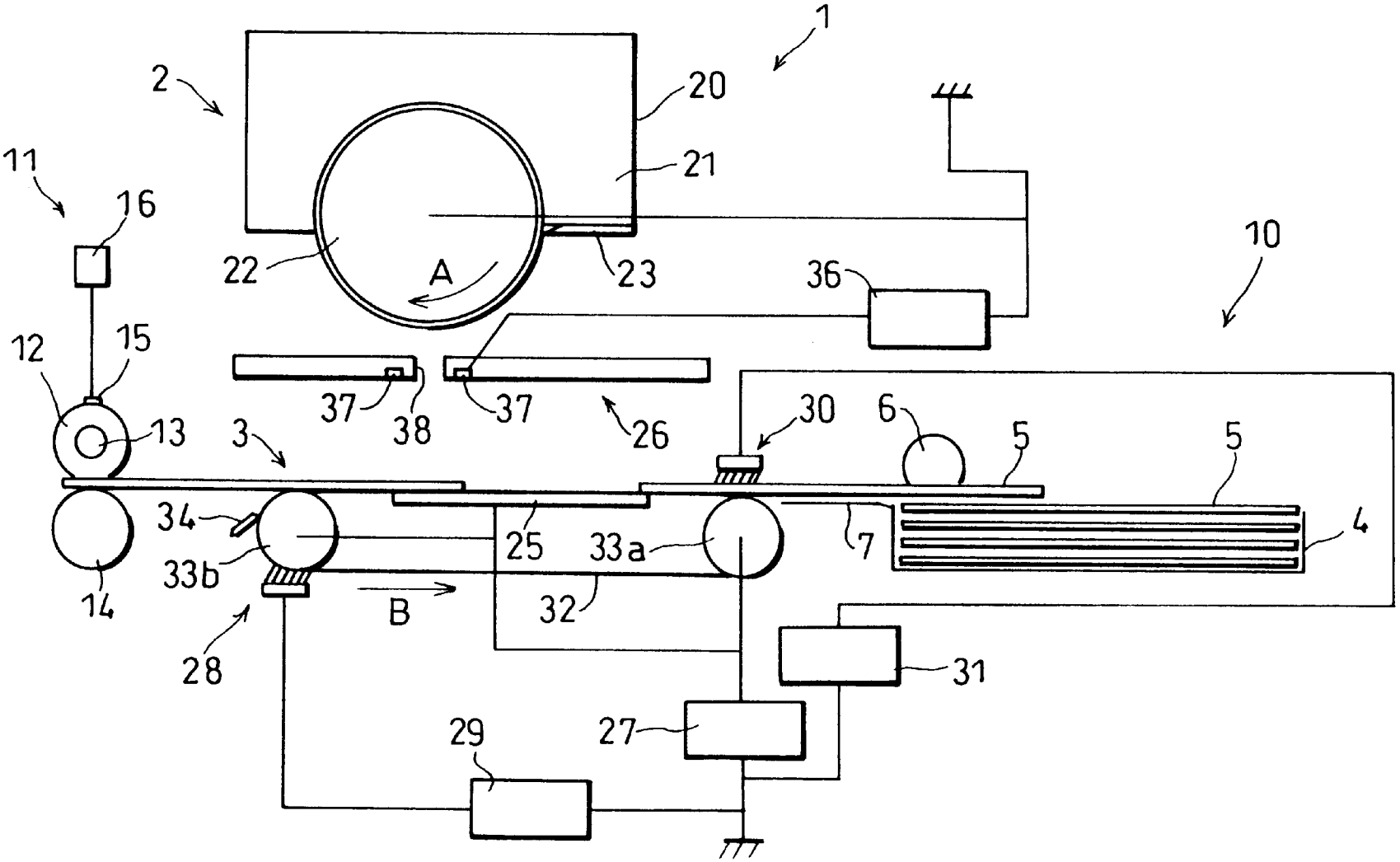
FIG. 3 is an explanatory drawing showing a schematic arrangement of the image forming apparatus.

FIG. 2 is a cross section of an image forming apparatus in accordance with the present embodiment, and FIG. 3 is a drawing which schematically shows the arrangement of the image forming apparatus. The image forming apparatus can be suitably adopted, for example, as a printing section of a digital copying machine and a facsimile device, a digital printer, and a plotter, and, as shown in FIG. 2 and FIG. 3, includes an image forming section 1 having a toner supply section 2 and a printing section 3.

The image forming section 1 visualizes an image, which is in accordance with an image signal, on a sheet (recording medium) using toner as a developer. Namely, in the image forming apparatus of the present embodiment, toner is flown by Coulomb force and is adhered onto a sheet, and flying of toner is controlled in accordance with an image signal, thus directly forming an image onto a sheet.

On a sheet feeding side of the image forming section 1 is provided a sheet feeding device 10. The sheet feeding device 10 is composed of a sheet cassette 4 for storing sheets 5 (recording medium), a pickup roller 6 for sending a sheet 5 from the sheet cassette 4, and a sheet guide 7 for guiding the sheet 5 supplied.

Between the pickup roller 6 and the image forming section 1 are provided a pair of resist rollers 8 for temporarily holding the sheet 5 so as to supply the sheet 5 to the image forming section 1 at a predetermined timing. The pickup roller 6 is rotatably driven by a driving device (not shown). The sheet feeding device 10 is provided with a sheet feeding sensor (not shown) for detecting a supply of the sheet 5.

On a sheet discharge side of the image forming section 1 is provided a fixing section 11 for fixing a toner image formed on the sheet 5 in the image forming section 1 by applying heat and pressure. The fixing section 11 is composed of a heat roller 12, a heater 13, a press roller 14, a temperature sensor 15, and a temperature control circuit 16.

The heat roller 12 is made from, for example, an alminium tube having a thickness of 2 mm. The heater 13 is composed of, for example, a halogen lamp, and is installed in the heat roller 12. The press roller 14 is made from, for example, silicon resin.

On both ends of respective axes of the heat roller 12 and the press roller 14 provided facing each other, a load of, for example, 2 kg is applied by a spring, etc. (not shown), so that the sheet 5 is pressed between the two rollers.

The temperature sensor 15 measures the surface temperature of the heat roller 12. The temperature control circuit 16 is controlled by a main control section, and controls the operation such as an ON/OFF operation of the heater 13 in accordance with the measurement result of the temperature sensor 15 to maintain the surface temperature of the heat roller 12 at 150° C., for example. The fixing section 11 includes a sheet discharge sensor (not shown) for detecting discharge of the sheet 5.

Note that, the material s of the heat roller 12, heater 13, and press roller 14, etc., are not particularly limited. The surface temperature of the heat roller 12 is not particularly limited either. Also, the fixing section 11 may have an arrangement wherein a toner image is fixed by applying heat or pressure onto the sheet 5.

On a sheet discharge side of the fixing section 11 are provided sheet discharge rollers 17 and a discharge tray (not shown). The sheet discharge rollers 17 discharge the sheet 5 processed in the fixing section 11 onto the discharge tray, and the discharge tray receives the sheet 5 discharged. The heat roller 12, the press roller 14, and the sheet discharge rollers 17 are rotatably driven by a driving device (not shown).

The toner supply section 2 of the image forming section 1 includes a toner storage tank 20, a toner carrier 22, and a doctor blade 23. The toner storage tank 20 stores toner 21 (developer particles). The toner carrier 22 is a cylindrical carrier (sleeve) for carrying the toner 21 by a magnetic force. The doctor blade 23 is provided inside the toner storage tank 20, and is for charging the toner 21 and regulating the thickness of a toner layer held around the outer peripheral surface of the toner carrier 22.

The toner carrier 22 is grounded and is driven by a driving device (not shown) to rotate in a direction of arrow A in FIG. 3. A magnet (not shown) is provided on a position inside the toner carrier 22 facing the doctor blade 23 and facing a control electrode 26 (control electrode section, mentioned later).

This allows the toner carrier 22 to carry the toner 21 on its outer peripheral surface. The toner 21 held on the outer peripheral surface of the toner carrier 22 forms a magnetic brush on a position corresponding to the magnet. Note that, the rotational speed of the toner carrier 22 is not particularly limited. Also, the toner carrier 22 may have an arrangement wherein the toner 21 is held by an electric force, rather than by a magnetic force.

The doctor blade 23 in the toner storage tank 20 is provided on the side of the toner storage tank 20 where the surface of the toner carrier 22 appears out of the toner storage tank 20 by the rotation in the direction of arrow A in FIG. 3 so that the distance between the doctor blade 23 and the outer peripheral surface of the toner carrier 22 is, for example, 60 $\mu$m. The toner 21 is a magnetic toner having an average particle diameter of, for example, 6 $\mu$m, and a charge is given by the doctor blade 23 so that the amount of charge carried by the toner 21 is in a range of −4 $\mu$C/g to −5 $\mu$C/g. Note that, the distance between the doctor blade 23 and the toner carrier 22 is not particularly limited. The average particle diameter and the amount of charge of the toner 21 are not particularly limited either.

The printing section 3 of the image forming section 1 includes a counter electrode 25, the control electrode 26, a high-voltage power source 27, a discharge brush 28, a discharge power source 29, a charge brush 30, a charge power source 31, a dielectric belt 32, suspension rollers 33*a* and 33*b*, and a cleaning blade 34. The counter electrode 25 is provided so as to face the outer peripheral surface of the toner carrier 22. The control electrode 26 is provided between the toner carrier 22 and the counter electrode 25 so as to cross the flying path of the toner 21. The high-voltage power source 27 is for supplying a high voltage to the counter electrode 25. The discharge power source 29 is for giving a discharge potential to the discharge brush 28. The charge brush 30 is for charging the sheet 5. The charge power source 31 is for giving a charge potential to the charge brush 30. The suspension rollers 33*a* and 33*b* are for suspending and supporting the dielectric belt 32.

The counter electrode 25 is made from, for example, an alminium plate having a thickness of 1 mm, and is provided so that the distance from the outer peripheral surface of the toner carrier 22 is, for example, 1.1 mm. To the counter electrode 25 is applied a high voltage of, for example, 2.3 kV by the high-voltage power source 27. Namely, by the high voltage applied by the high-voltage power source 27, an electric field is applied between the counter electrode 25 and the toner carrier 22, which is required for allowing the toner 21 held on the toner carrier 22 to fly towards the counter electrode 25. Note that, the material of the counter electrode 25 and the distance between the counter electrode 25 and the toner carrier 22 are not particularly limited. Also, the rotational speed of the toner carrier 22 and the voltage applied to the counter electrode 25 are not particularly limited either.

The discharge brush 28 is provided by being pressed against the outer surface of the dielectric belt 32, whose inner surface is contacting the suspension roller 33*b* on the side of the fixing section 11. To the discharge brush 28 is applied a discharge potential of, for example, 2.5 kV by the discharge power source 29 to remove an unnecessary charge on the outer surface of the dielectric belt 32.

The charge brush 30 is provided so as to contact the upper surface of the sheet 5 supplied to the printing section 3 from the sheet feeding device 10. A charge potential is applied to the charge brush 30 by the charge power source 31. This induces an electrostatic charge on the sheet 5, attaching the sheet 5 electrostatically to the dielectric belt 32.

The dielectric belt 32 is made of an insulating base material, such as PVDF (polyvinylidene fluoride), and has a volume resistivity of, for example, $10^{10}$ Ω·cm, and a thickness of, for example, 75 $\mu$m. The dielectric belt 32 is driven by a driving device (not shown), and rotates in a direction of arrow B in FIG. 3 at the speed of, for example, 30 mm/sec at the surface portion, for example. The suspension rollers 33*a* and 33*b* are each connected to the high-voltage power source 27.

The cleaning blade 34 is for removing the toner 21 adhering on the outer surface of the dielectric belt 32. This prevents contamination of the rear surface of the sheet 5 attached on the outer surface of the dielectric belt 32 even in the case where the toner 21 is adhering on the outer surface of the dielectric belt 32 due to an unexpected event such as a paper jam.

The control electrode 26 is a plate parallel to the counter electrode 25, which also is a plate, and extends two dimensionally while facing the counter electrode 25, and also has a structure for allowing the toner to pass through in a direction from the toner carrier 22 to the counter electrode 25. The control electrode 26 is provided so that the distance from the outer peripheral surface of the toner carrier 22 is, for example, 100 μm, and is fixed by a supporting member (not shown). Note that, the distance between the control electrode 26 and the toner carrier 22 is not particularly limited.

Figure 4:
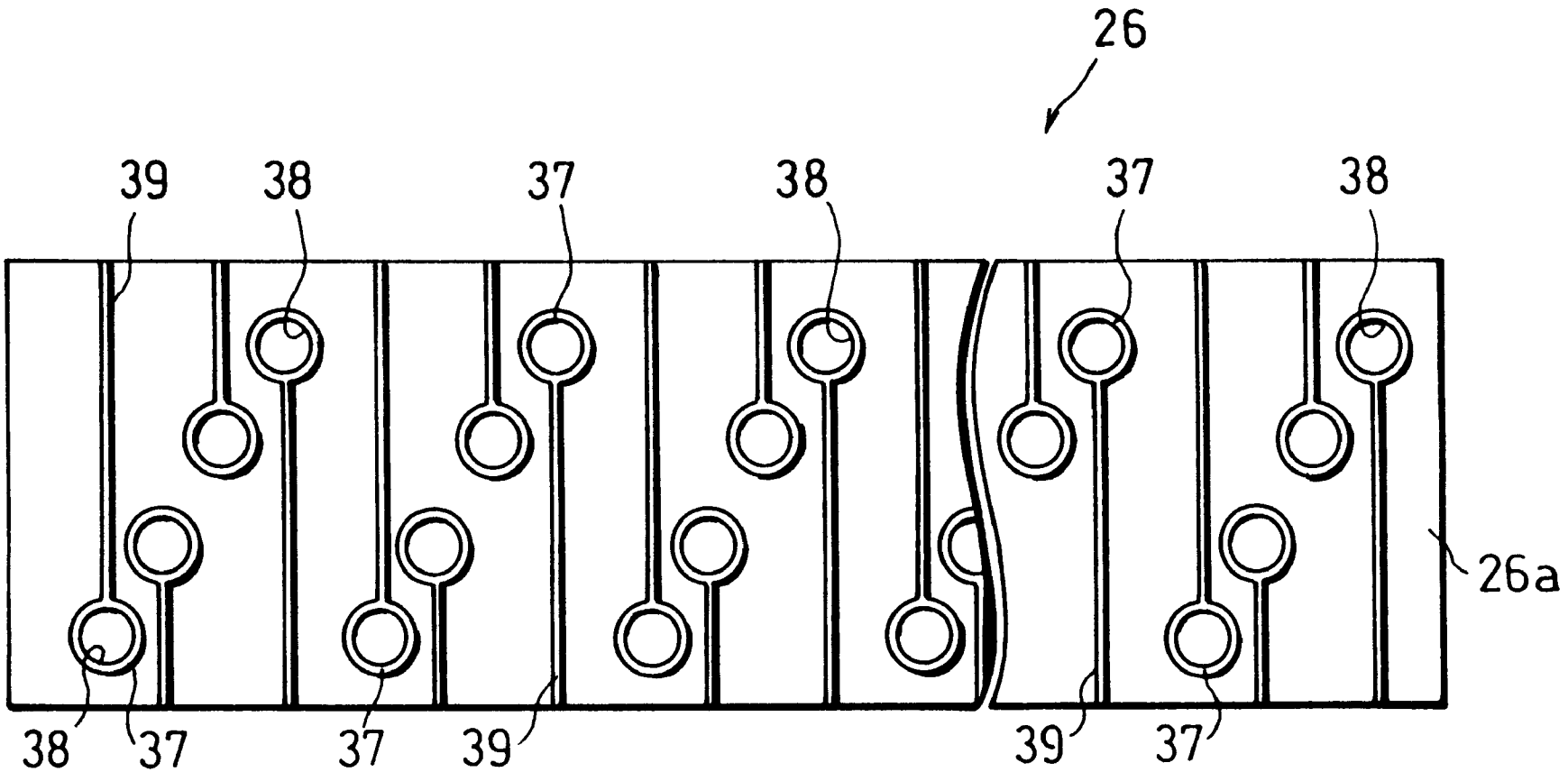
FIG. 4 is a plan view showing a structure of a control electrode provided in the image forming apparatus.

The control electrode 26 is connected to a control power source section 36 (potential applying means), which applies a potential that is in accordance with an image signal to ring electrodes 37 (see FIG. 4). By supplying a predetermined potential to the control electrode 26 from the control power source section 36, the electric field between the surface of the toner carrier 22 and the counter electrode 25 is changed, thus controlling flying of the toner 21 from the toner carrier 22 to the counter electrode 25. The following will describe the control electrode 26 in more detail.

As shown in FIG. 4, the control electrode 26 is composed of an insulating substrate 26*a*, a high-voltage driver (not shown), and independent ring conductors, that is, ring electrodes 27 (gate electrodes).

The substrate 26*a* is made of, for example, polyimide resin, and has a thickness of 25 μm. On the substrate 26*a* are formed a plurality of pores in a predetermined arrangement in a thickness direction of the substrate 26*a*, the plurality of pores each having an opening section with a diameter of, for example, 160 μm. Each pore constitutes a passage for the toner 21, which flies from the toner carrier 22 to the counter electrode 25. In the following, such pore will be referred to as a gate (passage pore) 38.

The ring electrodes 37 are made of, for example, a copper foil having a thickness of 18 μm, and are each provided around the gate 38, with a diameter of an opening section of, for example, 200 μm. Accordingly, the ring electrodes 37 are also disposed in a predetermined arrangement together with gates 38. In the present embodiment, on the substrate 26*a*, for example, 2560 ring electrodes 37 and gates 38 are provided in matrix (4 rows×640 columns). Note that, the rows are in a direction along the shorter sides of the substrate 26*a*, that is, along the transport direction of the sheet 5, and the columns are in a direction along the longer sides of the substrate 26*a*, that is, along the direction orthogonal to the transport direction of the sheet 5.

Note that, the number of the ring electrodes 37 and gates 38 are not particularly limited. The size of the gates 38, and the materials and the thicknesses of the substrate 26*a* and ring electrodes 37 are not particularly limited either.

Each of the ring electrodes 37 is electrically connected to the control power source section 36 (see FIG. 3) via a charger line 39 and a high-voltage driver (not shown). The surface of the ring electrodes 37 and the surface of charger lines 39 are coated with an insulating layer having a thickness of 30 μm. This ensures insulation (a) among the ring electrodes 37, (b) among the charger lines 39, (c) among the ring electrodes 37 and the charger lines 39 which are not connected to one another, and (d) among the control electrode 26 and the toner carrier 22 and the counter electrode 25.

As mentioned above, to the ring electrodes 37 of the control electrode 26 is applied a pulse (voltage) in accordance with an image signal by the control power source section 36. Namely, the control power source section 36 applies, for example, an ON potential of 150 V to the ring electrodes 37 when allowing a passage of the toner 21 held by the toner carrier 22 towards the counter electrode 25, and applies, for example, an OFF potential of −200 V to the ring electrodes 37 when not allowing the passage of the toner 21.

In this manner, when the potential applied to the control electrode 26 is controlled in accordance with an image signal, and when the sheet 5 is positioned on the surface of the counter electrode 25 facing the toner carrier 22, a toner image in accordance with the image signal is formed on the surface of the sheet 5.

Also, although not shown, the present image forming apparatus is provided with, as a control circuit, a main control section, an image processing section, an image memory, and an image formation control unit. The main control section is for controlling the entire image forming apparatus. The image processing section is for converting image data obtained to the format of image data to be printed. The image memory is for storing the image data converted. The image formation control unit is for converting the image data obtained from the image processing section to image data to be applied to the control electrode 26. The control power source section 36 is controlled by a control electrode controlling signal sent from the image formation control unit.

The described image forming apparatus can be used as an output printer of a computer or word processor, and also as a printing section of a digital copier. The following describes an image forming operation of the image forming apparatus when it is used as a printing section of a digital copier, referring to the flowchart of FIG. 5.

Figure 5:
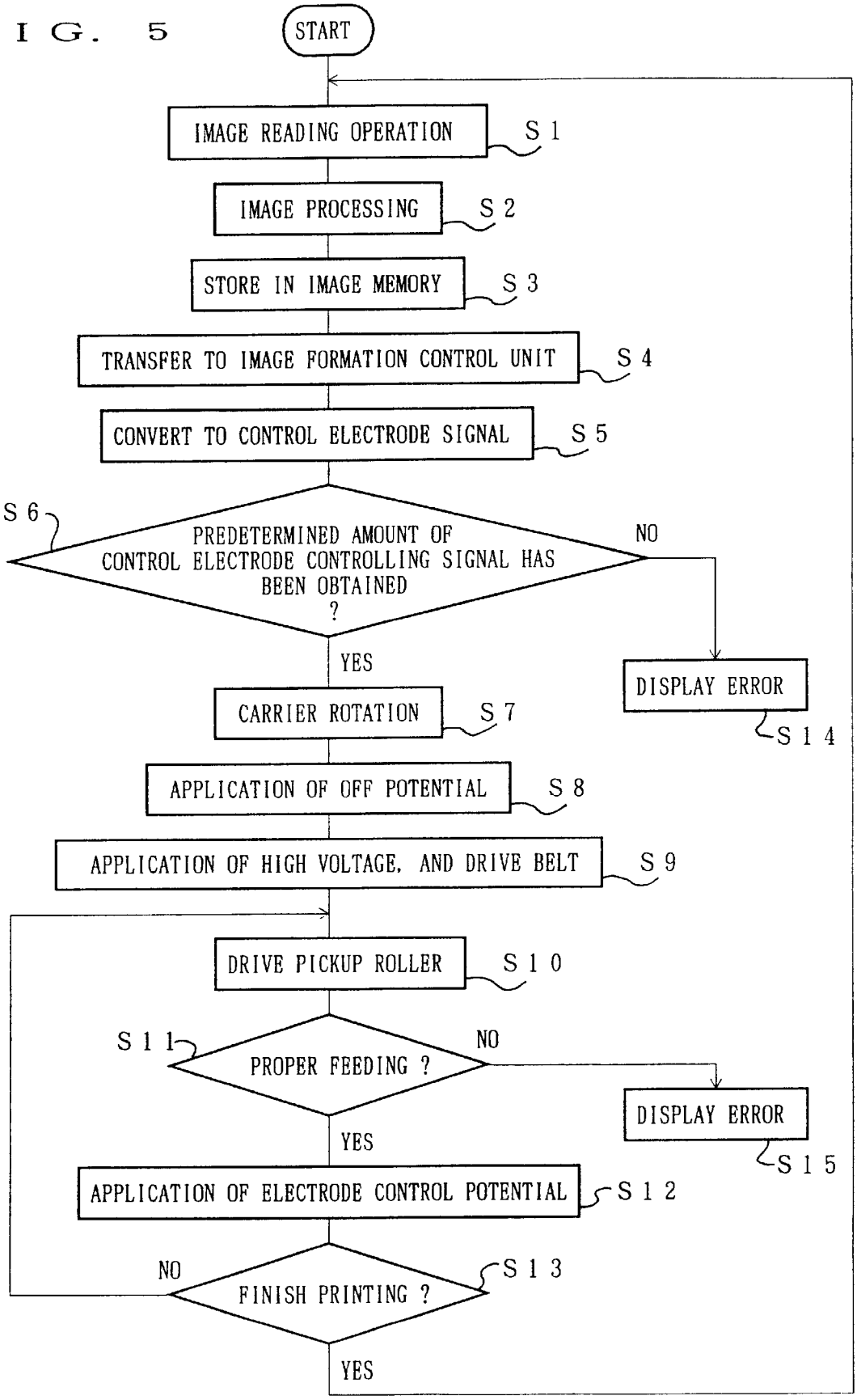
FIG. 5 is a flowchart of an image forming operation of the image forming apparatus.

As shown in FIG. 5, first, a document to be copied is placed, for example, on an image reading section. Then, upon operation of a copy start button (not shown), the main control section, having received this input, starts an image forming operation. Namely, the main control section instructs the image reading section to read a document image (Step 1; hereinafter "Step" will be simply abbreviated to S). The image data thus read are processed by the image processing section (S2), and are stored in the image memory (S3). When the image data stored in the image memory are transferred to the image formation control unit (S4), the image formation control unit starts converting the inputted image data to a control electrode controlling signal to be supplied to the control electrode 26 (S5).

The image formation control unit, upon receiving the control electrode controlling signal in a predetermined quantity (S6), drives a driving device (not shown) to rotate the toner carrier 22, and applies, for example, an OFF potential of −200 V to the ring electrodes 37 of the control electrode 26 so as to prevent undesirable flying of the toner 21 from the toner carrier 22 (S7 and S8). Note that, the predetermined quantity of the control electrode controlling signal differs depending on the arrangement and other make-up of the image forming apparatus.

Thereafter, a high voltage of, for example, 2.3 kV is applied to the counter electrode 25 and to the suspension rollers 33*a* and 33*b* by the high-voltage power source 27, and a high voltage of, for example, 1.2 kV is applied to the charge brush 30 by the charge power source 31. Here, the dielectric belt 32 is driven by a driving device (not shown) (S9).

Then, the pickup roller 6 is rotatably driven by a driving device (not shown), and the sheet 5 in the sheet cassette 4 is sent out towards the image forming section 1 (S10). When the sheet feeding sensor detects proper feeding (S11), the sheet 5 sent out by the pickup roller 6 is transported between the charge brush 30 and the suspension roller 33*a*.

Here, a predetermined potential difference is generated between the charge brush 30 and the suspension roller 33*a*, and therefore a negative charge is supplied to the surface of the sheet 5. As a result, the sheet 5 is electrostatically attached on the dielectric belt 32, and is transported directly below the gates 38 of the control electrode 26 by the movement of the dielectric belt 32.

Here, the charge on the surface of the dielectric belt 32 diminishes with time until it is directly below the gates 38. Thus, considering the potential of the counter electrode 25, the potential on the surface of the dielectric belt 32 is substantially 2 kV.

Then, the image formation control unit supplies the control electrode controlling signal to the control power source section 36. This supply of control electrode controlling signal is carried out at a timing in synchronization with the supply of the sheet 5 to the printing section 3 by the charge brush 30. The control power source section 36 controls the high voltage to be applied to each of the ring electrodes 37 of the control electrode 26, in accordance with the control electrode controlling signal (S12).

Namely, the control power source section 36 applies a potential of 150 V or −200 V appropriately to a predetermined ring electrode 37, thus controlling the electric field in the vicinity of the control electrode 26. That is, at the gate 38 of the control electrode 26, flying of the toner 21 from the toner carrier 22 to the counter electrode 25 is prevented or allowed appropriately in accordance with image data.

As a result, a toner image in accordance with an image signal is formed on the sheet 5, which is moving at the speed of 30 mm/sec towards the sheet discharge side by the movement of the dielectric belt 32 on the surface of the counter electrode 25.

The sheet 5 formed with the toner image is removed from the dielectric belt 32 by the curvature of the suspension roller 33*b* and is transported to the fixing section 11, and an unfixed toner image is fixed on the sheet 5 in the fixing section 11. The sheet 5 with the fixed toner image is then discharged onto the discharge tray by the discharge rollers 17, and the discharge sensor detects that the sheet 5 has been discharged properly. The main control section decides proper completion of the printing operation based on this detection operation (S13).

In the case where a desirable control electrode controlling signal is not obtained in S6, or proper feeding of sheet is not confirmed in S11, an error display is made on a display section (not shown) of the image forming apparatus (S14 and S15).

By the described image forming operation, a desirable image is formed on the sheet 5. In the present image forming apparatus, an image formed directly on the sheet 5, and therefore it is not required to provide developing media, such as a photoreceptor and a dielectric drum, which are used in conventional image forming apparatuses.

Thus, it is possible to omit the transfer process for transferring an image from a developing medium to the sheet 5, preventing deterioration of image. As a result, the reliability of the apparatus is improved. Also, because the structure of the apparatus is simplified and the number of components can be reduced, it is possible to reduce the size and cost of the apparatus.

Note that, whether the image forming apparatus be used as a printing section of a computer output terminal, or as a printing section of a digital copier, the methods adopted in their image forming operations are the same, even though the type of image signals processed and the communication of such signals may be different.

Note that, in the above explanation, a potential of 150 V was used as an example of the potential applied to the ring electrodes 37 of the control electrode 26 for allowing passage of the toner 21. However, as long as flying of the toner 21 is controlled desirably, the potential is not particularly limited. Likewise, the potential applied to the ring electrodes 37 of the control electrode 26 for preventing passage of the toner 21 is not particularly limited either, as long as it is within the scope of claims of the present invention. Also, as long as flying of the toner 21 is controlled desirably in a predetermined manner, the potential applied to the counter electrode 25, the potential applied to the charge brush 30, and the potential on the surface of the sheet 5 directly below the gates 38 are not particularly limited.

The following describes a method for controlling the potential applied to the control electrode 26 of the present embodiment.

In the present embodiment, the control power source section 36 applies a predetermined potential to each of the ring electrodes 37 so that the sum of transient current which flows through each ring electrode 37 by application of potential (change in potential) at a predetermined time is smaller than the sum of maximum value of transient current flowing individually through each ring electrode 37. The following describes how application of potential is controlled differently, using Examples 1 through 6.

Note that, in the following, the explanation will be given through the case where the predetermined potential is an ON potential for allowing toner 21 to fly in a direction from the toner carrier 22 to the counter electrode 25. However, the OFF potential for preventing flying of toner 21 in the above direction can also be adopted.

EXAMPLE 1

Figure 1:
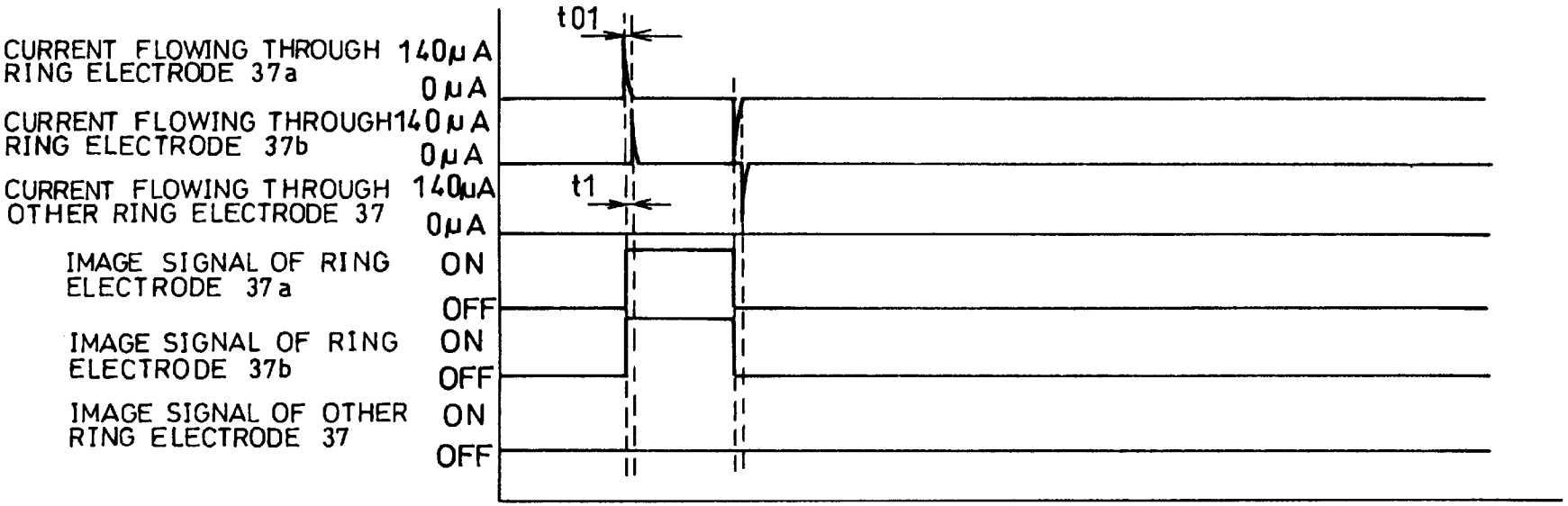
FIG. 1 is an explanatory drawing of one embodiment of an image forming apparatus in accordance with the present invention, showing waveforms of transient currents generated when ON potential is applied to a plurality of ring electrodes with a shifted apply timing, and waveforms of an image signal applied to each of the ring electrodes.
Figure 6:
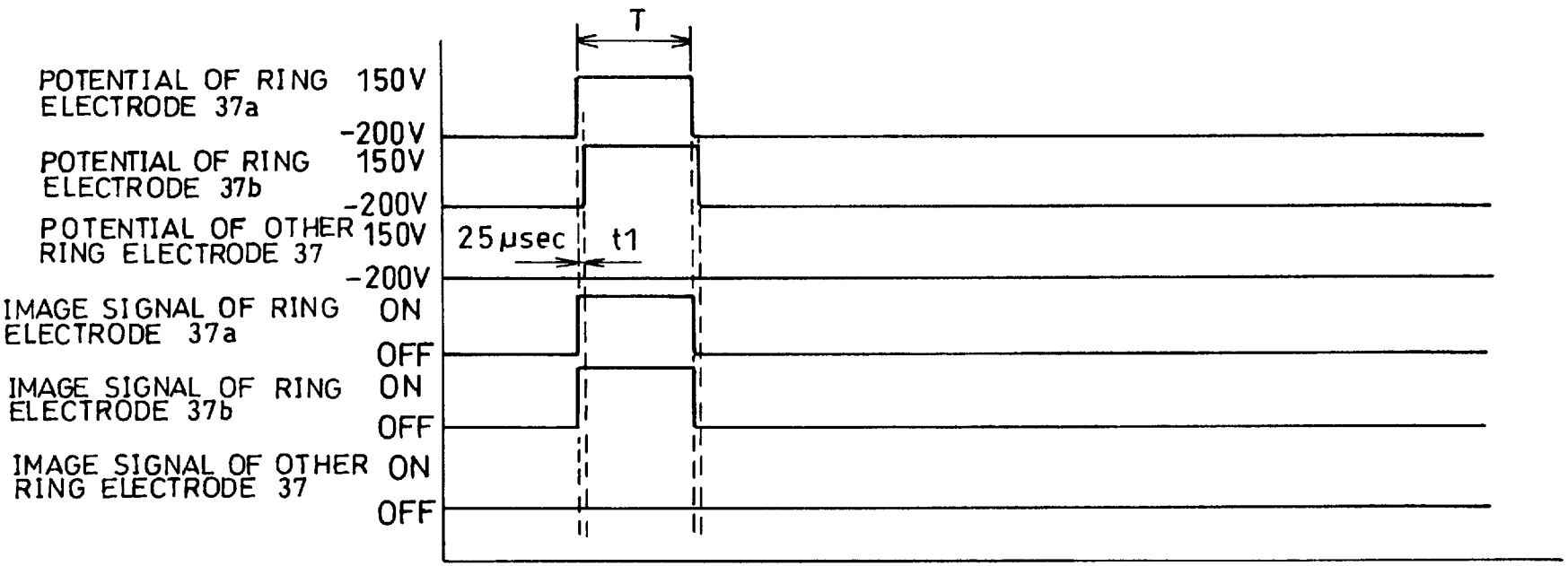
FIG. 6 is an explanatory drawing showing waveforms of transient currents generated when ON potential is applied to the plurality of ring electrodes with a shifted apply timing, and waveforms of an image signal applied to each of the ring electrodes.

In the present Example, as shown in FIG. 6, when applying an image signal to the ring electrodes 37*a* and 37*b* at the same timing, the control power source section 36 carries out a control of shifting the timing of applying an ON potential to the ring electrodes 37*a* and 37*b* by time t1. Thus, as shown in FIG. 1, the transient currents flowing respectively through the ring electrodes 37*a* and 37*b* are shifted from each other by time t1.

Figure 7:
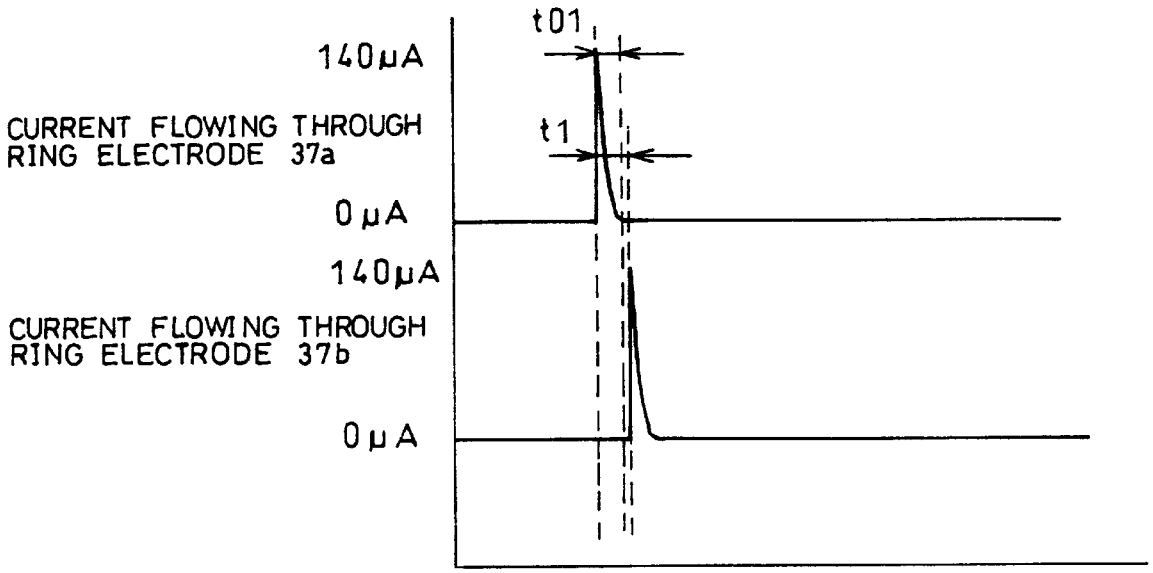
FIG. 7 is an explanatory drawing showing enlarged waveforms of transient currents flowing through the ring electrodes of FIG. 1.

Here, time t1 is adjusted so that respective peaks of the transient currents flowing through the ring electrodes 37*a* and 37*b*, respectively, are shifted from each other, or so that they do not exceed an output current value of the control power source section 36. As shown in FIG. 7, when the duration t01 of the transient current flowing while the ON potential is being applied to the ring electrodes 37*a* and 37*b* is substantially 15 μsec, in the present Example, the time t1 is set to 25 μsec, thus preventing simultaneous current flow of transient current through the ring electrode 37*a*, to which the ON potential was applied first, and through the ring electrode 37*b*, to which the ON potential was applied after the ring electrode 37*a*.

In effect, at a predetermined time, the control power source section 36 only needs to supply a transient current at the maximum of 140 $\mu$A which flows through a single ring electrode 37. Therefore, it is not required to provide a control power source section having a large current capacity.

Also, in the present Example, the explanation is given through the case where the number of ring electrodes 37 to which the ON potential is applied is two. However, not limiting to this, it is also possible to adopt three or more plural ring electrodes 37. In this case, the timing of applying the ON potential is subsequently shifted by t1 with respect to each ring electrode 37.

Therefore, in the present Example, even in the case where a control electrode 26 having a large number of ring electrodes 37 is adopted, it is possible to use a control power source section 36 having the current capacity which has been available conventionally, thus preventing an increase in size and cost of the control power source section 36, preventing in turn an increase in size and cost of the apparatus.

Also, because the current capacity of the control power source section 36 is not particularly large, even when a high voltage leak, etc., is generated via the control electrode 26, the output potential is reduced to some degree upon occurrence of such an event. Therefore, problems, such as destruction of other circuits and the apparatus, do not occur, thus improving reliability of the apparatus, and it is not required to take a high-level insulation measure.

Also, in the present Example, as shown in FIG. 6, apply period T of the ON potential to the ring electrodes 37*a* and 37*b* is set to, for example, 250 $\mu$sec, which is sufficiently longer than time t1. Therefore, even considering the transport speed of sheet 5, essentially no positional shift of dots due to time t1 is generated, and the obtained image is not affected in any ways by such an adverse effect.

Note that, the above description of a current waveform uses an example of a current waveform in which a transient current of 140 $\mu$A is generated at the switching of the potential and thereafter the current takes the value of 0 $\mu$A. However, not limiting to this, the present invention is applicable to a variety of current waveforms, such as a waveform which is obtained when there is a resistant component in a switching circuit of the potential.

EXAMPLE 2

When the ON potential is shifted subsequently by short time t1 with respect to the ring electrodes 37 to which an image signal is given simultaneously, the total shift time becomes (t1×(n−1)), where n is the number of ring electrodes 37.

Here, the control of Example 1 does not present any problem as long as the number of ring electrodes 37 which are subjected to simultaneous potential control, that is, the number of ring electrodes 37 to which an image signal is given simultaneously, is not too large.

However, for example, when there are 2560 ring electrodes 37 to which an image signal is given simultaneously, from the above equation, the total shift time adds to 25 $\mu$sec×2559=63975 $\mu$sec=63.975 msec, which is a considerably large shift time as a whole and therefore is not desirable.

Figure 8:
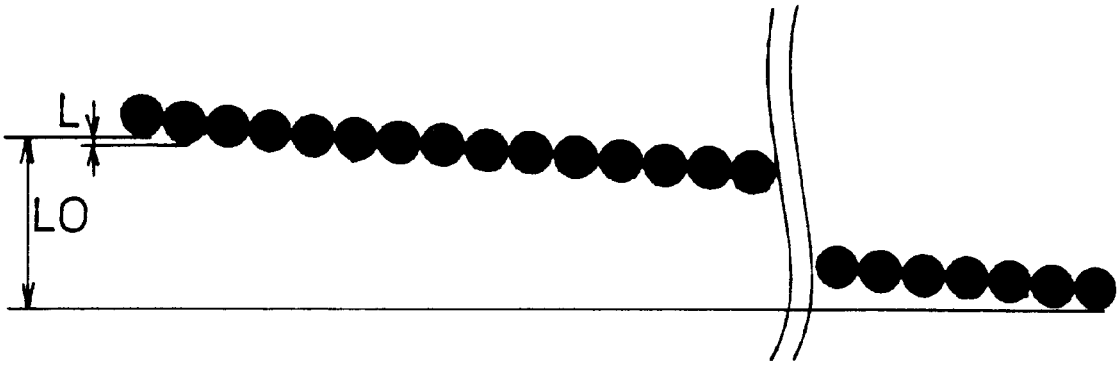
FIG. 8 is an explanatory drawing showing the degree of positional shift of dots generated by timing shift of ON potential application.

Also, for example, in the case of forming a horizontal line corresponding to the width of the sheet 5, that is, when carrying out printing from left to right of the sheet 5, when the timing of applying a potential is shifted by 25 $\mu$sec per each ring electrode 37 in the described manner, the positional shift L of the dots as shown in FIG. 8 becomes 30 mm/sec (transport speed of sheet 5)×25×$10^{-6}$ sec=750×$10^{-6}$ mm=7.5×$10^{-4}$ mm, and is very small.

However, the positional shift L0 between the dots at the both ends of the horizontal line becomes 7.5×$10^{-4}$ mm×2559=1.9125 mm, and the positions of the dots at the both ends are shifted by substantially 2 mm. Thus, in this case, the user definitely recognizes a distortion on the horizontal line, and formation of desirable image becomes difficult.

As a countermeasure, in the present Example, the control power source section 36 divides the ring electrodes 37 into a plurality of groups and carries out a control in such a manner that the ON potential is simultaneously supplied to predetermined ring electrodes 37 of each group, and the timing of applying the ON potential is shifted by short time t1 in the described manner between adjacent groups.

Note that, it is preferable that the number of groups is decided appropriately considering the capacity component, circuit resistance, and applied potential of the control electrode 26, and the current capacity of the control power source section 36.

Figure 9:
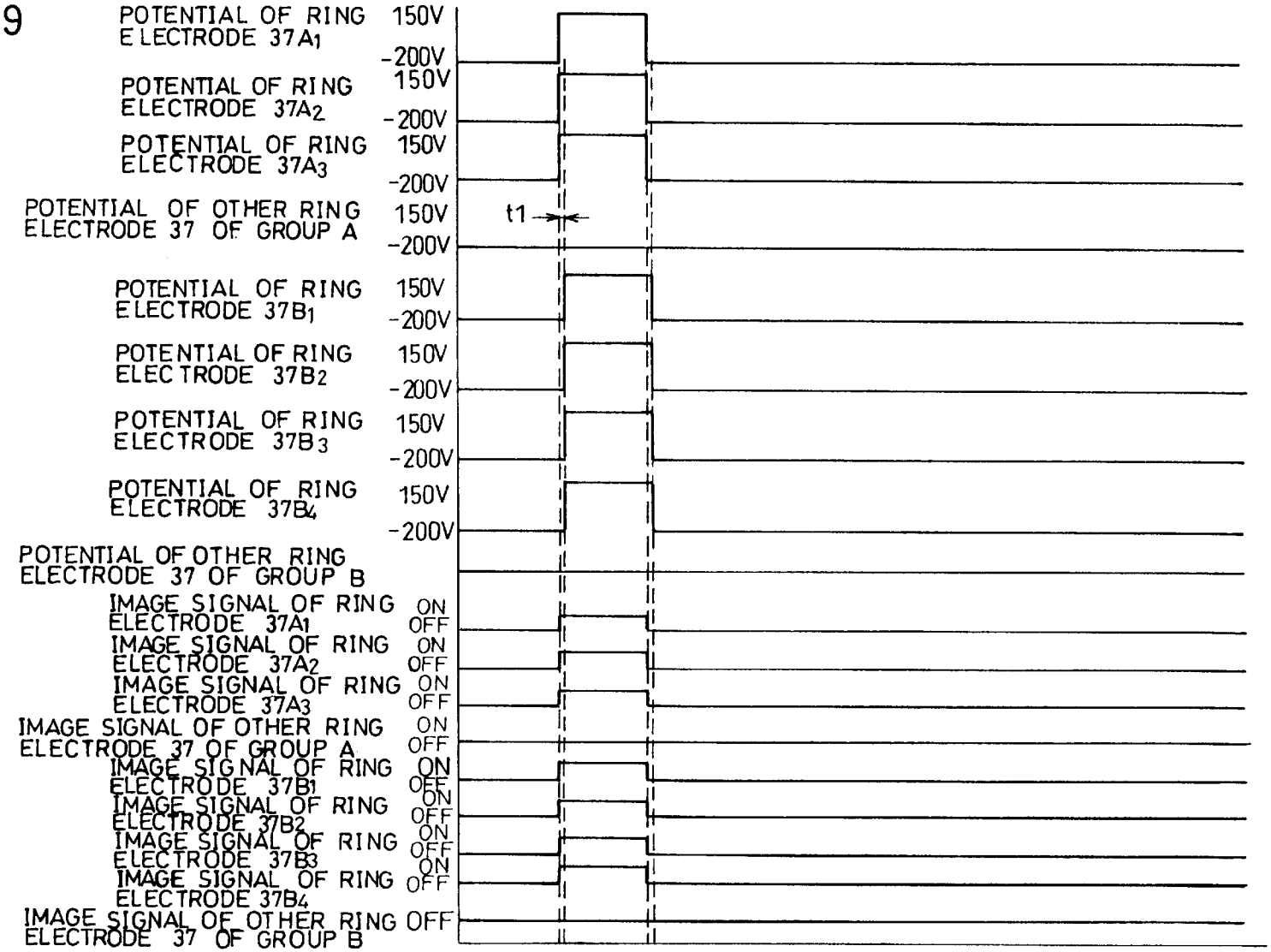
FIG. 9 is an explanatory drawing showing potential waveforms of ring electrodes and waveforms of an image signal applied to the ring electrodes, when carrying out a control with respect to a plurality of grouped ring electrodes in which a potential is simultaneously applied to the ring electrodes of a same group, and the timing of applying the potential is shifted among different groups.

Specifically, 2560 ring electrodes 37 are divided into 20 groups of A through T, and with respect to certain image data, as shown in FIG. 9 for example, the control power source section 36 carries out a control in such a manner that the ON potential is simultaneously applied to predetermined ring electrodes 37$A_1$ through 37$A_3$ of Group A, and the ON potential is not applied to other ring electrodes 37 of Group A.

The control power source section 36 also carries out a control with respect to, for example, Group B in such a manner that the ON potential is simultaneously applied to predetermined ring electrodes 37$B_1$ through 37$B_4$, and the ON potential is not applied to other ring electrodes 37 of Group B. The same control is also carried out with respect to other Groups C through T. Here, the timing of applying the ON potential is set and shifted by t1 (for example, 25 $\mu$sec) so as to avoid overlap among groups.

In such a control, the number of ring electrodes 37 in each group is 128, and even when the maximum of 128 ring electrodes in a group are simultaneously turned on, the peak current only takes the value of 17.92 mA (140 $\mu$A×128=17920 $\mu$A=17.92 mA). Thus, in the voltage application control of the present Example, as with the preceding Example, the transient current which flows momentarily is below the acceptable value of 70 mA. Therefore, it is not required to provide a large current capacity for the control power source section 36, and a high-level insulation measure is not required either.

Also, compared with the case where the timing of applying the potential is shifted among individual ring electrodes 37, by shifting the timing of applying a potential in a group unit, it is possible to finish potential application to all the ring electrodes 37 more quickly, and shifting of application timing occurs less often, thus obtaining the effect of quick image formation and desirable image formation with essentially no positional shift of dots.

In the present Example, the positional shift between the dots at the both ends of the horizontal line is 30 mm/sec×25×$10^{-6}$ sec×19=0.01425 mm, where 30 mm/sec is the transport speed of sheet 5, and the distortion on the horizontal line is hardly recognized, and the obtained image is not affected in any ways by such a distortion.

EXAMPLE 3

In Example 1, when applying the ON potential with the time shift of t1, a subsequent ON potential is applied after the transient current of a ring electrode 37 to which an ON potential was applied first becomes substantially zero. In such a control, when the number of ring electrodes 37 is increased, for example, for carrying out printing using sheet 5 having a large size or for high resolution printing, it takes some time from the first application of the ON potential to the last application of the ON potential, and as a result the positional shift between dots at the both ends of the horizontal line becomes noticeable.

Figure 10:
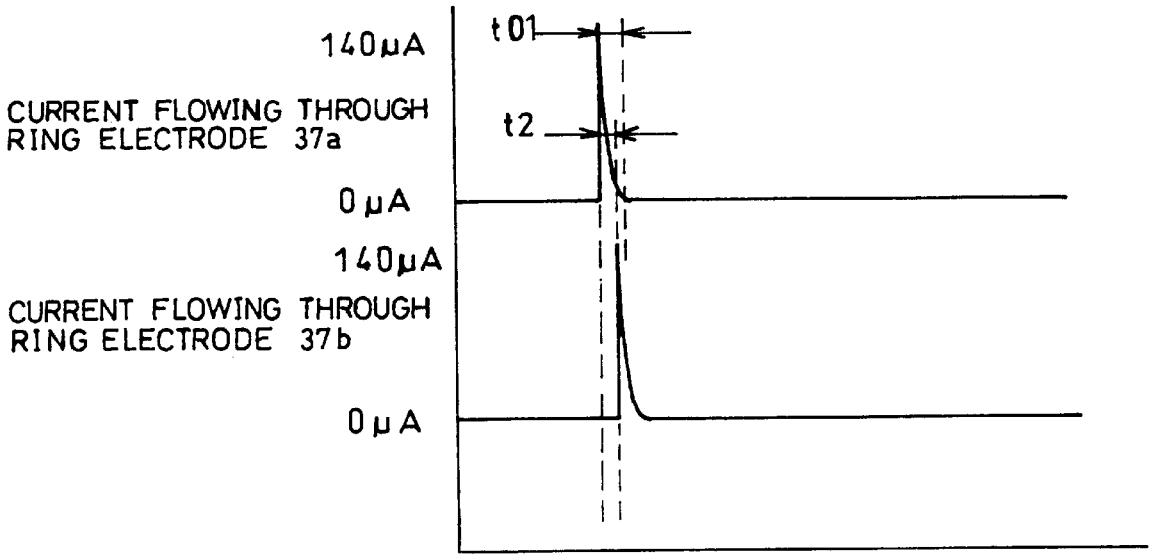
FIG. 10 is an explanatory drawing showing waveforms of transient currents flowing through the ring electrodes, when ON potential is applied to a subsequent ring electrode before a transient current flowing through a preceding ring electrode becomes zero.

Therefore, in the present Example, as shown in FIG. 10, the control power source section 36 applies the ON potential to a subsequent ring electrode 37*b* after the transient current flowing through the ring electrode 37*a* by first application of the ON potential becomes small enough but before it becomes zero. Namely, the ON potential is applied to the subsequent ring electrode 37*b* after elapsed time t2, which is shorter than duration t01 of the transient current flowing through the ring electrode 37*a*, after application of the ON potential to the ring electrode 37*a*.

This reduces the time required to apply the ON potential to all ring electrodes 37, to which an image signal is applied simultaneously, and as a result the positional shift of dots is relieved, realizing desirable image formation.

Note that, in this control, the time t2 is set so that the sum of (a) transient current flowing through the ring electrode 37*a* by first application of the ON potential and (b) transient current flowing through the ring electrode 37*b* by subsequent application of the ON potential does not exceed the current capacity of the control power source section 36.

Figure 11:
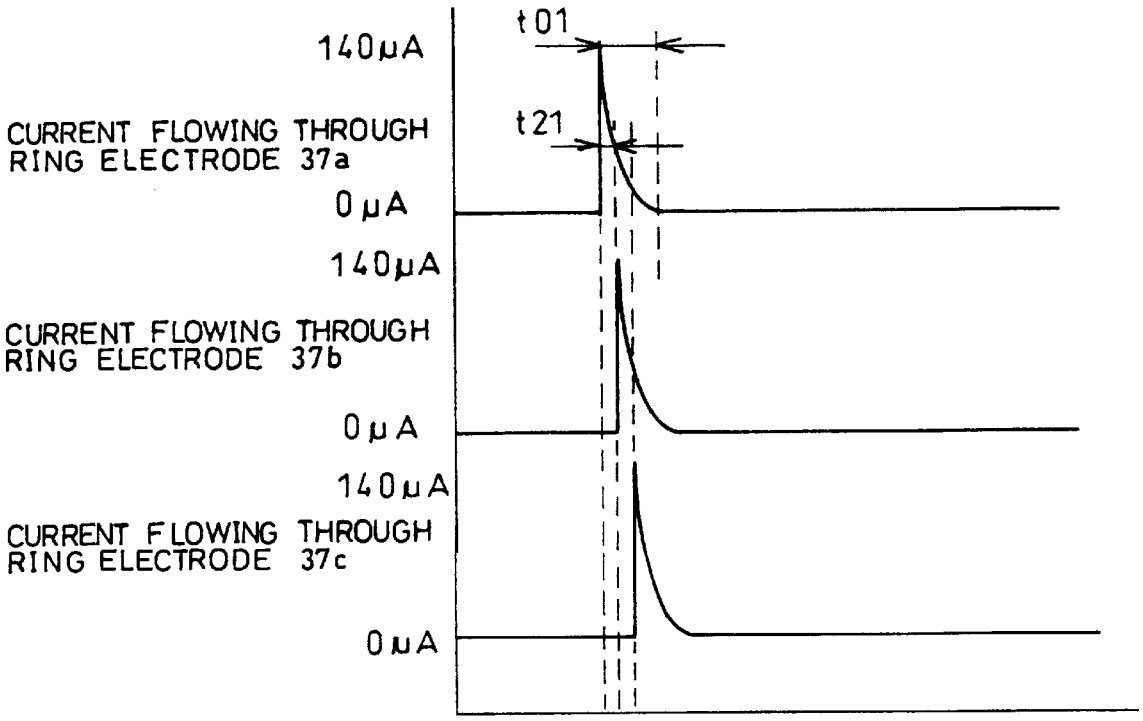
FIG. 11 is an explanatory drawing showing waveforms of transient currents flowing through the ring electrodes, when ON potential is subsequently applied to two ring electrodes with a shifted timing before transient current flowing through a single ring electrode becomes zero.

It is also possible to carry out a control, as shown in FIG. 11, in which the timing of applying the ON potential to three ring electrodes 37*a*, 37*b*, and 37*c* is shifted by t21 so that the transient currents of respective ring electrodes 37*a*, 37*b*, and 37*c* are overlapped without coinciding peaks of their current waveforms. The same control may also be carried out with respect to four or more ring electrodes 37. In any case, the current capacity of the control power source section 36 is not to be exceeded.

In the present Example, the explanation was given through the case where duration t01 (time constant) of transient current which flows at the switching of potential is set to 15 μsec for example. However, the duration t01 is not just limited to this. In fact, the duration t01 is easily changed depending on, for example, structures of circuits, electrostatic capacity of the control electrode 26, and other factors. Therefore, it is preferable that the time t1 and time t2 of timing shift of potential application are set appropriately taking into consideration these variables.

EXAMPLE 4

In the present Example, as with Example 2, 2560 ring electrodes 37 are divided into a plurality of groups, and the timing of applying a high voltage is shifted subsequently among groups. However, the present Example differs from Example 2 in that a high voltage IC (potential switching means) for switching ON/OFF of a potential applied to the ring electrodes 37 of the same group is provided for each group, and that the control power source section 36 is connected to the ring electrodes 37 via high voltage IC of each group. The following describes this structure.

Figure 12:
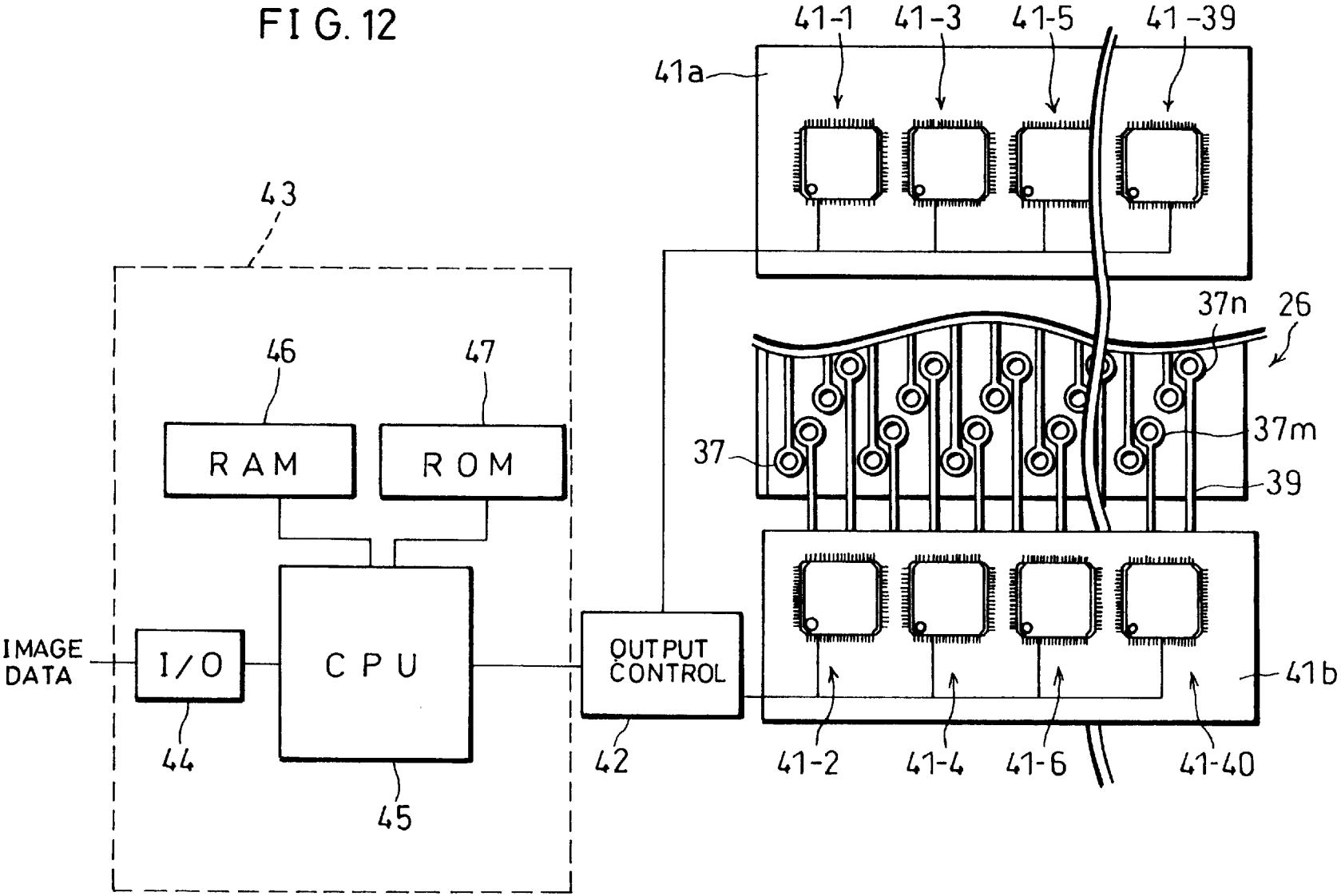
FIG. 12 is an explanatory drawing showing a circuit structure when the plurality of electrodes are grouped using high-voltage ICs.

As shown in FIG. 12, the present Example uses 40 high voltage ICs (Integrated Circuits) 41-1, 41-2, . . . , 41-40, each having 64 output channels. Each of 64 channels of the high voltage ICs is connected individually to each ring electrode 37, thus carrying out a potential switching control with respect to the total of 2560 ring electrodes 37.

Here, high voltage ICs having odd numbers on their reference numerals constitute a group on a circuit substrate 41*a*, and high voltage ICs having even numbers on their reference numerals constitute a group on a circuit substrate 41*b*. The ring electrodes 37 disposed in the row direction on the control electrode 26 include ring electrodes 37*m* and ring electrodes 37*n* respectively provided in the vicinity of the central portion and in the vicinity of the edge portions of the substrate of the ring electrodes 37. Each high voltage IC is connected by charger lines 39 to closer of the ring electrodes 37*m* and further of the ring electrodes 37*n*.

Figure 16:
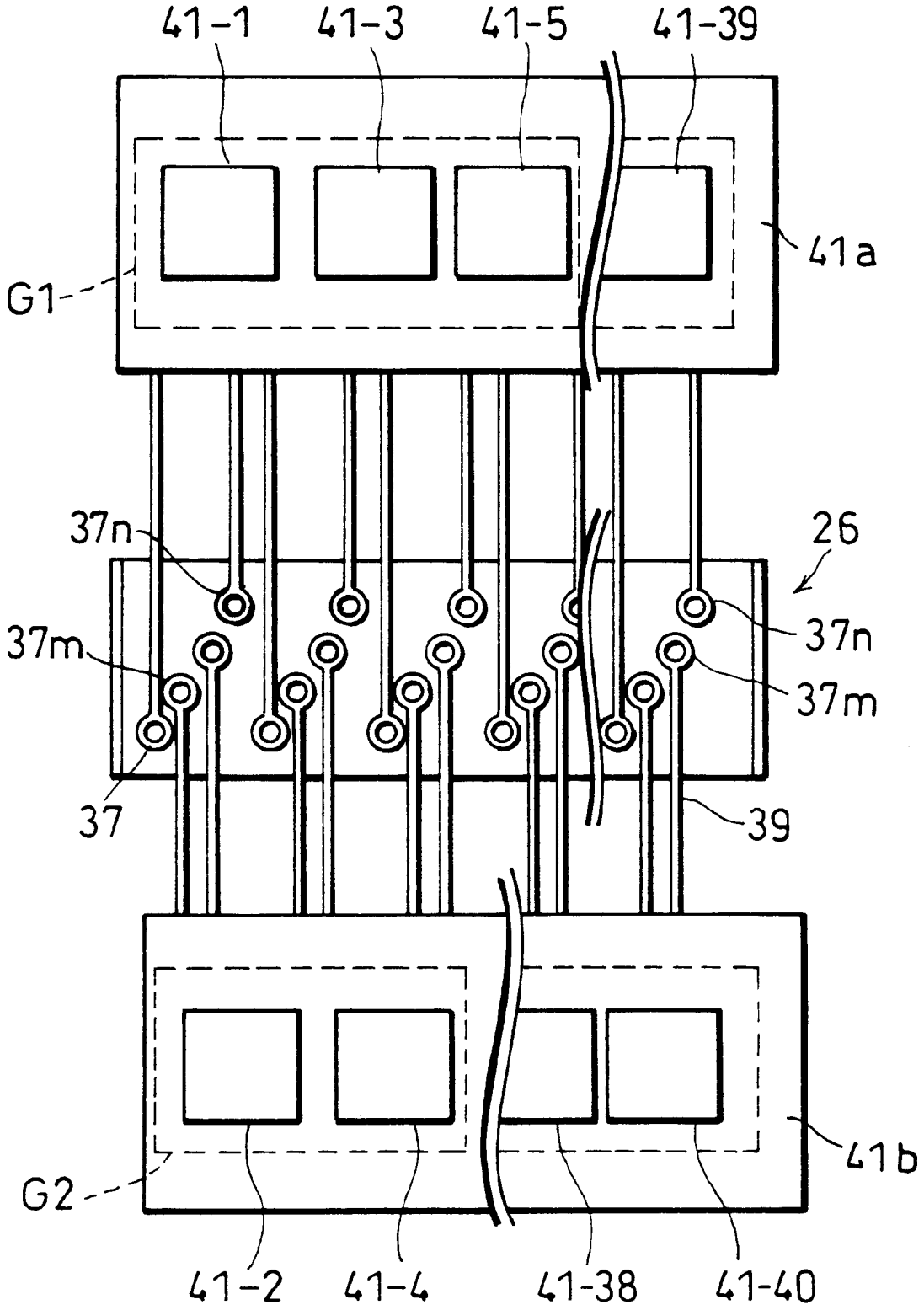
FIG. 16 is an explanatory drawing showing grouping within high-voltage ICs connected to the ring electrodes in the vicinity of the central portion of the substrate and grouping within high-voltage ICs connected to the ring electrodes in the vicinity of the edge portions of the substrate, wherein the number of former high-voltage ICs is greater than that of latter high-voltage ICs.

For example, as shown in FIG. 16, it is possible to have an arrangement wherein high voltage ICs having odd numbers on their reference numerals constitute a group on the circuit substrate 41*a*, and are connected by the charger lines 39 to the ring electrodes 37*m* in the vicinity of the central portion of the substrate of the ring electrodes 37 formed on the control electrode 26, and high voltage ICs having even numbers on their reference numerals constitute a group on the circuit substrate 41*b*, and are connected by the charger lines 39 to the ring electrodes 37*n* in the vicinity of the edge portions of the substrate.

The 40 high voltage ICs as described above do not have control means for controlling the outputs of individual channels, and therefore a high voltage is outputted simultaneously from individual channels of each high voltage IC. Namely, the 64 channels of each high voltage IC are switched on at the same time as required.

Note that, a high voltage IC capable of carrying out a control for individually shifting the switching timing of channels are available. However, such a high voltage IC has an extremely complex structure and is large and expensive, and therefore is not suitable for apparatuses such as the apparatus of the present Example requiring large numbers of high voltage ICs.

Each of the high voltage ICs is connected to an image processing unit 43 via an output control 42. The output control 42 carries out a pulse control of timing so that the output timing of the channels is shifted among the high voltage ICs.

The image processing unit 43 corresponds to the control circuit as described above, and is composed of an I/O (Input/Output) 44, a CPU (Central Processing Unit) 45 as a main control section, a RAM (Random Access Memory) 46 as an image memory, a ROM (Read Only Memory) 47, and an image processing section and an image formation control unit (both not shown). The ROM 47 stores beforehand data required for image formation, and the data are read out as required by the control of the CPU 45. The high voltage ICs are each connected to the control power source section 36.

In this structure, when image data are inputted to the CPU 45 via the I/O 44, the image data are sent to the image processing section (not shown) under the control of the CPU 45, and are converted by the image processing section to a format of image data to be printed and are stored in the RAM 46. The data read out from the RAM 46 and the ROM 47 are outputted to each high voltage IC in accordance with the output timing control by the output control 42.

Each high voltage IC outputs, for example, an ON potential of 150 V, supplied from the control power source section 36 to the connected ring electrodes 37 in accordance with the supplied image data.

Therefore, even when all the 64 ring electrodes 37 of the same group are switched on, the transient current of only 8.96 mA (140 μA×64=8960 μA=8.96 mA) flows momentarily, which is sufficiently smaller than the acceptable current (70 mA). Thus, it is not required to provide a large current capacity for the control power source section 36.

Because the plurality of ring electrodes 37 are connected to each high voltage IC in a group unit, the control of applying a predetermined potential with respect to all ring electrodes 37 can be carried out per high voltage IC, that is, per group. This simplifies the control compared with the case where the control of potential application is carried out with respect to individual ring electrodes 37.

Figure 13:
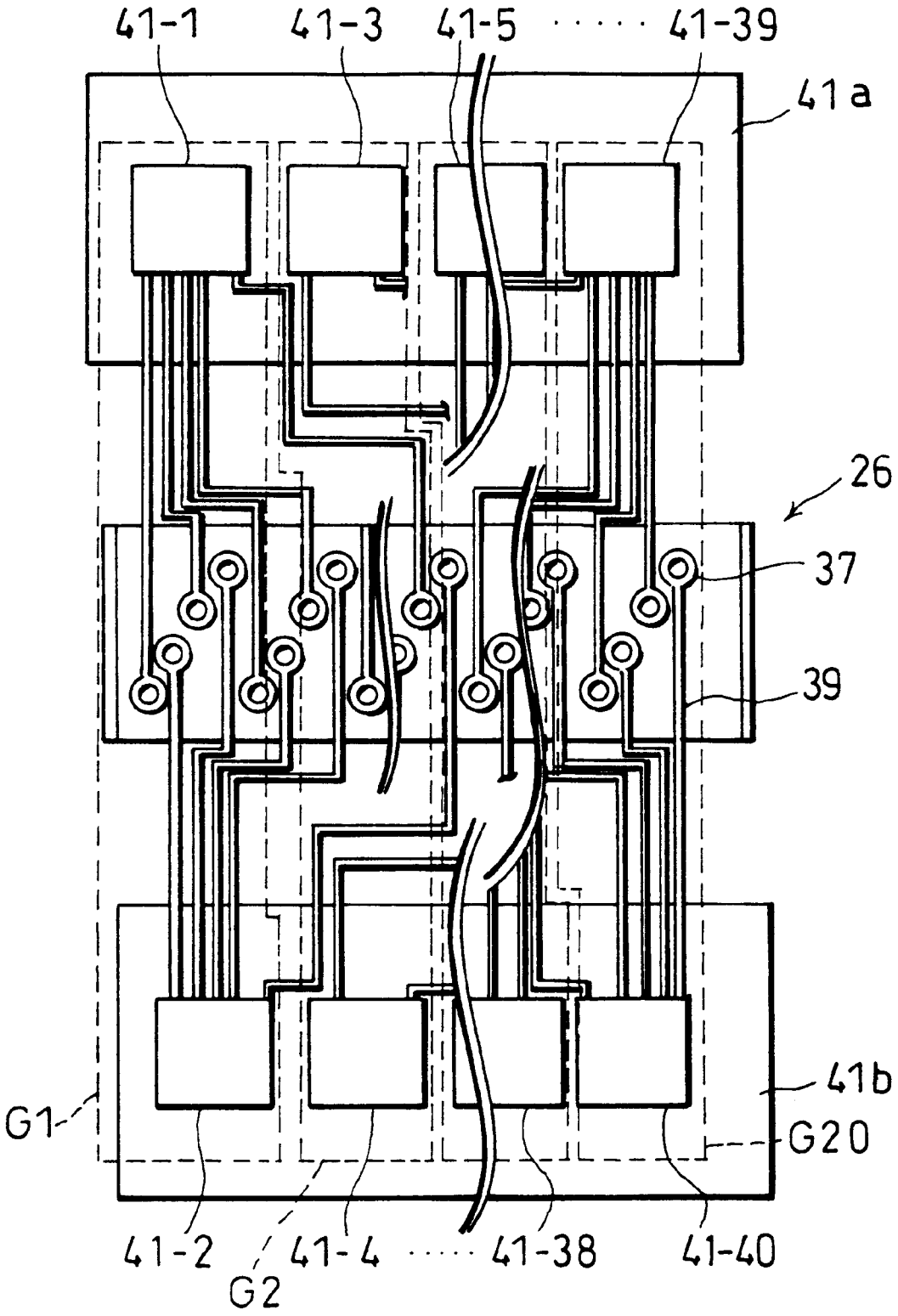
FIG. 13 is an explanatory drawing showing grouping of high-voltage ICS connected to the ring electrodes in the vicinity of the central portion of a substrate and high-voltage ICs connected to the ring electrodes in the vicinity of the edge portions of the substrate.

Note that, in the present Example, the simultaneous application of the ON potential is carried out per 64 ring electrodes 37, that is, per single high voltage IC. However, not limiting to this, it is possible alternatively, for example, as shown in FIG. 13, to provide 20 groups of a pair of high voltage ICs, such as Group G1 coupling high voltage ICs 41-1 and 41-2, Group G2 coupling high voltage ICs 41-3 and 41-4, and so on up to Group G20 coupling high voltage ICs 41-39 and 41-40, and simultaneously apply the ON potential with respect to 128 ring electrodes 37. This further simplifies the control compared with the case where the control of potential application is carried out per individual high voltage IC.

Figure 14:
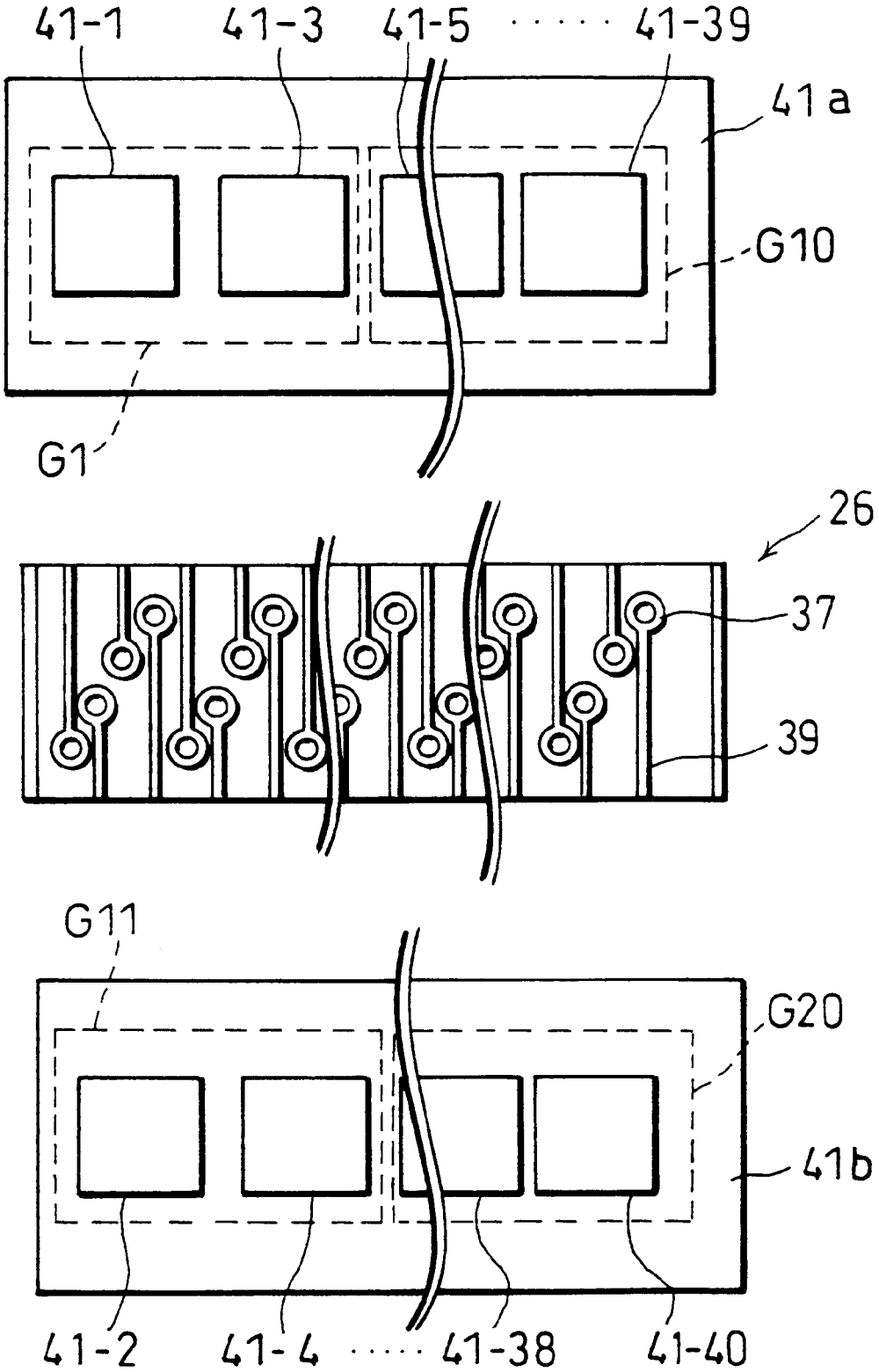
FIG. 14 is an explanatory drawing showing grouping within high-voltage ICs connected to the ring electrodes at the central portion of the substrate and grouping within high-voltage ICs connected to the ring electrodes in the vicinity of the edge portions of the substrate.

Note that, as shown in FIG. 14, the above groups may be Group G1 coupling high voltage ICs 41-1 and 41-3, Group G11 coupling high voltage ICs 41-2 and 41-4, and Group G20 coupling high voltage ICs 41-38 and 41-40.

Also, in FIG. 14, for simplicity, the connections between the charger lines 39 and the respective high voltage ICs are omitted. Further, each group may be composed of three or more high voltage ICs. However, it is required in this case that the peak value of transient current which flows when the channels of each group are switched on simultaneously does not to exceed the acceptable value (70 mA).

Note that, the amount of charge Q supplied per unit area of the ring electrode 37 is represented by $Q=CV=(\epsilon/d)\cdot V$, where C is the electrostatic capacity of the ring electrode 37, d the distance between the toner carrier 22 and the ring electrode 37, and $\epsilon$ the dielectric constant of the ring electrode 37. Therefore, when the distance d changes, the amount of charge Q is also changed accordingly.

Figure 15:
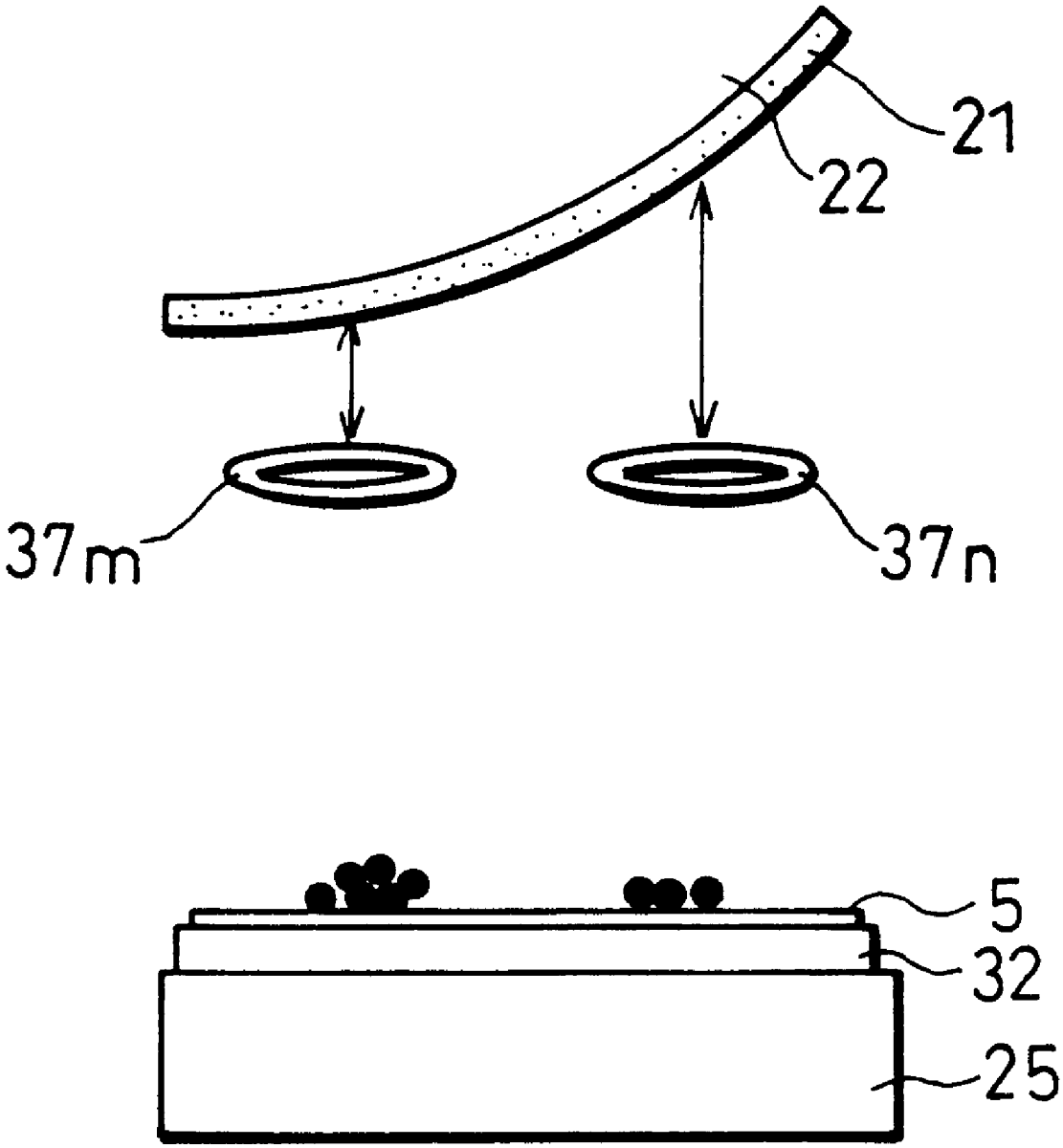
FIG. 15 is an explanatory drawing showing a positional relationship between the ring electrodes in the vicinity of the central portion of the substrate and the ring electrodes in the vicinity of the edge portions of the substrate with respect to a toner carrier.

In the present Example, as shown in FIG. 15, the distance between the toner carrier 22 and the ring electrode 37*m* and the distance between the toner carrier 22 and the ring electrode 37*n* are different, and, for example, the high voltage IC 41-1 and the ring electrodes 37*m* are connected to each other, and the high voltage IC 41-2 and the ring electrodes 37*n* are connected each other.

Therefore, even when the high voltage ICs 41-1 and 41-2 supply the same high voltage to the ring electrodes 37*m* and 37*n*, respectively, the amount of charge supplied to the ring electrodes 37*m* and 37*n* are different.

More specifically, because the distance d between the ring electrodes 37*m* and the toner carrier 22 is shorter than the distance d between the ring electrodes 37*n* and the toner carrier 22, from the above equation, the current flowing through the ring electrodes 37*m* is larger than the current flowing through the ring electrodes 37*n*.

Therefore, as described above, even though it is possible in principle to constitute a group from arbitrary numbers of high voltage ICs, as shown in FIG. 16, when groups are to be formed using a plurality of high voltage ICs, it is preferable, under the premise that the sum of transient currents which simultaneously flow in each group does not exceed the current capacity of the control power source section 36, that larger numbers of high voltage ICs are used to constitute a group when the high voltage ICs are connected to the ring electrodes 37*n* (for example, Group G1 is formed with high voltage ICs 41-1, 41-3, and 41-5), and that smaller numbers of high voltage ICs are used to constitute a group when the high voltage ICs are connected to the ring electrodes 37*m* (for example, Group G2 is formed with high voltage ICs 41-2 and 41-4).

In such a case, the total number of high voltage ICs can be reduced compared with the case where each group is formed with a pair of high voltage ICs, thus reducing the cost, simplifying the structure, and realizing more efficient control.

The following describes the timing control of potential application to the ring electrodes 37 of the present Example, using the structure of FIG. 13 as an example.

Figure 17:
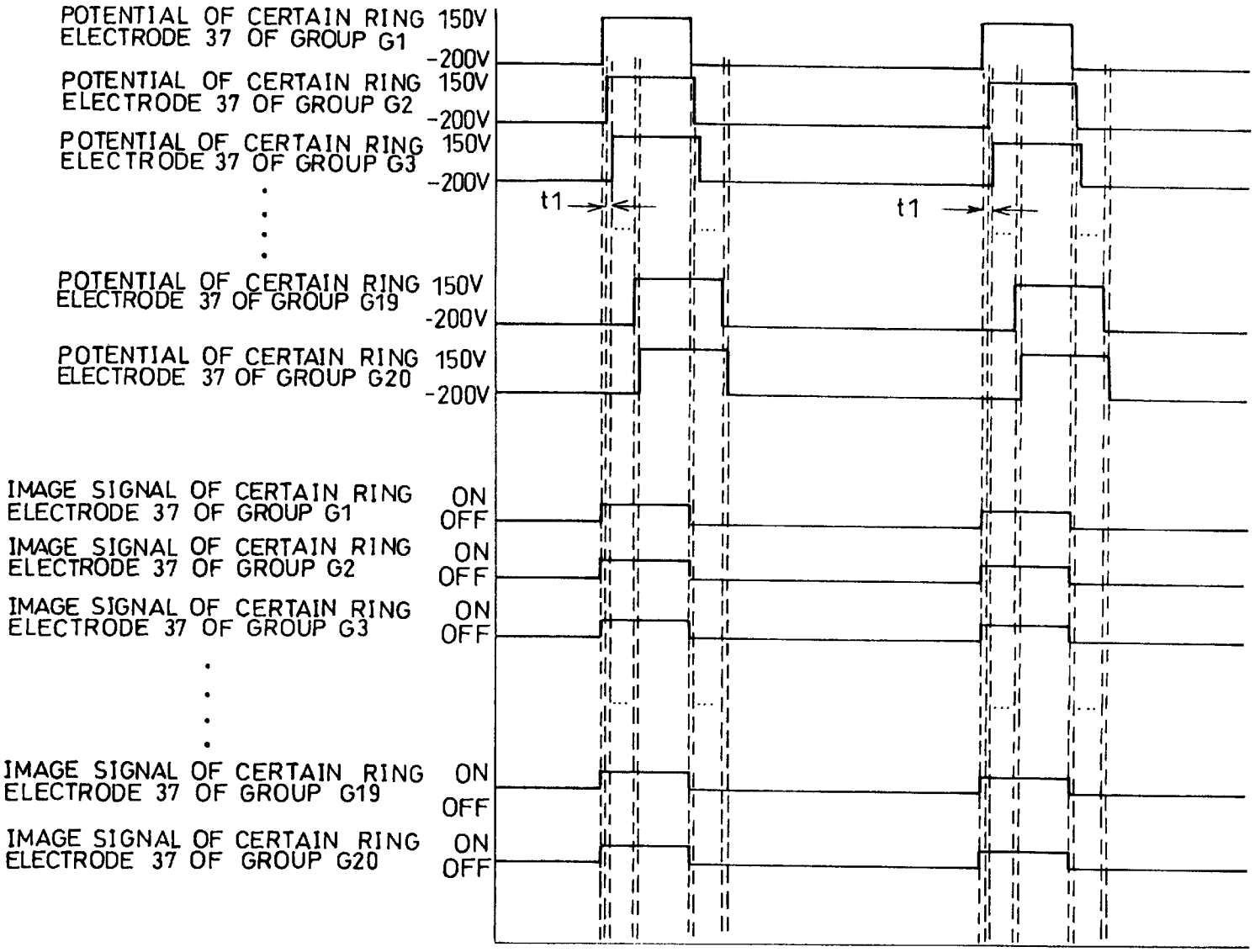
FIG. 17 is an explanatory drawing showing potential waveforms when a potential is applied to a plurality of grouped ring electrodes per group with a shifted apply timing, and waveforms of an image signal applied to each ring electrode.

FIG. 17, in the structure of FIG. 13, shows potential waveforms, each being a potential waveform of a certain ring electrode 37 of each group, which are obtained when the ON potential is applied to the ring electrodes 37 of Group G1 to Group G20 in this order. In FIG. 17, time t1 of timing shift of potential application between adjacent groups is 25 $\mu$sec, and the total time of timing shift of potential application is 25 $\mu$sec×19=475 $\mu$sec.

Figure 18:
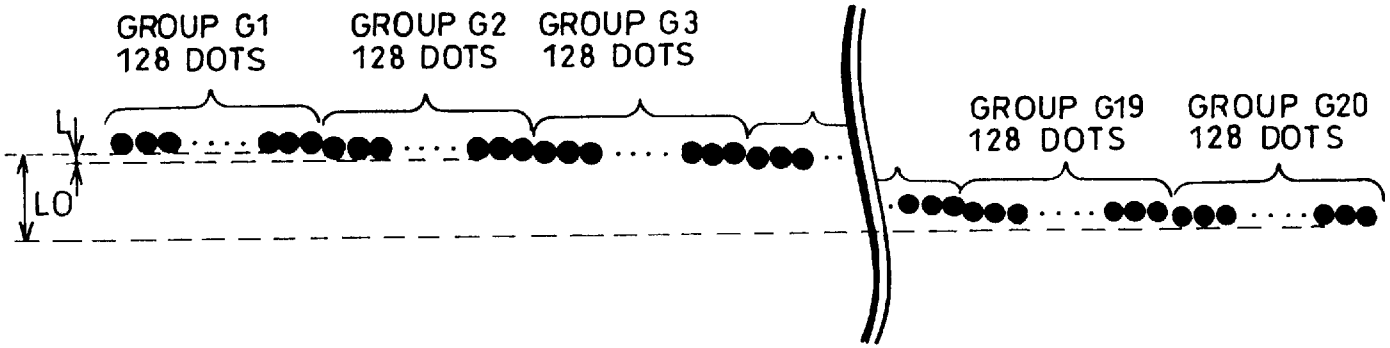
FIG. 18(*a*) is an explanatory drawing showing the degree of positional shift of dots when ON potential is Subsequently applied to adjacent groups with a shifted apply timing.
Figure 18:
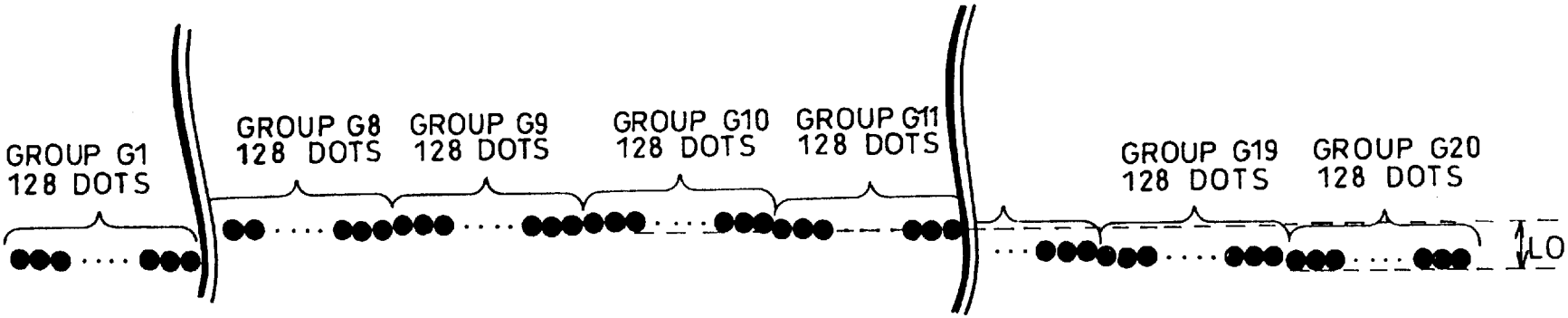

In the control of FIG. 17, as shown in FIG. 18(*a*), positional shift of dots, corresponding to the shift time of each group, is generated in a step manner when a horizontal line is formed on the sheet 5. However, when the transport speed of sheet 5 is 30 mm/sec, the positional shift L between adjacent two groups is 30 mm/sec×$25\times10^{-6}$ sec=$7.5\times10^{-4}$ mm, and the total positional shift L0 is $7.5\times10^{-4}$ mm 19=0.01425 mm (=14.25 $\mu$m) and is very small.

Therefore, in the control of the present Example,even when positional shift L0 equivalent of several dots is generated, as shown in FIG. 18(*a*), it is only manifested as a slight slope on the horizontal line.

Even when the positional shift L0 becomes large, for example, by an increase in resolution, an increase in the number of ring electrodes 37 and groups as a result of an increase in sheet width for example, an increased transport speed of the sheet 5, a change in time constant of the switching circuit of the potential, and by the arrangement and specifications of the apparatus, the amount of shift is within the range of several $\mu$m, and deterioration of the quality of the printed image is not to the extent which is recognizable by the user. Further, when the shift time t1 is reduced to several $\mu$sec, the amount of total positional shift L0 is also reduced to several $\mu$m, and the positional shift due to timing shift of potential application becomes negligible.

Note that, in the present Example, the ON potential is applied to the ring electrodes 37 by shifting the timing by time t1 in an order of Group G1 to Group G20. However, the order is not limited to this.

Figure 19:
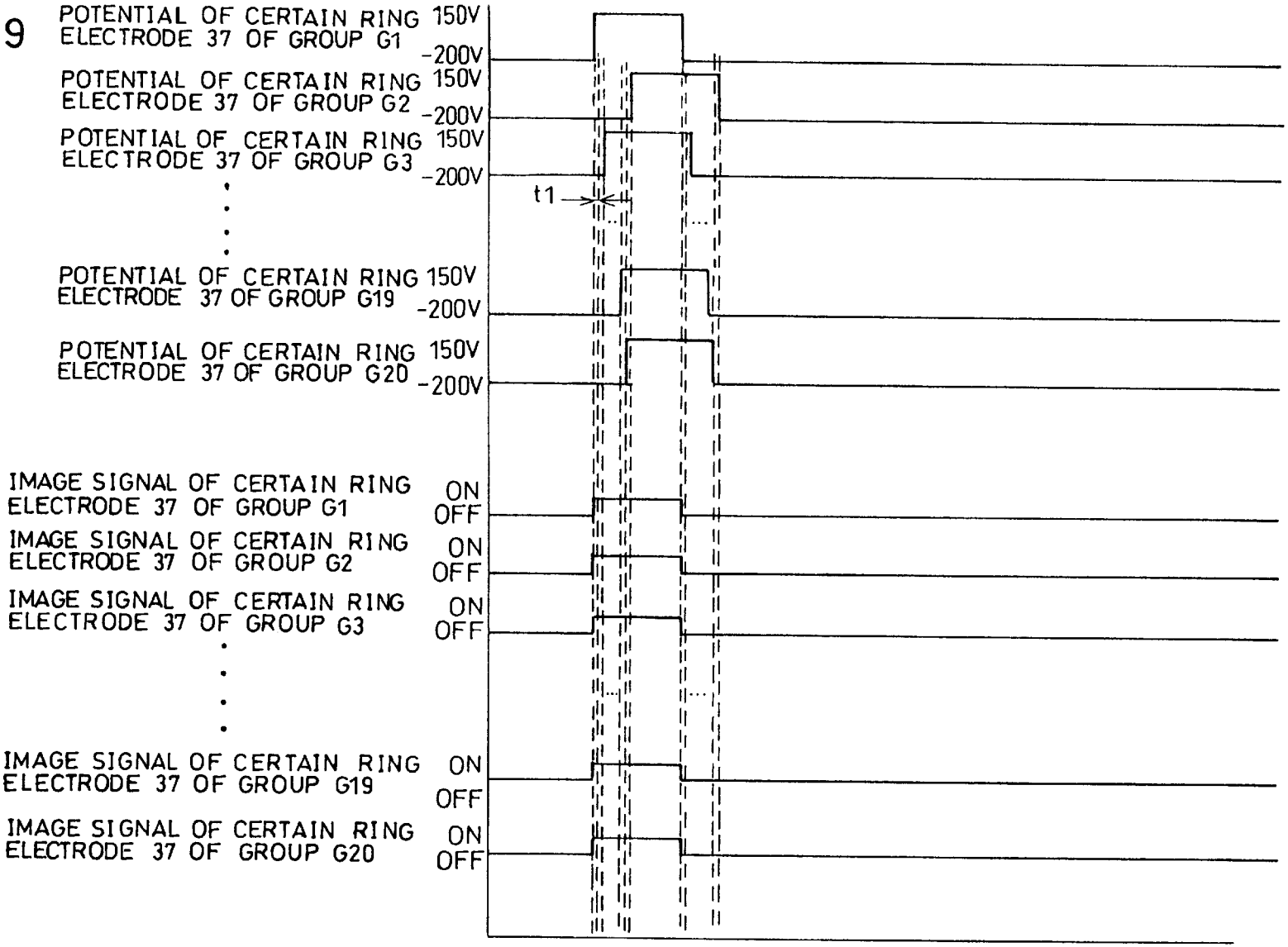
FIG. 19 is an explanatory drawing showing potential waveforms of the ring electrodes and waveforms of an image signal applied to the ring electrodes, when ON potential is subsequently applied to adjacent groups with a shifted apply time, skipping one group en route, and lastly to the skipped group.
Figure 20:
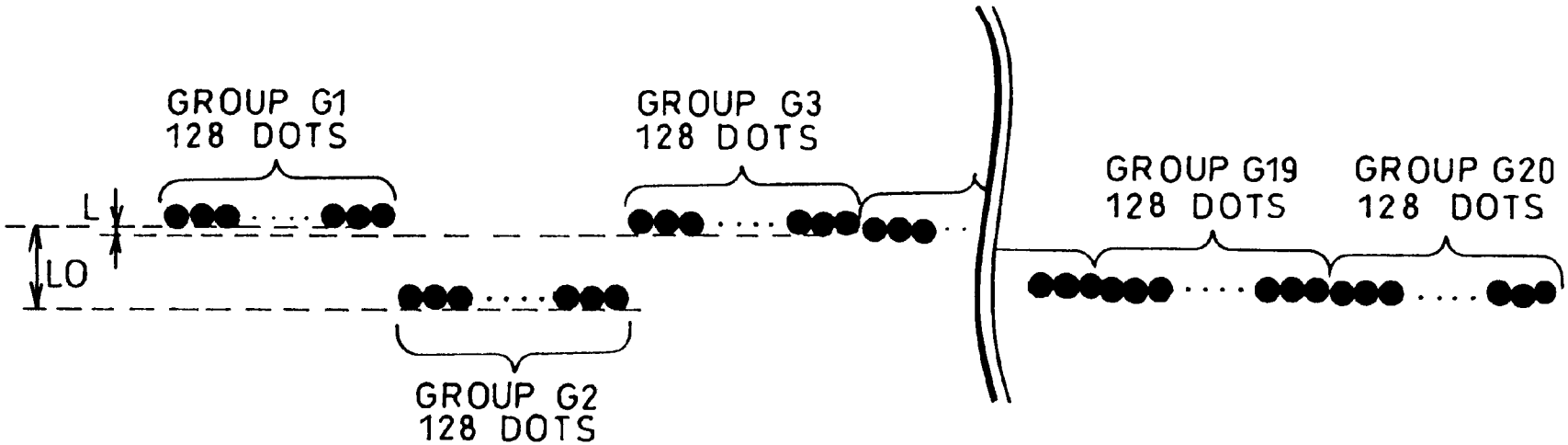
FIG. 20 is an explanatory drawing showing the degree of positional shift of dots actually formed by the control of potential application of FIG. 19.

For example as shown in FIG. 19, when the control is carried out in such a manner that the ON potential is applied first to the ring electrodes 37 of Group G1, skipping Group G2, and then to the ring electrodes 37 of Group G3, Group G4, and up to Group G20 in this order, and finally to the ring electrodes 37 of Group G2, a horizontal line as shown in FIG. 20 is formed, and the positional shift of dots due to timing shift of potential application becomes eminently noticeable and therefore this control is not preferable.

Therefore, the control is rather carried out in such a manner that the ON potential is applied to the groups in an order which are neither adjacent to nor widely separated from one another, such as Group G1, Group G3, Group G2, Group G4, and so on up to Group G20. In this case, an image (horizontal line) as shown in FIG. 20, in which the dot position is shifted in isolation, is not formed, and the image appears natural to the user.

Also, instead of applying the ON potential subsequently from a group at the end, it is possible alternatively, for example, to apply the ON potential first to a group at the center (for example, Group G10) and then subsequently to a group towards the end. In such a case, the ON potential is applied subsequently from Groups G9 and G11, Groups G8 and G12, and so on to Groups G1 and G19, simultaneously for each pair, and finally to Group G20.

Note that, even when the ON potential is applied to the ring electrodes 37 of a pair of groups at the same time, the transient current which momentarily flows is 140×μA×256=35840 μA=35.84 mA, and does not exceed the acceptable value of 70 mA.

FIG. 18(*b*) shows an image which is obtained by such a control. In the described control, the ON potential is applied to at the maximum of two groups, and compared with the case of the control as shown in FIG. 17, the time required for finishing the application of ON potential to all groups is reduced to almost half.

Accordingly, the maximum value of positional shift L0 of dots is also reduced to almost half of 14.25 μm. This makes it even more difficult for the user to recognize the distortion of the image, and the image appears more naturally.

Figure 21A:
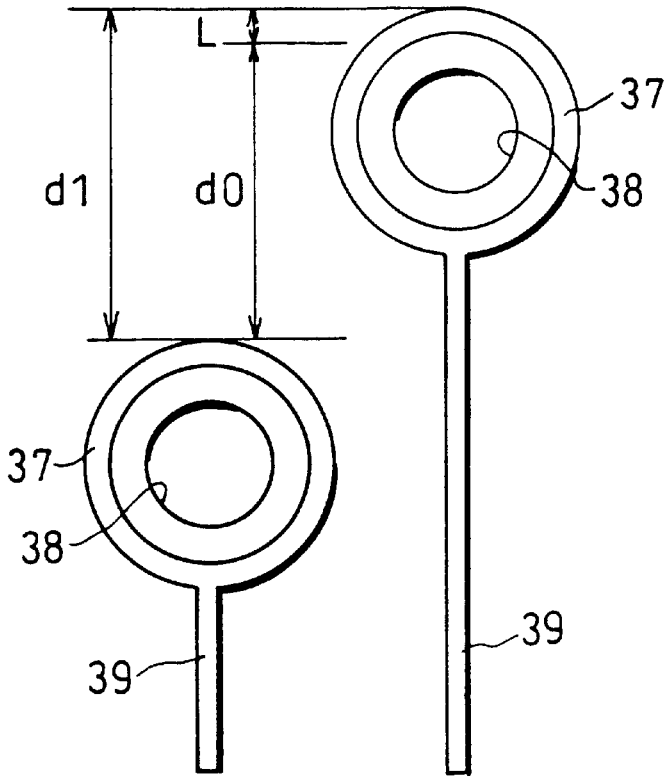
FIG. 21(*a*) is a plan view showing a positional relationship of gate and ring electrodes adjacent to another set of gate and ring electrodes when the gate and ring electrodes are formed to correct the positional shift of dots generated by the timing shift of ON potential application.
Figure 21B:
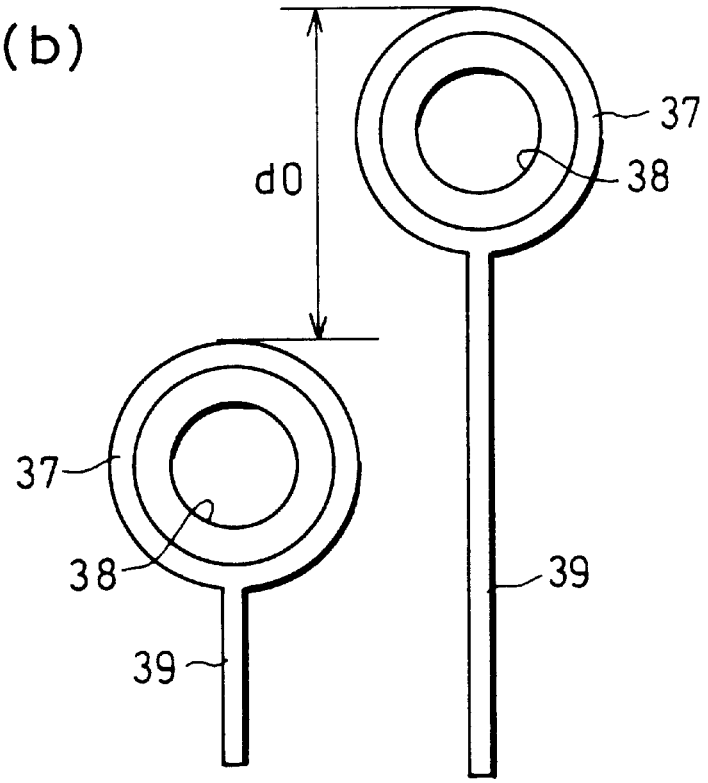

Note that, as described, it is essential to control the application of ON potential to each group so that the image formed on the sheet 5 is not distorted greatly. In the case where even a slight distortion presents a problem, for example as shown in FIG. 21(*a*), it is very effective to adopt a method in which the position of the ring electrode 37 and the gate 38 is shifted beforehand in a direction along the charger lines 39 (transport direction of sheet 5) with respect to the position of another ring electrode 37 and gate 38 in accordance with the amount of the positional shift L of dots, preferably by the amount equal to the positional shift L of dots, caused by timing shift of ON potential application. specifically, as shown in FIG. 21(*b*), on the control electrode 26 of FIG. 4, when an original offset amount of adjacent ring electrodes 37 in the extending direction of the charger lines 39 is do, the ring electrodes 37 are positioned so that the offset amount d1 of the adjacent ring electrodes 37 in the direction of the charger lines 39 is d1=d0+L.

In this manner, by positioning the ring electrodes 37 and the gates 38 adjacent to one another, taking into consideration beforehand the positional shift L of dots, even slightest positional shift of dots as shown in FIG. 18(*a*) and FIG. 18(*b*) is eliminated, thus further improving the quality of the image formed.

Note that, the correction of the positional shift of dots as described above can also be carried out, other than positioning the ring electrodes 37 and the gates 38 in a predetermined manner, for example, by inclining the position of the control electrode 26 with respect to the transport direction of sheet 5.

EXAMPLE 5

The above Examples 1 through 4 described specifically the timing of applying the ON potential to the ring electrodes 37. However, the transient current also flows through the ring electrodes 37 when the OFF potential is applied to the ring electrodes 37, and therefore the principle of Examples 1 through 4 is also applicable to the case where the potential is switched to the OFF potential. Namely, a control for shifting the timing of applying the OFF potential is essentially required.

In the above Examples 1 through 4, the apply time of ON potential is constant, and for this reason when the timing of applying the ON potential is shifted, for example, by 25 μsec, the timing of applying the OFF potential is also shifted automatically by 25 μsec. Thus, in Examples 1 through 4, it is not required to carry out an independent control of shifting the timing of applying the OFF potential.

However, when it comes to the case where the absolute values of ON and OFF potentials are different, or duration (time constant) t01 of the transient current generated when the potential is switched to the ON potential is different from duration (time constant) t02 of the transient current generated when the OFF potential is applied, for example, due to the effect of impedance characteristic of the power source, it is not always the case that the sum of transient currents which flow momentarily at the switching of potential is reduced by a predetermined amount, even when the timing of applying the ON potential is shifted by ti or t2 as described and the timing is shifted by t1 or t2 at the switching to the OFF potential.

The following describes such a phenomenon in detail, using a pair of ring electrodes 37*a* and 37*b* as an example. Note that, in the following, the ON potential is applied to the ring electrode 37*a* and the ring electrode 37*b* in this order.

Figure 22:
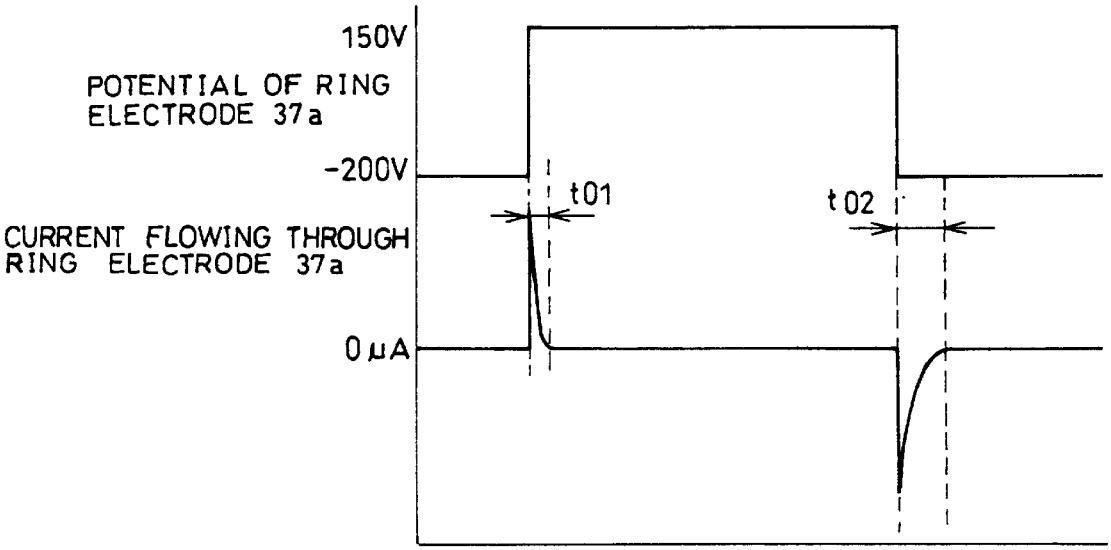
FIG. 22(*a*) is an explanatory drawing showing a potential waveform by application of ON potential and OFF potential, and waveforms of transient current when a duration of a transient current which flows by application of OFF potential is longer than a duration of a transient current which flows by application of ON potential.
Figure 22B:
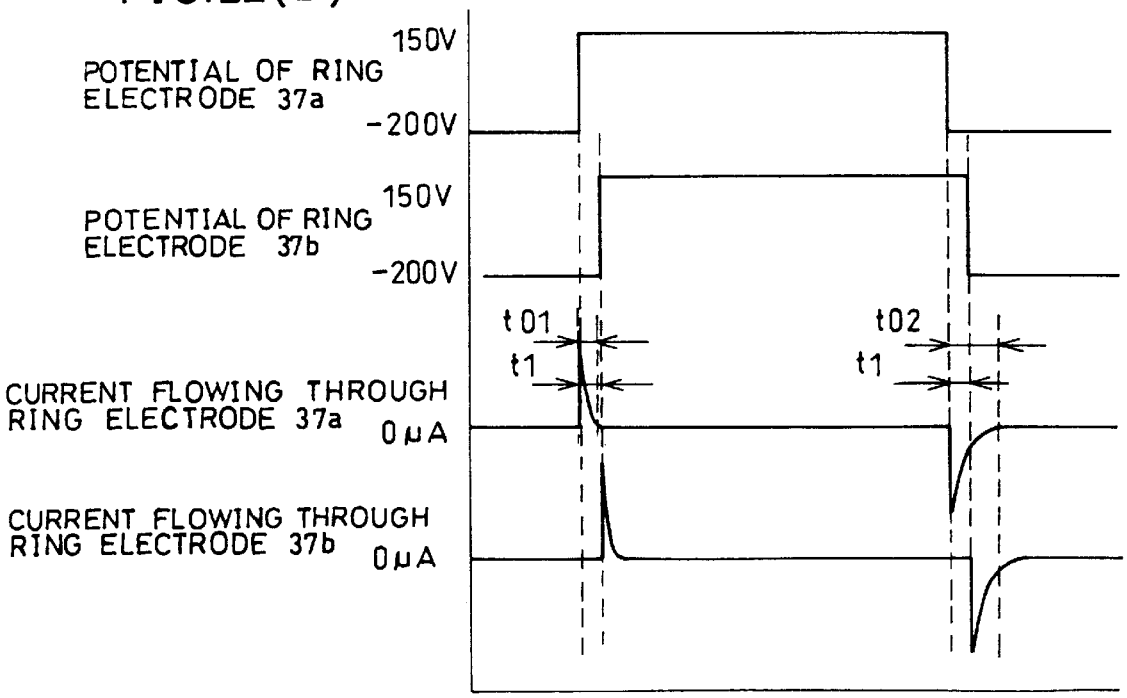

FIG. 22(*a*) illustrates the case where duration t01 of transient current generated at the switching to the ON potential and duration t02 of transient current generated at the switching to the OFF potential are related to one another by t01<t02 in the transient current flowing through the ring electrode 37*a*.

When the control as described in Examples 1 through 4 is carried out with respect to this current waveform, as shown in FIG. 22(*b*), there is a case where switching to OFF potential is made on the ring electrode 37*b* before the current value of the transient current generated in the ring electrode 37*a* at the switching to OFF potential becomes zero, and as a result the sum of transient currents at a predetermined time cannot be controlled with certainty.

Figure 23:
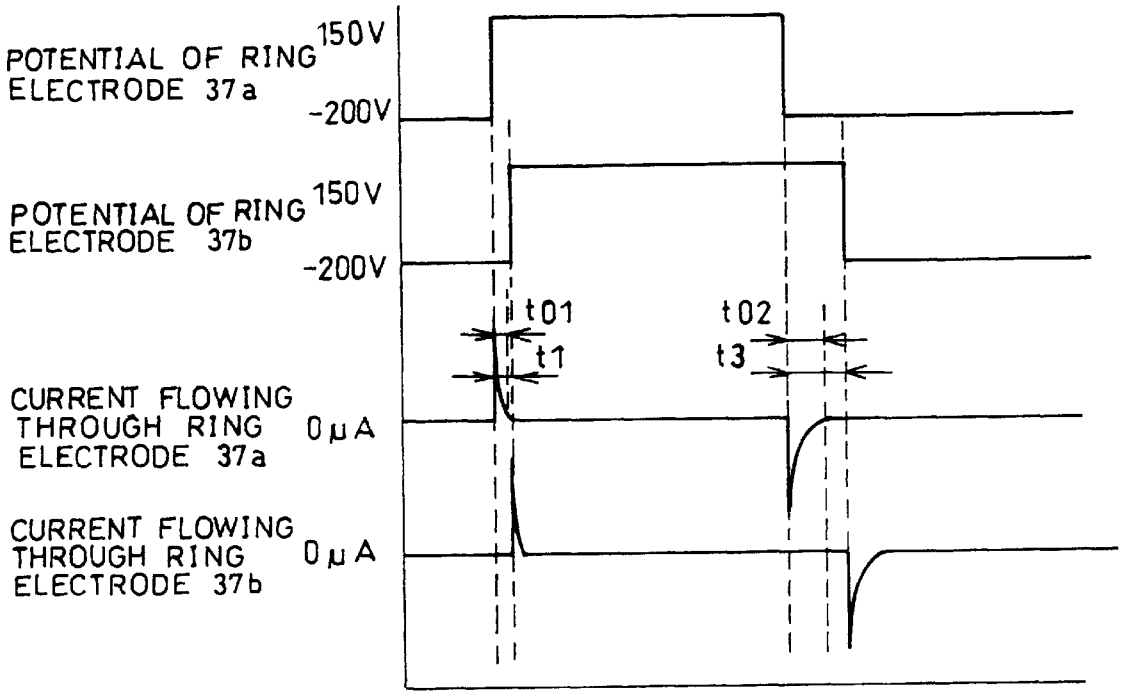
FIG. 23(*a*) is an explanatory drawing showing potential waveforms and waveforms of transient current through the ring electrodes, when the apply time of ON potential of a ring electrode to which ON potential is applied later is adjusted longer than the apply time of ON potential of a ring electrode to which ON potential is applied first so that the transient currents which flow by application of ON potential and the transient currents which flow by application of OFF potential are both not overlapped with one another in time.
Figure 23:
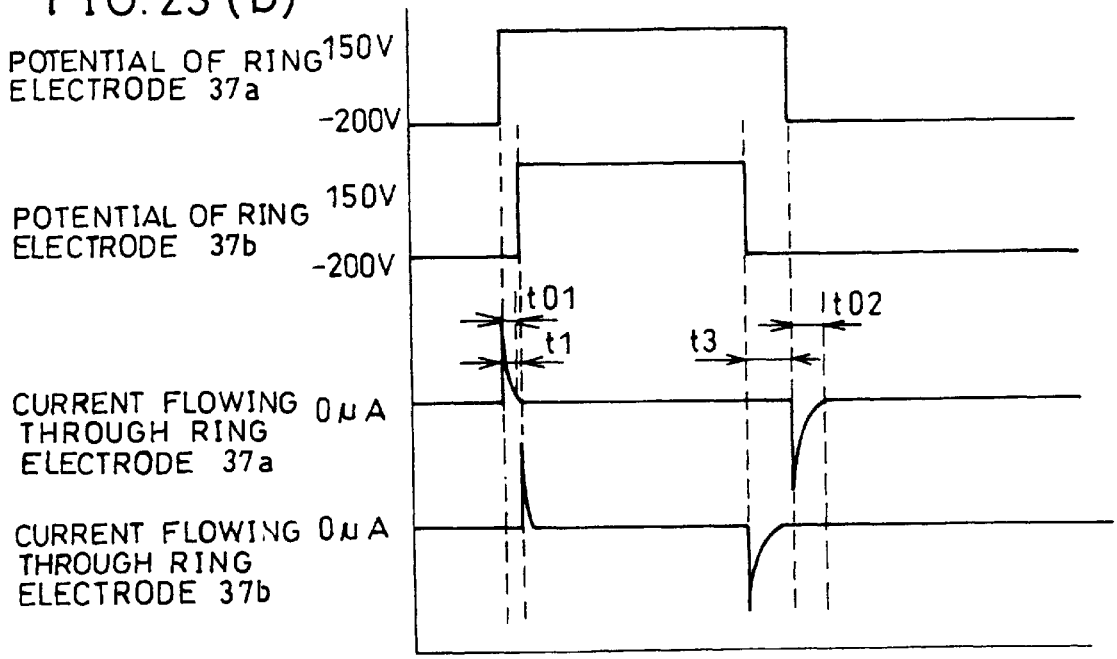

Therefore, in the present Example, as shown in FIG. 23(*a*), time t3 for shifting the timing of applying the OFF potential is separately provided from time t1 for shifting the timing of applying the ON potential so that t02<t3. Namely, the OFF potential is applied to a subsequent ring electrode 37*b* after elapsed time t3, which is longer than duration t02 of the transient current, after application of OFF potential to the ring electrode 37*a*.

In this control, the transient currents generated at the switching to the OFF potential on the plurality of ring electrodes 37 do not flow in an overlapping manner in time. Thus, it is ensured that the sum of transient currents is controlled also at the switching to the OFF potential.

Also, because the sum of transient currents which flows at the switching to the OFF potential is the transient current flowing through a single ring electrode 37, the control power source section 36 only needs to be provided with a current capacity capable of supplying a transient current of a single ring electrode 37 at a predetermined time. This allows the control power source section 36 to have only a small current capacity, thus reducing the cost of the control power source section 36, preventing in turn an increase in size and cost of the apparatus.

Alternatively, this effect can also be obtained by carrying out a control, as shown in FIG. 23(*b*), in which the OFF potential is applied to the ring electrode 37*b* the amount of time t3 earlier than application of the OFF potential to the ring electrode 37*a*. In this case, however, the applied pulse width becomes shorter, and for this reason it is required that printing is not adversely affected by such an applied pulse width.

Figure 24:
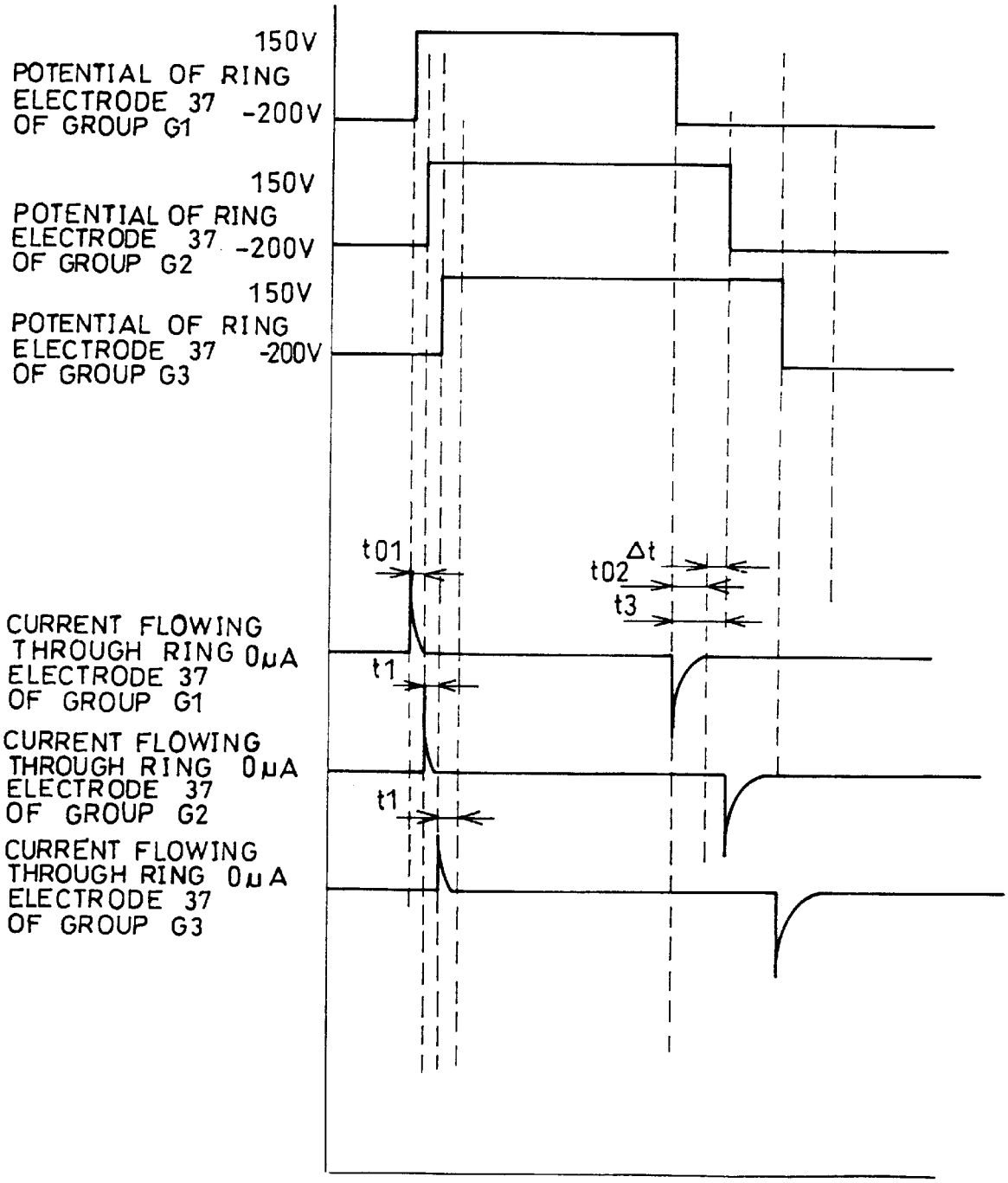
FIG. 24 is an explanatory drawing showing potential waveforms and waveforms of transient current through the ring electrodes, when the apply time is gradually increased by adjusting the apply time of ON potential of a ring electrode to which ON potential is applied later to be longer than the apply time of ON potential of a ring electrode to which ON potential is applied first so that the transient currents which flow by application of ON potential and the transient currents which flow by application of OFF potential are both not overlapped with one another in time.

Note that, in the case where the plurality of ring electrodes 37 are divided into 20 groups of Group G1 to Group G20, as shown in FIG. 24, while no problem is presented when at, which is the difference between duration t02 of transient current and time t3, is small enough, when At is larger than a certain value, the time for applying the potential gradually becomes longer as the potential is applied subsequently from Group G2, Group G3, and so on up to Group G20. As a result, compared with Group G1 to which the potential is applied first, the time for applying the potential becomes excessively longer for Group G20, to which the potential is applied last.

When the time for applying the potential becomes excessively long, the toner 21 is flown in excess, and this results in an increase in dot diameter and dot density on the sheet 5, failing to form uniform dots. Also, because the image density is nonuniform, reproduction of halftones becomes insufficient. Other problems are also presented that the amount of toner consumed is increased by excessive consumption of the toner 21. For these reasons, it is not preferable to increase the time for applying the potential excessively.

It is experimentally determined that the duration t01 of transient current generated when applying the ON potential is 15 μsec as described, and that the duration t02 of transient current generated when applying the OFF potential is 22 μsec. Therefore, in the present Example, time t1 for shifting the timing of applying the ON potential is set to a value which is not less than t01 and t02, and to a value closer to larger of t01 and t02, for example, to the value of 25 μsec. This minimizes the occurrence of pulse width gradually becoming longer, as shown in FIG. 24, thus preventing the above-mentioned problems associated with an increase in pulse width.

EXAMPLE 6

In the described Examples 1 through 5, the toner carrier 22 is grounded, and as a potential required for controlling flying of toner, for example, an ON potential of 150 V and an OFF potential of −200 V are used. However, the potentials are not just limited to these values, and it is possible for example to offset the ON potential and the OFF potential from each other so that one of the potentials is 0 V (ground potential).

Figure 25:
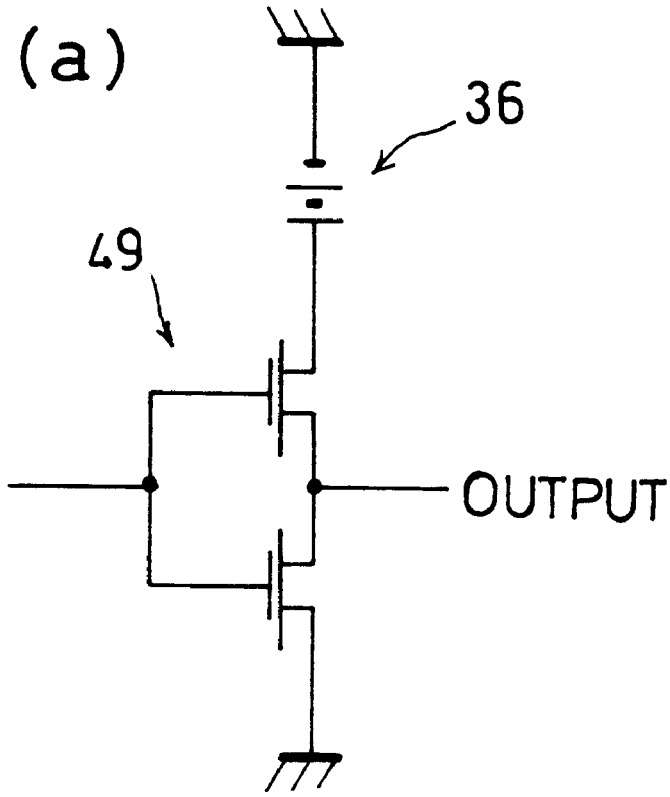
FIG. 25(*a*) is an explanatory drawing showing a circuit structure adopting a switching element which supplies an apply potential from a control power source section to the ring electrodes when applying ON potential to the ring electrodes, and supplies a ground potential to the ring electrodes when applying OFF potential to the ring electrodes.
Figure 25:
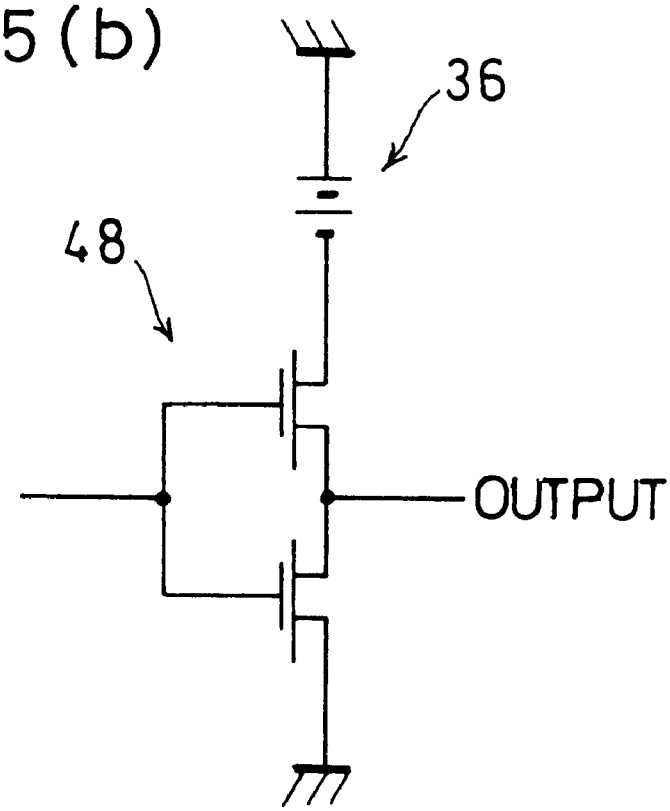

Such a control is realized by offsetting the potential applied to each component of the apparatus by 200 V (for example, 200 V is applied to the toner carrier 22). For this control, control power source section 36 with an output of 350 V is used, and as shown in FIG. 25(*a*), switching element 49 of a push-pull type is used.

The switching element 49 supplies an ON potential of 350 V outputted from the control power source section 36 to the ring electrodes 37 when applying the ON potential to the ring electrodes 37. On the other hand, when applying the OFF potential to the ring electrodes 37, one terminal of the switching element 49 is connected to the positive node of the control power source section 36 and the other terminal is grounded so that the ground potential (0 V) is supplied to the ring electrodes 37. The negative terminal of the control power source section 36 is grounded.

In this structure, the transient current which flows through the ring electrodes 37 while the ON potential is being applied is supplied from the control power source section 36, and the transient current which flows through the ring electrodes 37 while the OFF potential is being applied is supplied from the grounded portion. Therefore, in this case, the grounded portion constitutes the supply source of OFF potential with an unlimited current capacity, and accordingly it is not required to carry out the control, for example, as shown in FIG. 23(*a*) and FIG. 23(*b*) and FIG. 24, for preventing overlapping of transient current peaks. As a result, the above control only needs to be carried out when applying the ON potential, thus simplifying the control of potential application with respect to the ring electrodes 37.

Note that, in this structure, it is possible to carry out a control for setting the timing of applying the OFF potential to individual ring electrodes 37 at the same timing. However, in this case, it is essential that a change in dot diameter and dot density due to reduced apply time of the ON potential does not adversely affect the image.

It is possible alternatively to offset the potential applied to each component of the apparatus by −150 V, for example. The circuit structure which carries out this control is shown in FIG. 25(*b*). In this structure, control power source section 36 with an output of −350 V is used, and a switching element 48 of a push-pull type is used. T he switching element 48 applies a ground potential (0 V) to the ring electrodes 37 when applying the ON potential to the ring electrodes 37. on the other hand, when applying the OFF potential to the ring electrodes 37, one terminal of the switching element 48 is grounded and the other terminal thereof is connected to the negative node of the control power source section 36 so that the ON potential of −350 V outputted from the control power source section 36 is supplied to the ring electrodes 37. The positive node of the control power source section 36 is grounded.

In this structure, the transient current which flows through the ring electrodes 37 while the OFF potential is being applied is supplied from the control power source section 36, and the transient current which flows through the ring electrodes 37 while the ON potential is being applied is supplied from the grounded portion. Therefore, in this case, the grounded portion constitutes the supply source of ON potential with an unlimited current capacity. Accordingly, in this case, it is not required to carry out the control of setting the timing when applying the ON potential, and it is only required to carry out the control of shifting the timing when applying the OFF potential.

Figure 26:
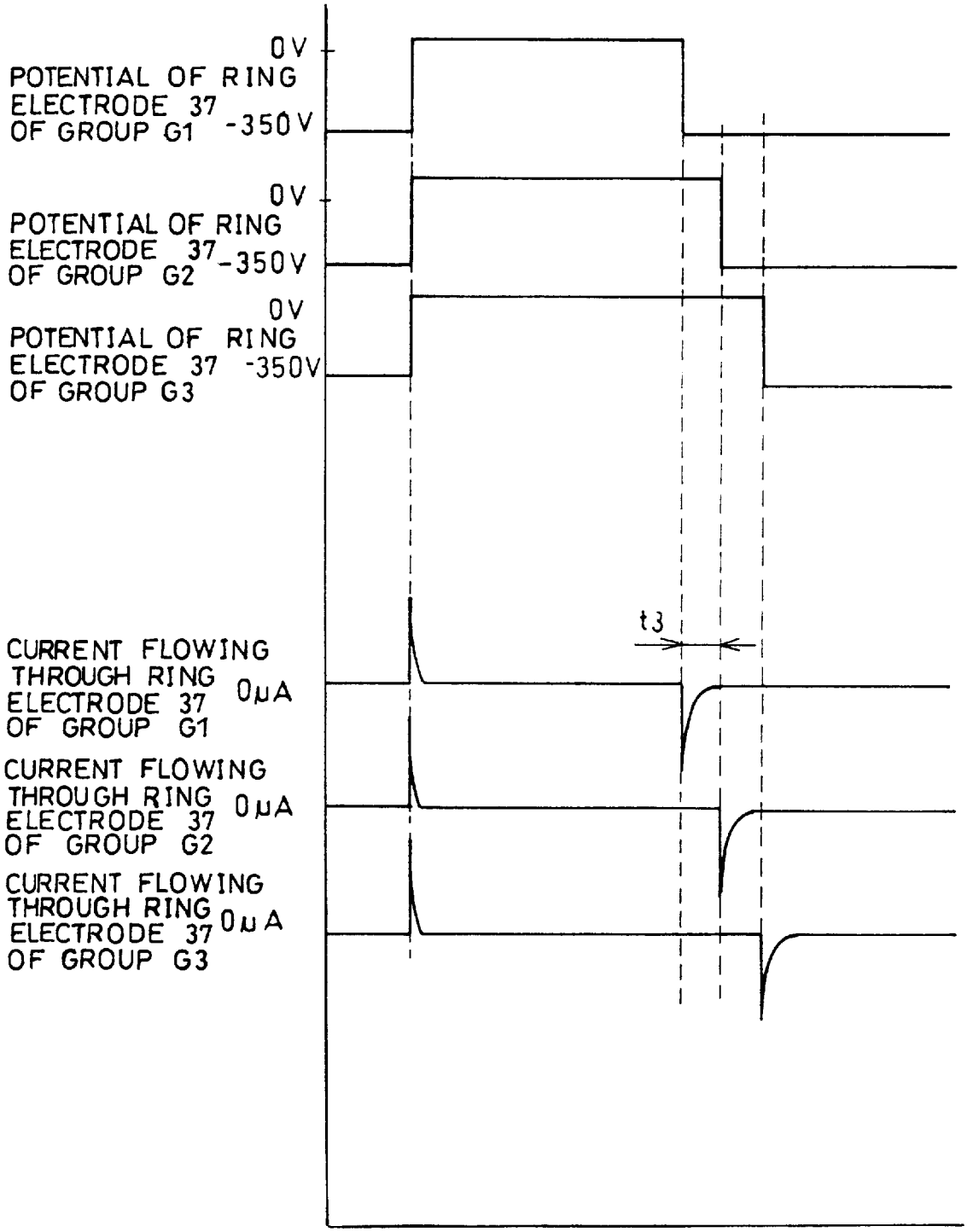
FIG. 26 is an explanatory drawing showing potential waveforms and waveforms of transient current through the ring electrodes, when the timing of applying OFF potential to each ring electrode is shifted and the timing of applying ON potential is the same so that the transient currents which flow by application of OFF potential do not overlap with one another in time.

Also, in this structure, as shown in FIG. 26, it is possible to carry out a control in which the timing of applying the OFF potential to individual ring electrodes 37 is shifted by time t3, and the timing of applying the ON potential is the same. However, in this case, it is essential that a change in dot diameter and dot density due to increased apply time of ON potential does not adversely affect the image.

Figure 27:
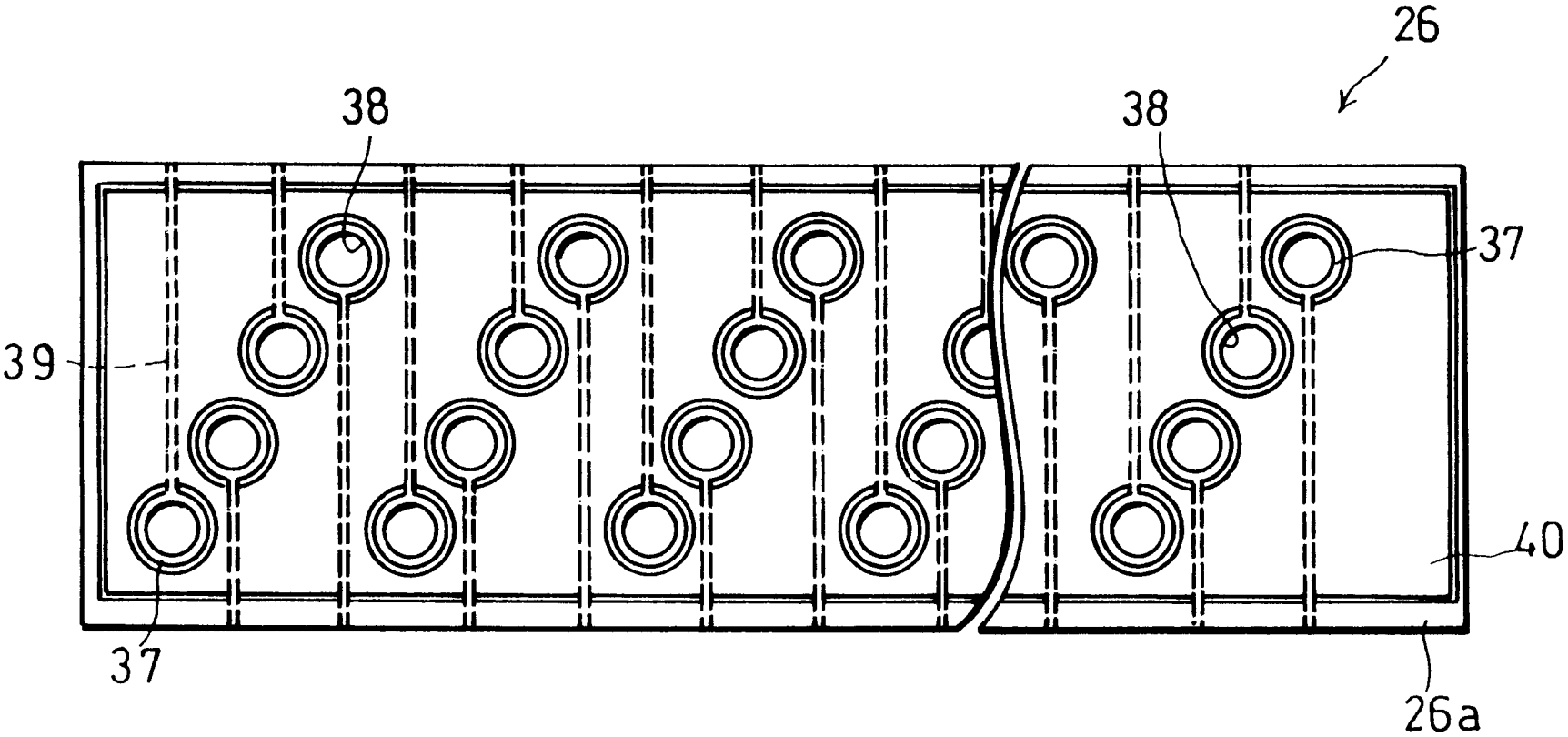
FIG. 27 is a plan view showing a structure of the control electrode provided with a shield electrode.

Note that, as the control electrode 26 used in the above Examples 1 through 6, it is possible alternatively to adopt, for example as shown in FIG. 27, a control electrode in which a shield electrode 40 having opening sections corresponding one to one to the gates 38 is provided on the substrate 26*a* on the side of the toner carrier 22.

Without the provision of such a shield electrode 40, there is a case where the toner 21 is flown not only towards the gates 38 but also towards the charger lines 39 upon application of the ON potential to the ring electrodes 37. When the toner 21 is flown in excess towards the control electrode 26 in this manner, a problem, such as contamination of the control electrode 26, is presented. Further, adhesion of toner 21 to the control electrode 26 could lead to clogging of the gates 38.

With the provision of the shield electrode 40, flying of toner 21 can be localized only on the portion where the gates 38 are provided, thus preventing the above problem. Also, provision of the shield electrode 40 allows the amount of toner flying onto the gate 38 portion to be adjusted, thus providing effective means of adjusting the amount of flying toner for forming desirable dots.

Also, when the shield electrode 40 is provided, an electrode (shield electrode 40) facing the ring electrodes 37 is positioned more closely to the ring electrodes 37. Thus, when the potential of the ring electrodes 37 is switched to the ON potential or to the OFF potential to control flying of toner, the amount of charge supplied to each ring electrode 37 becomes larger compared with the case where the shield electrode 40 is not provided.

The following describes this principle in more detail. When the shield electrode 40 is provided, the distance between the ring electrodes 37 and the shield electrode 40 is typically around 50 $\mu$m, and the ring electrodes 37 and the shield electrode 40 can be regarded as a capacitor of some sort.

When this principle is applied to the case where the shield electrode 40 is not provided, the ring electrodes 37 and the toner carrier 22, or the ring electrodes 37 and the counter electrode 25 can be regarded as a capacitor. Note that, here, the distance between the ring electrodes 37 and the toner carrier 22, or between the ring electrodes 37 and the counter electrode 25 is around 100 $\mu$m or 1000 $\mu$m in each case.

Here, the amount of charge Q which flows when a potential is applied to the ring electrodes 37 is determined from $Q=Cv=(\epsilon S/d)\cdot V$ as described above.

Therefore, when the area S of facing electrodes remains constant with or without the provision of the shield electrode 40, "d" in the above equation becomes smaller with the provision of the shield electrode 40, compared with the case without it. Thus, the amount of charge Q supplied to the ring electrodes 37, that is, the amount of current which flows through the ring electrodes 37 is increased with the provision of the shield electrode 40.

Also, provision of the shield electrode 40 would require a control power source section 36 (see FIG. 3) having even larger current capacity. However, as in Examples 1 through 6, when the control of shifting the timing of applying the ON potential or OFF potential to the ring electrodes 37 is carried out, the peaks of transient currents do not overlap at a predetermined time, and the sum of transient currents does not exceed the acceptable value at a predetermined time. Therefore, it is not required to provide control power source section 36 having a large current capacity even when adopting the control electrode 26 having the shield electrode 40.

Note that, the shield electrode 40 may also be provided on the side of the counter electrode 25 in addition to the side of the toner carrier. In this case, the amount of charge supplied from the control power source section 36 is further increased. However, by the potential application control of Examples 1 through 6, the control power source section 36 needs not to be provided with a large current capacity.

[Second Embodiment]

Figure 28:
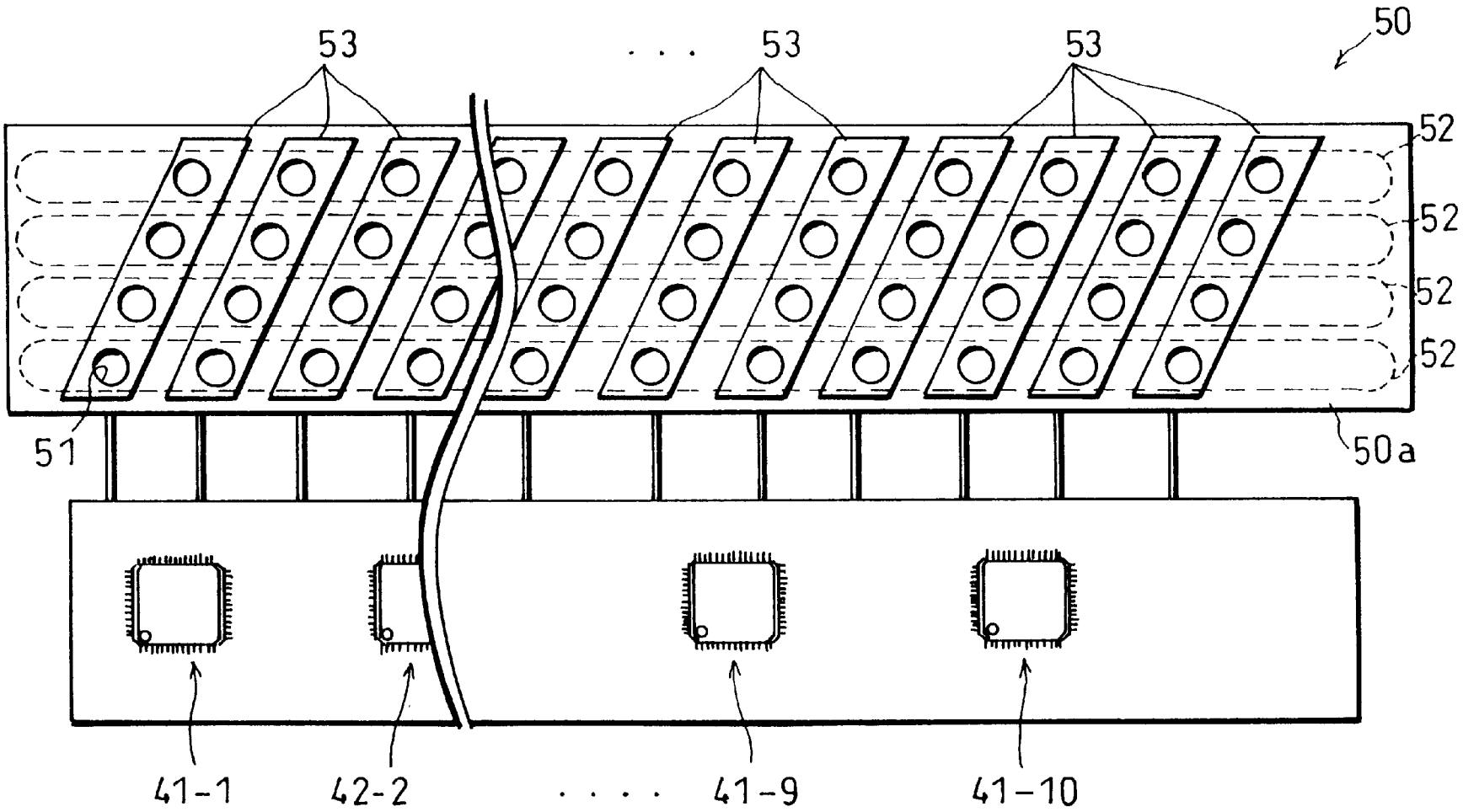
FIG. 28 is a plan view showing a structure of a control electrode of a matrix drive.
Figure 29:
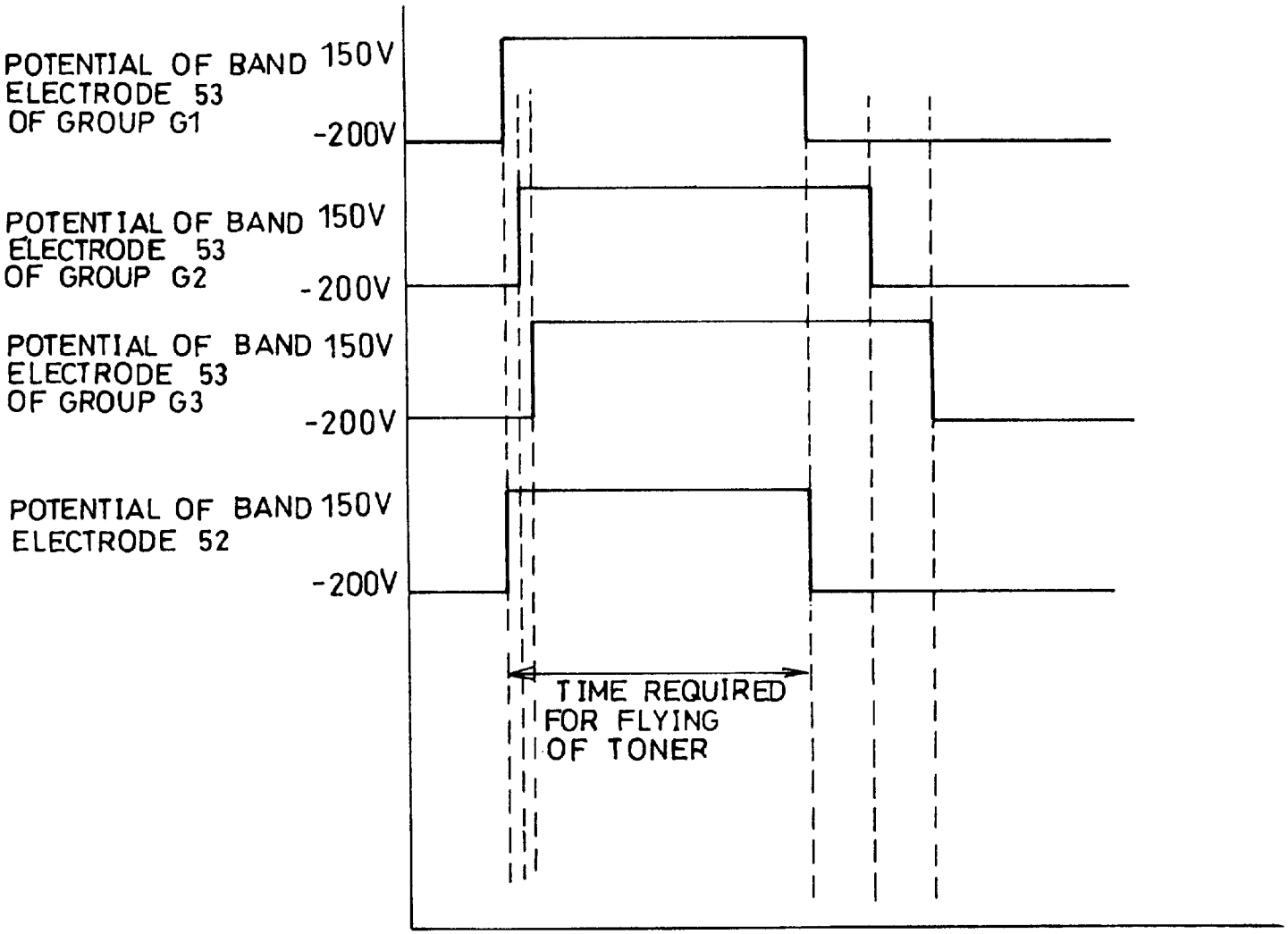
FIG. 29 is an explanatory drawing showing waveforms of potentials applied to two types of band electrodes of the control electrode.

The following will describe another embodiment of the present invention referring to FIG. 28 and FIG. 29. Note that, members having the same functions as the members described in First Embodiment are given the same reference numerals and explanations thereof are omitted here.

First Embodiment adopted a so-called single drive control electrode, which controls the passage of toner through a single gate corresponding to the ring electrode by controlling the potential applied to a single ring electrode. However, the present embodiment adopts, as shown in FIG. 28, a control electrode 50 of a matrix drive.

As with the control electrode of First Embodiment, the control electrode 50 has gates 51 constituting a passage of toner. In the lengthwise direction of a substrate 50*a* of the control electrode 50, there are provided 640 gates 51 per one line, and this set of gates 51 is provided in four lines. Therefore, a total of 2560 (640×4=2560) gates 51 are provided in matrix on the control electrode 50.

The substrate 50*a* is provided with band electrodes 52 (first electrodes) on the side of the counter electrode, and band electrodes 53 (second electrodes) on the side of the toner carrier. FIG. 28 is a plan view of the substrate 50*a* viewed from the side of the toner carrier. The band electrodes 52 control altogether passage of toner through 640 gates 51 provided in the lengthwise direction of the substrate 50*a*, and a total of four band electrodes 52 are provided along the short side direction of the substrate 50*a*. The band electrodes 53 control altogether passage of toner through four gates 51 provided substantially along the short side direction of the substrate 50*a*, and 640 gates 51 are provided, corresponding to the number of lines of the gates 51.

The control power source section 36 (see FIG. 3) is connected to each of the four band electrodes 52, and also connected to each of the band electrodes 53, via the high voltage ICs 41-1 through 41-10, the same as the ones described in First Embodiment. The control power source section 36 controls the potential applied to the band electrodes 53 provided in large numbers through respective high voltage ICs. Note that, 64 band electrodes 53 are connected to a single high voltage IC.

In the described structure, the control power source section 36 applies a predetermined potential to the band electrodes 52 and to the band electrodes 53, and in the same principle as that of Example 4 for example, carries out a control of shifting the timing of applying the ON potential and/or OFF potential to the band electrodes 53 belonging to a predetermined group.

As a result, passage of toner through the gates 51 at the intersections of the band electrodes 52 and 53 is controlled, allowing toner to fly in a direction from the toner carrier to the counter electrode only when the ON potential is being simultaneously applied to the band electrodes 52 and 53.

With the described structure, the same effect as obtained in Example 4 is obtained by carrying out the control as described in Example 4, that is to shift the timing of applying the ON potential and/or OFF potential per group.

Also, the band electrodes 52 and 53 have a larger surface area than the ring electrodes described in First Embodiment, and therefore the current value of transient current generated when the potential is applied is also higher. Thus, when the timing of applying the ON potential and/or OFF potential to the band electrodes 52 and 53 is to be made the same, it would require a control power source section 36 having a large current capacity.

However, the present embodiment carries out a control of shifting the timing of applying the ON potential and/or OFF potential, and therefore the sum of transient currents at a predetermined time does not exceed the acceptable value even when the control electrode 50 having a large electrode area is adopted. As a result, it is not required to provide a control power source section 36 having a large current capacity.

Also, in Example 4, it was required to provide 40 high voltage ICs, each having 64 channels, when grouping the 2560 ring electrodes.

However, because the present embodiment adopts the control electrode 50 of a matrix drive, it is required to provide only 10 high voltage ICs, even though the number of gates remains the same at 2560. Therefore, with the structure of the present embodiment, it is possible to make the apparatus more compact by simplifying the circuit structure, and because smaller numbers of high voltage ICs are required, the cost of the apparatus can be reduced.

In the event where the switching circuits corresponding in number to the number of electrodes of the control electrode are adopted as the switching circuits for switching ON/OFF of the potential applied to the control electrode, instead of the high voltage ICs each having the output of 64 channels, while 2560 switching circuits are required in First Embodiment, only 644 switching circuits are required in the present embodiment, thus also reducing the cost of the circuit.

Further, because the number of electrodes of the control electrode 50 of a matrix drive is significantly smaller (substantially quarter in the present embodiment) than that of the single drive control electrode, even when the timing of applying the ON potential and/or OFF potential is shifted, the positional shift of dots as shown in FIG. 18(*a*) and FIG. 18(*b*) and FIG. 20 is not generated.

As a result, in the present embodiment, the quality of image is further improved compared with that of First Embodiment. Also, because the number of electrodes is smaller, as shown in FIG. 23(*a*) and FIG. 24, the apply time of ON potential of a group to which the ON potential is applied last does not become eminently longer than the apply time of ON potential of a group to which the ON potential is applied first. As a result, it is ensured that the problem such as nonuniform image density caused by increased apply time of ON potential is prevented.

Also, as shown in FIG. 29, even when the apply time of ON potential to the band electrodes 53 of group G2 or group G3 is increased, due to the characteristic of matrix driving, flying of toner only occurs in a time domain in which the band electrodes 52 and 53 simultaneously take the ON potential, and the flying of toner stops at the moment when the potential of the band electrodes 52 is switched to OFF potential. Therefore, even when the apply time of ON potential to the band electrodes 53 is increased, by carrying out a potential control of the band electrodes 52 appropriately, it is possible to prevent an increase in the amount of flying toner, thereby preventing generation of the above-mentioned problems associated with an increase in the amount of flying toner.

Note that, as with Example 4, it is possible to form a group, for example, with two high voltage ICs, and carry out a control of simultaneously applying a potential to 128 band electrodes 53. It is also possible to constitute a group with three or more high voltage ICs.

Also, it is possible to have a structure where the shield electrode as described in First Embodiment is provided on the side of the toner carrier and/or counter electrode of the control electrode 50 of the present embodiment. When the shield electrode is provided, as described, the transient current supplied from the control power source section 36 is increased. However, because the control of shifting the timing of applying the ON potential and/or OFF potential to the band electrodes 53 is carried out, the sum of transient currents at a predetermined time does not exceed the acceptable value.

[Third Embodiment]

Figure 30:
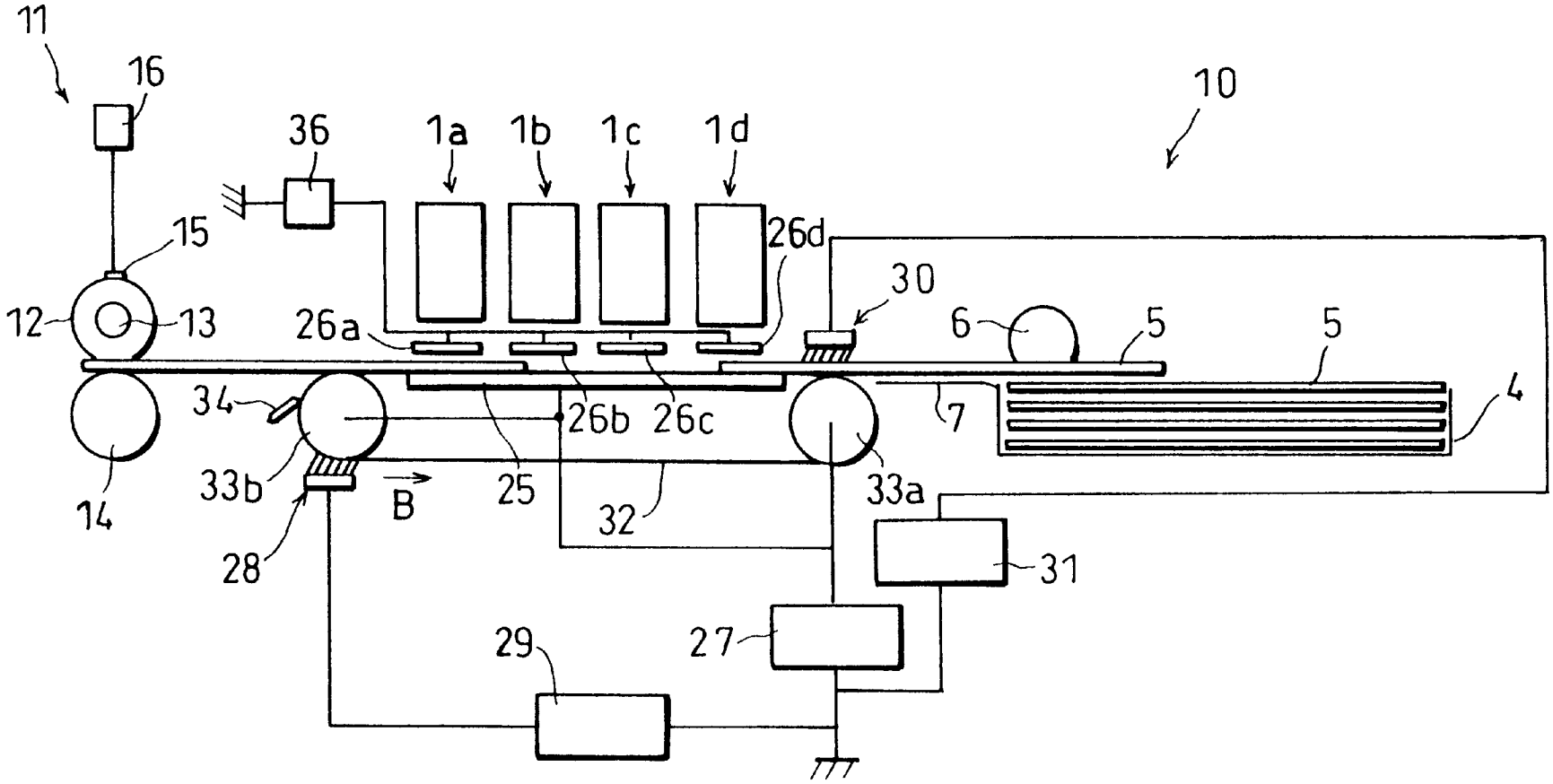
FIG. 30 is an explanatory drawing showing an arrangement of a color image forming apparatus as another embodiment of the image forming apparatus in accordance with the present invention.
Figure 31:
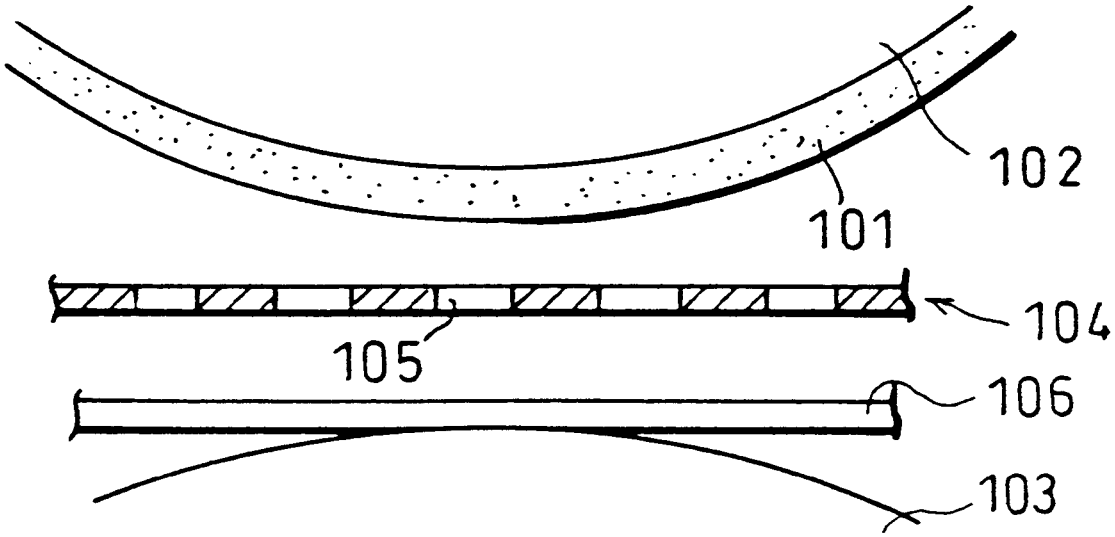
FIG. 31 PRIOR ART
FIG. 31 is a cross sectional view showing an enlarged view of an image forming section of a conventional image forming apparatus.
Figure 32:
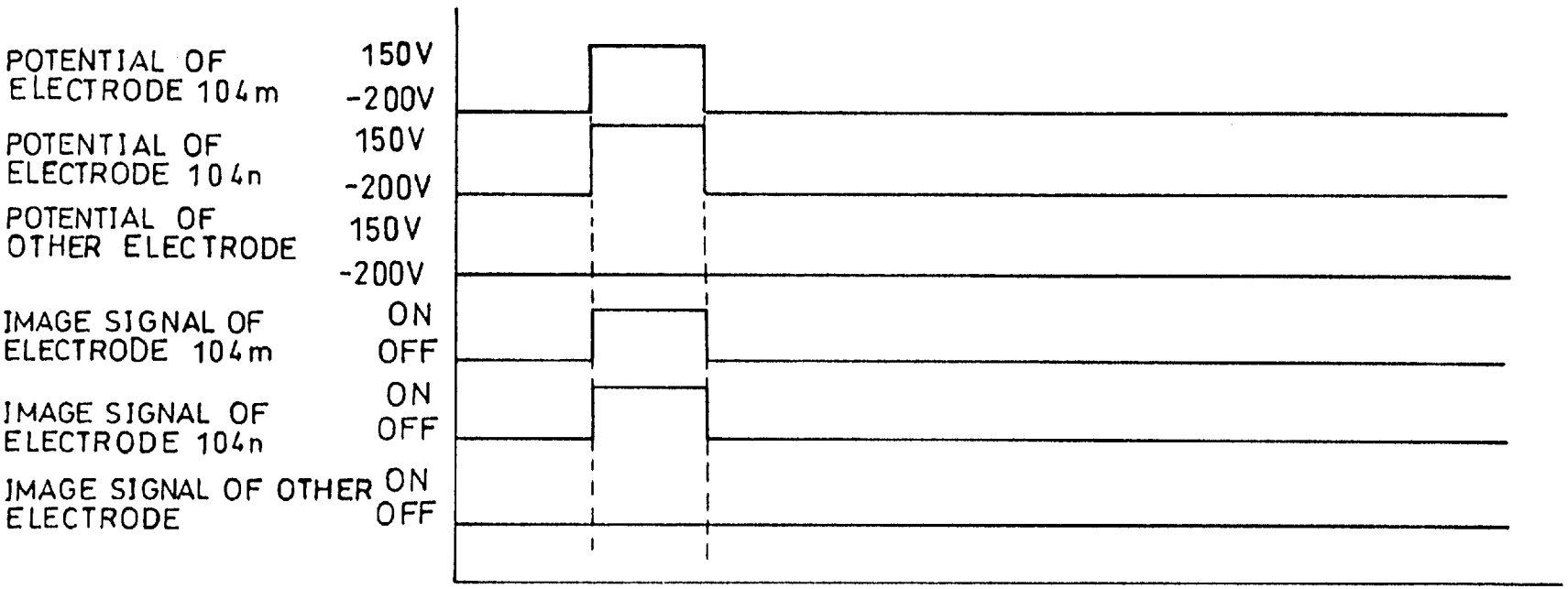
FIG. 32 PRIOR ART
FIG. 32 is an explanatory drawing showing waveforms of potential and image signal when a potential is simultaneously applied to a plurality of ring electrodes in accordance with an image signal in the conventional image forming apparatus.
Figure 33:
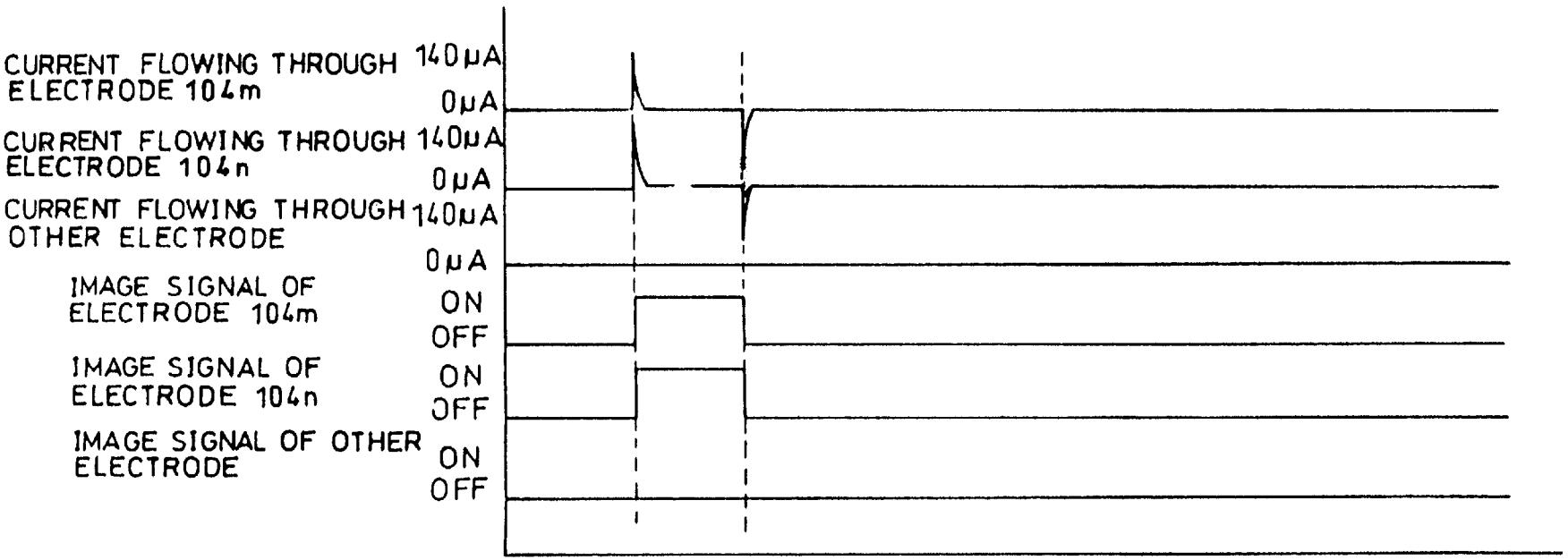
FIG. 33 PRIOR ART
FIG. 33 is an explanatory drawing showing waveforms of transient current and image signal when a potential is simultaneously applied to the plurality of ring electrodes in accordance with an image signal in the conventional image forming apparatus.

The following will describe yet another embodiment of the present invention referring to FIG. 30. The following explanation is based on the case where the control of shifting the timing of applying the ON potential and/or OFF potential, as described in First Embodiment, is applied to a color image forming apparatus. Note that, for convenience, members having the same functions as the members described in First and Second Embodiments are given the same reference numerals and explanations thereof are omitted here.

A color image forming apparatus of the present embodiment includes image forming sections 1*a*, 1*b*, 1*c*, and 1*d*, for which a toner supply section and a printing section are individually provided. Each toner supply section stores toners of, for example, yellow, magenta, cyan, and black. There are provided control electrodes 26*a*, 26*b*, 26*c*, and 26*d*, corresponding to the image forming sections 1*a*, 1*b*, 1*c*, and 1*d*, respectively, for controlling the electric field between a toner carrier of each toner supply section and the counter electrode 25. The control electrodes 26*a* through 26*d* may be of a single drive or a matrix drive. The other structure is the same as that of First Embodiment. An image forming operation is also the same as that of First Embodiment except that toner is flown onto the sheet 5 with respect to each of the image forming sections 1*a* through 1*d*.

The control power source section 36 carries out a control of shifting the timing of applying the ON potential and/or OFF potential so that the sum of transient currents flowing through respective ring electrodes of the control electrodes 26*a* through 26*d* at a predetermined time is smaller than the sum of maximum values of the transient currents flowing through the ring electrodes. As a result, the peaks of transient currents generated on the ring electrodes do not overlap, and it is not required to provide a control power source section 36 having a large current capacity.

In the color image forming apparatus of the present embodiment, the number of control electrodes is four times that of First Embodiment, and accordingly the sum of transient currents supplied to the ring electrodes by the control power source section 36 is also increased fourfold. Thus, in a conventional color image forming apparatus in which the potential is applied at the same timing, it is required to provide a power source whose current capacity is four times the current capacity of the power source used for the black-and-white image forming apparatus.

However, in the color image forming apparatus of the present embodiment, the control is carried out such that the peaks of transient currents do not overlap, allowing the power source of the black-and-white image forming apparatus to be used directly. That is, it is not required to provide a power source having a particularly large current capacity. Therefore, with the described structure, the cost of the power source used for the color image forming apparatus can be reduced, thereby reducing the overall cost of the apparatus.

Note that, in the color image forming apparatus, there is a case where the potential applied for controlling flying of toner is different for each color, and this case, the transient current value and the transient current duration are also different. In such a case, it is preferable to change the pattern of grouping the ring electrodes of each of the control electrodes 26*a* through 26*d*, for appropriately adjusting the timing of applying a potential to each of the control electrodes 26*a* through 26*d*.

Note that, in the described First through Third Embodiments, a DC (Direct Current) potential is used as an apply potential. However, not limiting to this, it is possible alternatively to use various types of potentials, such as an AC (Alternating Current) potential having a frequency component, and an AC potential having a frequency component and a DC component. Also, even though the apply pulse as described above takes the form of a rectangular wave, it may take a variety of pulse waveforms such as a triangular wave.

Further, in First through Third Embodiments, the control of shifting the timing of applying the potential to the control electrode was explained using the ON and OFF potentials. However, such a timing control may be carried out using potentials other than the ON and OFF potentials. In fact, the control of shifting the apply timing can be desirably carried out with respect to all kinds of potentials applied to the control electrode, such as a cleaning potential applied for cleaning of the control electrode 26, and a potential switched from the cleaning potential.

Also, as described in Example 6, in the case where the current generated at the switching of potential flows to the grounded portion, or in the case where such a current is supplied from the grounded portion, namely when such a current is not supplied directly from the power source, it is not particularly required to shift the apply timing with respect to application of a potential for generating such a current. For example, in the case where the cleaning potential is supplied from the grounded portion, it is not required to shift the apply timing with respect to application of the cleaning potential.

Note that, in First through Third Embodiments, the explanations are based on the case where the developer is the toner. However, the toner may be an ink, etc., which is chargeable. Further, the toner supply section may have a structure adopting an ion flow method. Namely, the image forming section may have a structure including an ion source such as a corona charger. The described functions and effects can also be obtained by such a structure.

Also, it is possible to adopt a combination of the structures of the described Examples or Embodiments In order to solve the above-mentioned problems, the image forming apparatus in accordance with the present invention icludes: a carrier for carrying developer partices; a counter electrode positioned so as to face the carrier; a control electrode section, having a plurality of passage pores constituting a passage of developer particles and a plurality of gate electrodes formed one to one around the plurality of passage pores, for controlling flying of the developer particles from the carrier towards the counter electrode by changing the electric field between the carrier and the counter electrode in accordance with the potential applied to each of the plurality of gate electrodes; and potential applying means for applying a potential that is in accordance with an image signal to the plurality of gate electrodes, the image forming apparatus characterized in that the potential applying means applies a predetermined potential to each of the plurality of gate electrodes so that a sum of current flowing through each of the plurality of gate electrodes at a predetermined time by application of the predetermined potential is smaller than a sum of maximum value of the current flowing through each of the plurality of gate electrodes.

With this arrangement, the potential applying means applies a predetermined potential to the gate electrodes of the control electrode section, thus controlling flying of the developer particles, held on the carrier, towards the counter electrode.

Here, when the potential applying means applies the predetermined potential to the gate electrodes, a transient current momentarily flows through each gate electrode. If the timing of applying the predetermined potential is the same, the transient current is supplied from the potential applying means simultaneously. This means that when the number of gate electrodes is large, potential applying means having a large supplying ability of a transient current is required.

However, in the described arrangement, the potential applying means applies the predetermined potential to each gate electrode so that the sum of current flowing through each gate electrode at a predetermined time is smaller than the sum of maximum value of the current flowing through each gate electrode. The potential applying means may realize this control, for example, by shifting the timing of applying the predetermined potential by a predetermined amount with respect to each gate electrode, or by grouping the plurality of gate electrodes, and while simultaneously applying the predetermined potential to the gate electrodes of a same group, applying the predetermined potential to the gate electrodes of different groups at a different timing.

This ensures that the amount of current supplied at a predetermined time by the potential applying means is significantly reduced compared with the conventional case where the potential is applied to the gate electrodes at the same timing. As a result, it is not required to provide potential applying means having a particularly large current capacity even when the number of gate electrodes is increased.

Therefore, with the described arrangement, even when adopting a control electrode section having large numbers of gate electrodes, it is possible to use potential applying means having the conventional current capacity, thus preventing an increase in size and cost of the potential applying means, preventing in turn an increase in size and cost of the apparatus.

Also, because the current capacity of the potential applying means is not particularly large, even when a high voltage leak, etc., is generated via the control electrode section, the output potential is reduced to some degree upon occurrence of such an event. Therefore, problems, such as destruction of other circuits and the apparatus, do not occur, thus improving reliability of the apparatus and eliminating the need of a high-level insulation measure.

Note that, as long as the transient current is flown as a result of applying the potential to the gate electrodes, the potential may be a potential for controlling flying of developer particles, such as a flying potential for allowing the developer particles to fly towards the counter electrode and a flying preventing potential for preventing flying of developer particles towards the counter electrode, or alternatively, a cleaning potential for cleaning the control electrode section.

The image forming apparatus may have an arrangement wherein the potential applying means applies the flying potential for allowing the developer particles to fly towards the counter electrode first to a predetermined gate electrode, and then to another gate electrode after an elapsed time which is different from a duration of a transient current generated when the flying potential is applied.

With this arrangement, even though the transient current generally has a waveform which becomes maximum (peak is generated) at a predetermined time, the peak of a transient current flowing through one gate electrode by application of the flying potential does not overlap with the peak of a transient current flowing through another gate electrode by application of the flying potential. Therefore, it is ensured that the sum of transient currents flowing at a predetermined time is smaller than the sum of maximum values of the transient currents flowing through individual gate electrodes. As a result, with the described arrangement, even when the potential applied to the gate electrodes is the flying potential, the effect of the described arrangement is obtained with certainty.

The image forming apparatus may have an arrangement wherein the potential applying means applies the flying potential first to a predetermined gate electrode, and then to another gate electrode after an elapsed time which is longer than the duration of the transient current.

With this arrangement, the transient current flowing through one gate electrode by application of the flying potential does not overlap in time with. the transient current flowing through another gate electrode by application of the flying potential. As a result, the sum of transient currents which flow at a predetermined time is the transient current flowing through a single gate electrode. Thus, in accordance with the above arrangement, the potential applying means only needs to be provided with a current capacity capable of supplying a transient current for a single gate electrode at a predetermined time, allowing the use of potential applying means having a small current capacity. As a result, it is possible to reduce the cost of the potential applying means, and in turn, the cost and size of the apparatus.

The image forming apparatus may have an arrangement wherein the potential applying means applies the flying potential first to a predetermined gate electrode, and then to another gate electrode after an elapsed time which is shorter than the duration of the transient current.

With this arrangement, it is possible to further reduce the timing shift of flying potential application while maintaining the effect that the sum of transient currents which flow at a predetermined time is smaller than the sum of maximum values of transient currents flowing through individual gate electrodes. This minimizes the positional shift of dots formed on a recording medium, which is induced by the timing shift of potential application, thus obtaining a desirable image, in which image distortion is negligible.

The image forming apparatus may have an arrangement wherein the potential applying means applies a flying preventing potential for preventing flying of the developer particles towards the counter electrode first to a predetermined gate electrode, and then to another gate electrode after an elapsed time which is different from a duration of a transient current generated when the flying preventing potential is applied.

With this arrangement, the peak of a transient current flowing through one gate electrode by application of the flying preventing potential does not overlap with the peak of a transient current flowing through another gate electrode by application of the flying preventing potential.

As a result, it is ensured that the sum of transient currents which flow at a predetermined time is smaller than the sum of maximum values of the transient currents flowing through individual gate electrodes. Thus, with the above arrangement, the described effect is obtained with certainty even when the potential applied to the gate electrodes is the flying preventing potential.

The image forming apparatus may have an arrangement wherein the potential applying means applies the flying preventing potential first to a predetermined gate electrode, and then to another gate electrode after an elapsed time which is longer than the duration of the transient current.

With this arrangement, the transient current flowing through one gate electrode by application of the flying preventing potential does not overlap in time with the transient current flowing through another gate electrode by application of the flying preventing potential.

As a result, with the described arrangement, the sum of transient currents which flow at a predetermined time is the transient current which flows through a single gate electrode. Thus, in accordance with the described arrangement, the potential applying means only needs to be provided with a current capacity capable of supplying the transient current for a single gate electrode at a predetermined time, allowing the use of potential applying means having a small current capacity. As a result, it is possible to reduce the cost of the potential applying means, and in turn, the cost and size of the apparatus.

The image forming apparatus may have an arrangement wherein the potential applying means applies the flying preventing potential first to a predetermined gate electrode, and then to another gate electrode after an elapsed time which is shorter than the duration of the transient current.

With this arrangement, compared with the above-described arrangement, it is possible to further reduce the timing of applying the flying preventing potential while maintaining the effect that the sum of transient currents which flow at a predetermined time is smaller than the sum of maximum values of the transient currents flowing through individual gate electrodes. This minimizes the positional shift of dots formed on a recording medium, which is induced by the timing shift of potential application, thus obtaining a desirable image, in which image distortion is negligible.

The image forming apparatus may have an arrangement wherein, in the case where a duration of a transient current generated when the flying preventing potential is applied to each of the plurality of gate electrodes is longer than a duration of a transient current generated when the flying potential is applied to each of the plurality of gate electrodes, the potential applying means applies the flying potential to each of the plurality of gate electrodes while adjusting an apply time of the flying potential so that durations of transient currents generated when the flying preventing potential is applied do not overlap with one another.

With this arrangement, when a duration (hereinafter "second duration") of a transient current generated when the flying preventing potential is applied is longer than a duration (herein after "first duration") of a transient current generated when the flying potential is applied, by the potential applying means adjusting the apply time of the flying potential, durations of transient currents generated when the flying preventing potential is applied do not overlap with one another. Note that, without adjustment of the apply time of the transient current, when the apply time of the flying potential is the same, there is a case where durations of transient currents generated when the flying preventing potential is applied are overlapped, even when durations of transient currents which flow by application of the flying potential are not overlapped.

Therefore, with the described arrangement, when second duration is longer than first duration, by only carrying out the control of preventing overlap of durations of transient currents which flow when the flying potential is applied, it is possible to provide potential applying means with a small current capacity, that is, with the capacity for supplying the transient current for a single gate electrode. As a result, the cost of the potential applying means can be reduced, reducing in turn the cost and size of the apparatus.

The image forming apparatus may have an arrangement wherein, when a duration of a transient current generated when a flying potential is applied to each of the plurality of gate electrodes is time t1 and when a duration of a transient current generated when a flying preventing potential is applied to each of the plurality of gate electrodes is time t2, in the case where time t1 and time t2 are different, the potential applying means applies the flying potential and the flying preventing potential to each of the plurality of gate electrodes at a timing which is shifted by an amount longer than time t1 and time t2 and by an amount closer to longer of time t1 and time t2.

With this arrangement, the potential applying means applies the flying potential and the flying preventing potential with a timing shift by an amount longer than time t1 and time t2. Thus, durations of transient currents do not overlap in either case when the flying potential is applied and when the flying preventing potential is applied. Thus, it is possible to provide potential applying means with a small current capacity, that is, with the capacity for supplying the transient current for a single gate electrode. As a result, the cost of the potential applying means can be reduced, reducing in turn the cost and size of the apparatus.

Further, because the potential applying means applies the flying potential and the flying preventing potential with a timing shift by an amount longer of time t1 and time t2, the apply time of flying potential does not become longer than necessary.

Incidentally, when the apply time of flying potential becomes longer than necessary, the amount of flying developer particles is increased, and as a result the amount of developer particles consumed is also increased. Further, due to an increase in the amount of flying developer particles, the dot diameter formed on a recording medium is increased, flattening the image and increasing the dot density, and thus failing to obtain a desired image density. As a result, problems such as lowering of image definition and insufficient reproduction of halftone image are presented.

However, with the described arrangement, the apply time of flying potential can be minimized, and the above problems are not presented, thus proving an image with a desirable quality.

The image forming apparatus may have an arrangement wherein, preferably, the flying preventing potential applied to each of the plurality of gate electrodes is a ground potential.

With this arrangement, a supply source for supplying the flying preventing potential is a grounded portion with an unlimited current capacity, and therefore it is not required to carry out the control of preventing overlapping peaks of transient currents generated when the flying preventing potential is applied to each gate electrode. As a result, the above control only needs to be carried out when applying the flying potential, thus simplifying the entire control of potential application with respect to each gate electrode.

The image forming apparatus may have an arrangement wherein the potential applying means divides the plurality of gate electrodes into a plurality of groups, and simultaneously applies the predetermined potential to gate electrodes of a same group, while applying the predetermined potential to gate electrodes of different groups at a different timing.

With this arrangement, a predetermined potential is simultaneously applied to the gate electrodes of the same group. Yet, here, the sum of transient currents at a predetermined time is only the sum of transient currents flowing through the gate electrodes of a single group, which is apparently smaller than the product of the maximum value of a transient current times the number of gate electrodes. Therefore, the same effect as obtained in the described arrangement is obtained.

Also, compared with the case where the timing of applying the potential is shifted among individual gate electrodes, by shifting the timing of applying a potential in a group unit, it is possible to finish the potential application to all the gate electrodes more quickly, and shifting of application timing occurs less often, thus obtaining the effect of quick image formation and desirable image formation with essentially no positional shift of dots.

The image forming apparatus may have an arrangement wherein the potential applying means subsequently applies the predetermined potential with respect to groups adjacent to one another at a different timing.

With this arrangement, the positional shift of dots generated by a timing delay becomes equal among adjacent groups, and distortion of the image becomes almost unnoticeable. Namely, distortion of the image is suppressed to the degree which is almost unrecognizable, thereby forming an image natural to the user, despite the fact that the positional shift of dots is actually generated.

The image forming apparatus may have an arrangement wherein the potential applying means applies the predetermined potential with respect to groups in a vicinity of one another at a different timing.

With this arrangement, the positional shift of dots generated by a timing delay differs among adjacent groups, and for this reason the effect obtained is not as good as the effect obtained by subsequently applying a predetermined potential to adjacent groups. Even so, the positional shift is not as extreme as to be perceived as unnatural among adjacent groups. Therefore, an image in which the distortion is hardly recognized can also be obtained by subsequently applying a predetermined potential with respect to groups in a vicinity of one another.

The image forming apparatus may have an arrangement including a plurality of potential switching means for switching the potential applied to each of the plurality of gate electrodes by the potential applying means, the plurality of potential switching means being connected to the plurality of gate electrodes in a group unit, and the potential applying means applies the predetermined potential to each of the plurality of gate electrodes via the plurality of potential switching means.

With this arrangement, because the gate electrodes are connected to the plurality of potential switching means in a group unit, the control of applying the predetermined potential to all the gate electrodes can be carried out per potential switching means, that is, per group. As a result, it is possible to simplify the control of potential application compared with the case of carrying out the control of potential application with respect to individual gate electrodes.

The image forming apparatus may have an arrangement wherein the potential applying means divides the plurality of potential switching means into a plurality of groups, and carries out a control of potential application per each group.

With this arrangement, groups of plurality of potential applying means are formed, and the control of potential application is carried out per group, thus further simplifying the control of potential application, compared with the case of carrying out the control of potential application per potential switching means.

The image forming apparatus may have an arrangement wherein the plurality of gate electrodes are composed of a plurality of first electrodes and a plurality of second electrodes for controlling altogether passage of developer particles through the plurality of passage pores, the plurality of first electrodes and the plurality of second electrodes being disposed so as to intersect one another, and controlling, in accordance with the potential applied to each of the plurality of the gate electrodes, passage of developer particles through the plurality of passage pores where the plurality of first electrodes and the plurality of second electrodes intersect, and the potential applying means controls a potential applied to either one of the plurality of first electrodes and the plurality of second electrodes.

With this arrangement, the developer particles fly via the passage pores at the intersections of the first electrodes and the second electrodes only when, for example, the flying potential is simultaneously applied to the first electrodes and the-second electrodes.

Here, even in the case where the apply time of the flying potential applied to one of the electrodes (first or second electrodes) is increased more than necessary, for example, by the described control of potential application, because a normal control of potential application is carried out with respect to the other electrodes, when the flying preventing potential is applied to this electrodes, flying of developer particles is stopped even when the flying potential is applied to the electrodes with an increased apply time.

Therefore, with the above arrangement, it is possible to prevent an increase in the amount of flying developer particles even when the apply time of the flying potential to one of the first and second electrodes is increased more than necessary, thereby preventing an increase in the amount of developer particles consumed and image deterioration such as nonuniform image density.

The image forming apparatus may have an arrangement wherein, preferably, the plurality of passage pores are formed so as to correct a positional shift of dots generated on a recording medium by a timing shift when the potential applying means applies the predetermined potential to each of the plurality of gate electrodes.

With this arrangement, the positional shift of dots caused by timing shift of potential application does not generate, and a desirable image with no distortion is obtained despite the fact that the control of shifting the timing of potential application is carried out.

In order to solve the foregoing problems, another image forming apparatus of the present invention includes: a plurality of carriers, each carrying developer particles of different color; a counter electrode positioned so as to face the plurality of carriers; a plurality of control electrode sections, each having a plurality of passage pores constituting a passage of developer particles and a plurality of gate electrodes formed one to one around the plurality of passage pores, for controlling flying of the developer particles from the carriers towards the counter electrode by changing the electric field between the carriers and the counter electrode in accordance with the potential applied to each of the plurality of gate electrodes; and potential applying means for applying a potential that is in accordance with an image signal to the plurality of gate electrodes, the image forming apparatus characterized in that the potential applying means applies a predetermined potential to each of the plurality of gate electrodes so that a sum of current flowing through each of the plurality of gate electrodes at a predetermined time by application of the predetermined potential is smaller than a sum of maximum value of the current flowing through each of the plurality of gate electrodes.

With this arrangement, the potential applying means applies a predetermined potential to the gate electrodes of each control electrode section, and as a result flying of developer particles of predetermined colors held on their respective carriers in a direction towards the counter electrode is controlled with respect to each carrier, thus forming a color image.

When the potential applying means applies the predetermined potential to the gate electrodes, a transient current is flown momentarily through each gate electrode. Here, if the timing of applying the potential is the same, the transient current is simultaneously supplied from the potential applying means, and this means that when the number of gate electrodes is large, potential applying means capable of supplying a large transient current is required. Also, in the above color image forming apparatus, for example, the number of control electrodes is four times that of the black-and-white image forming apparatus, and accordingly the sum of transient current supplied to each gate electrode by the potential applying means is also increased fourfold, requiring potential applying means having a current capacity four times larger than that of the black-and-white image forming apparatus.

However, with the above arrangement, the potential applying means applies the predetermined potential to the gate electrodes so that the sum of current flowing through each gate electrode at a predetermined time is smaller than the sum of maximum value of the current flowing through each gate electrode. The potential applying means realizes this control, for example, by shifting the timing of potential application by a predetermined amount when applying the predetermined potential to each gate electrode, or alternatively, by grouping the plurality of gate electrodes, and then by applying the potential to the gate electrodes of the same group at the same timing, while applying the potential to the gate electrodes of different groups at a different timing.

As a result, the amount of current supplied momentarily by the potential applying means is reduced with certainty compared with the conventional case where the potential is applied to the gate electrodes at the same timing. Thus, it is not required to provide potential applying means having a particularly large current capacity, even when the number of gate electrodes is increased.

Therefore, with the described arrangement, it is possible to use potential applying means having the same current capacity as that of the black-and-white image forming apparatus even when the control electrode sections having large numbers of gate electrodes are used, thus preventing an increase in size and cost of the potential applying means, and in turn size and cost of the apparatus.

Also, because the current capacity of the potential applying means is not particularly large, even when a high voltage leak, etc., is generated via the control electrode section, the output potential is reduced to some degree upon occurrence of such an event. Therefore, problems, such as destruction of other circuits and the apparatus, do not occur, thus improving reliability of the apparatus, and it is not required to take a high-level insulation measure with the described arrangement.

Note that, as long as the transient current is flown as a result of applying the potential to the gate electrodes, the potential may be a potential for controlling flying of developer particles, such as the flying potential for allowing the developer particles to fly towards the counter electrode and the flying preventing potential for preventing flying of developer particles towards the counter electrode, or alternatively, a cleaning potential for cleaning the control electrode section.

The image forming apparatus may have an arrangement wherein the potential applying means applies the predetermined potential to each of the plurality of gate electrodes at a different timing with respect to each of the plurality of control electrode sections.

With this arrangement, the timing of applying the potential to the gate electrodes is changed per control electrode section, that is, per each color of the developer particles, and therefore it is possible to control flying of developer particles of each color with an optimum condition in accordance with the characteristics of the developer particles of each color, thus improving the quality of the color image formed.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a carrier for carrying developer particles;

a counter electrode positioned so as to face said carrier;

a control electrode section having a plurality of passage pores constituting a passage of developer particles flying from said carrier to said counter electrode, and a plurality of gate electrodes formed one to one around the plurality of passage pores; and potential applying means for applying a potential that is in accordance with an image signal to the plurality of gate electrodes, wherein, in a case where a duration of a transient current generated when a flying preventing potential is applied to each of the plurality of gate electrodes is longer than a duration of a transient current generated when a flying potential is applied to each of the plurality of gate electrodes, said potential applying means applies the flying potential to each of the plurality of gate electrodes while adjusting an apply time of the flying potential so that durations of the transient current generated when the flying preventing potential is applied do not overlap one another.

2. The image forming apparatus as set forth in claim 1, wherein said potential applying means applies a flying potential for allowing the developer particles to fly towards said counter electrode first to a predetermined gate electrode, and then to another gate electrode after an elapsed time which is different from a duration of a transient current generated when the flying potential is applied.

3. The image forming apparatus as set forth in claim 2, wherein said potential applying means applies the flying potential first to a predetermined gate electrode, and then to another gate electrode after an elapsed time which is longer than the duration of the transient current.

4. The image forming apparatus as set forth in claim 2, wherein said potential applying means applies the flying potential first to a predetermined gate electrode, and then to another gate electrode after an elapsed time which is shorter than the duration of the transient current.

5. The image forming apparatus as set forth in claim 1, wherein said potential applying means applies a flying preventing potential for preventing flying of the developer particles towards said counter electrode first to a predetermined gate electrode, and then to another gate electrode after an elapsed time which is different from a duration of a transient current generated when the flying preventing potential is applied.

6. The image forming apparatus as set forth in claim 5, wherein said potential applying means applies the flying preventing potential first to a predetermined gate electrode, and then to another gate electrode after an elapsed time which is longer than the duration of the transient current.

7. The image forming apparatus as set forth in claim 5, wherein said potential applying means applies the flying preventing potential first to a predetermined gate electrode, and then to another gate electrode after an elapsed time which is shorter than the duration of the transient current.

8. An image forming apparatus comprising:

a carrier for carrying developer particles;

a counter electrode positioned so as to face said carrier, a control electrode section having a plurality of passage pores constituting a passage of developer particles flying from said carrier to said counter electrode, and a plurality of gate electrodes formed one to one around the plurality of passage pores; and potential applying means for applying a potential that is in accordance with an image signal to the plurality of gate electrodes, wherein, when a duration of a transient current generated when a flying potential is applied to each of the plurality of gate electrodes is time t1 and when a duration of a transient current generated when a flying preventing potential is applied to each of the plurality of gate electrodes is time t2, in a case where the time t1 and the time t2 are different, said potential applying means applies the flying potential and the flying preventing potential to each of the plurality of gate electrodes at a timing which is shifted by an amount longer than the greater of the time t1 or the time t2.

9. The image forming apparatus as set forth in claim 5, wherein the flying preventing potential applied to each of the plurality of gate electrodes is a ground potential.

10. The image forming apparatus as set forth in claim 2, wherein the flying potential applied to each of the plurality of gate electrodes is a ground potential.

11. The image forming apparatus as set forth in claim 1, wherein said potential applying means divides the plurality of gate electrodes into a plurality of groups, and simultaneously applies the predetermined potential to gate electrodes of a same group, while applying the predetermined potential to gate electrodes of different groups at a different timing.

12. The image forming apparatus as set forth in claim 11, wherein said potential applying means subsequently applies the predetermined potential with respect to groups adjacent to one another at a different timing.

13. The image forming apparatus as set forth in claim 11, wherein said potential applying means applies the predetermined potential with respect to groups in a vicinity of one another at a different timing.

14. The image forming apparatus as set forth in claim 1, further comprising:

a plurality of potential switching means for switching the potential applied to each of the plurality of gate electrodes by said potential applying means, said plurality of potential switching means being connected to the plurality of gate electrodes in a group unit, and said potential applying means applying the predetermined potential to each of the plurality of gate electrodes via said plurality of potential switching means.

15. The image forming apparatus as set forth in claim 14, wherein said potential applying means divides said plurality of potential switching means into a plurality of groups, and carries out a control of potential application per each group.

16. The image forming apparatus as set forth in claim 1, wherein:

said plurality of gate electrodes are composed of a plurality of first electrodes and a plurality of second electrodes for controlling altogether passage of the developer particles through said plurality of passage pores, the plurality of first electrodes and the plurality of second electrodes being disposed so as to intersect one another, and controlling, in accordance with the potential applied to each of the plurality of the gate electrodes, passage of the developer particles through said plurality of passage pores where the plurality of first electrodes and the plurality of second electrodes intersect, and said potential applying means controls a potential applied to either one of the plurality of first electrodes and the plurality of second electrodes.

17. The image forming apparatus as set forth in claim 1, wherein said plurality of passage pores are formed so as to correct a positional shift of dots generated on a recording medium by a timing shift when said potential applying means applies the predetermined potential to each of the plurality of gate electrodes.

18. The image forming apparatus as set forth in claim 1, wherein said potential applying means shifts a timing of applying a flying potential to each of the plurality of gate electrodes, the flying potential being a potential for allowing the developer particles to fly towards said counter electrode.

19. The image forming apparatus as set forth in claim 18, wherein said potential applying means shifts the timing of applying the flying potential to each of the plurality of gate electrodes in accordance with a duration of a transient current generated when the flying potential is applied.

20. The image forming apparatus as set forth in claim 1, wherein said potential applying means applies the flying potential, which is applied to cause the developer particles to fly toward the counter electrode, to a predetermined gate electrode, and then to another gate electrode after an elapsed time period which is in accordance with a duration of the transient current generated when the flying potential is applied.

* * * * *